US006698710B1

(12) United States Patent
VanderWerf

(10) Patent No.: US 6,698,710 B1
(45) Date of Patent: Mar. 2, 2004

(54) SYSTEM FOR THE CONSTRUCTION OF INSULATED CONCRETE STRUCTURES USING VERTICAL PLANKS AND TIE RAILS

(75) Inventor: Pieter A. VanderWerf, Stoughton, MA (US)

(73) Assignee: Portland Cement Association, Skokie, IL (US)

( * ) Notice: Subject to any disclaimer, the term of this patent is extended or adjusted under 35 U.S.C. 154(b) by 0 days.

(21) Appl. No.: 09/742,577

(22) Filed: Dec. 20, 2000

(51) Int. Cl.[7] ..... E04G 17/06

(52) U.S. Cl. ..... 249/216; 249/218; 249/193; 249/159; 52/294

(58) Field of Search ..... 249/48, 209, 159, 249/193, 194, 219.1, 47, 44, 45, 191, 192, 216, 218; 52/294, 562, 426, 277

(56) References Cited

U.S. PATENT DOCUMENTS

| | | | |
|---|---|---|---|
| 1,244,870 | A | 10/1917 | Levens |
| 1,738,842 | A | 12/1929 | Ray |
| 2,339,220 | A | 1/1944 | Crowley |
| 3,293,813 | A | 12/1966 | Emmons et al. |
| 3,423,891 | A | 1/1969 | Burris |
| 3,508,364 | A | 4/1970 | Thompson |
| 3,697,039 | A | 10/1972 | Phelps et al. |
| 3,713,257 | A | 1/1973 | Beavers |
| 3,772,842 | A | 11/1973 | Barbera |
| 3,788,020 | A | 1/1974 | Gregori |
| 3,835,586 | A | 9/1974 | Gates et al. |
| 3,849,957 | A | 11/1974 | Bastgen |
| 3,902,296 | A | 9/1975 | Thomas |
| 3,956,864 | A | 5/1976 | Fung |
| 3,994,470 | A | 11/1976 | Nakada |
| 3,995,843 | A | 12/1976 | Kasteler |
| 4,047,691 | A | 9/1977 | Wolf |
| 4,056,908 | A | 11/1977 | McManus |

(List continued on next page.)

FOREIGN PATENT DOCUMENTS

| | | |
|---|---|---|
| AU | 146585 | 5/1952 |
| AU | 486232 | 9/1974 |
| CH | 571629 | 1/1976 |
| DE | 1103549 | 3/1961 |
| FR | 483097 | 5/1917 |
| FR | 2556387 | 6/1985 |
| GB | 544943 | 5/1942 |

OTHER PUBLICATIONS

Article entitled "Thermalite® . . . Forms That Perform™," 2 pages, Dec. 1999.

TechSYSTEMS "Building the Future Block by Block," entitled "Stay–in–Place Insulating Concrete Form System," 6 pages, Dec. 1999.

(List continued on next page.)

*Primary Examiner*—Carl D. Friedman
*Assistant Examiner*—Chi Q. Nguyen
(74) *Attorney, Agent, or Firm*—Fitch, Even, Tabin & Flannery

(57) ABSTRACT

An improved system and methods for forming foundations, walls, buildings and other structures having one or more walls made of concrete or other pourable, hardenable materials. The system uses substantially rigid forming panels and is "open" in that forming panels from a variety of sources can be utilized in the system with limited (if any) changes or alterations to the components used in the system. Such panels particularly include insulating foam panels, and also include other substantially rigid panels of other materials which may provide additional insulating properties.

The system and methods provide wall tie rail and corner assemblies that are adaptable for use in a variety of construction applications using forming procedures and techniques readily adaptable from conventional forming system construction and assembly procedures. The tie rails and corner assemblies may be made of a variety of materials to provide properties such as reduced weight and cost, and/or fire and insect resistance, without regard to the panel materials. The forming system and methods of the invention further provide improved footing systems, and window and door construction, and multi-level forming capabilities.

117 Claims, 32 Drawing Sheets

U.S. PATENT DOCUMENTS 4,065,540 A 12/1977 Okami
4,138,084 A 2/1979 Reid
4,151,694 A 5/1979 Sriberg et al.
4,159,099 A 6/1979 Maguire
4,189,883 A 2/1980 McManus
4,229,920 A 10/1980 Lount
4,234,156 A 11/1980 Wepf
4,239,176 A 12/1980 Salazar
4,259,822 A 4/1981 McManus
4,368,604 A 1/1983 Spielau et al.
4,380,329 A 4/1983 Nunno
4,433,520 A 2/1984 Masckhoff
4,439,961 A 4/1984 Witte
4,439,967 A 4/1984 Dielenberg
4,516,372 A 5/1985 Grutsch
4,589,624 A 5/1986 Jones
4,604,843 A 8/1986 Ott et al.
4,633,634 A 1/1987 Nemmer et al.
4,653,237 A 3/1987 Taft
4,655,014 A 4/1987 Krecke
4,678,156 A 7/1987 Scalamandre et al.
4,730,422 A 3/1988 Young
4,738,061 A 4/1988 Herndon
4,742,659 A 5/1988 Meilleur
4,742,665 A 5/1988 Baierl
4,750,308 A 6/1988 McKay
4,757,651 A 7/1988 Crites
4,765,109 A 8/1988 Boeshart
4,796,727 A 1/1989 Eaton
4,809,474 A 3/1989 Ekberg, Jr.
4,835,928 A 6/1989 Scott
4,866,891 A * 9/1989 Young ..... 52/105
4,885,888 A 12/1989 Young
4,889,310 A 12/1989 Boeshart
4,924,579 A 5/1990 Berendsen
4,924,641 A * 5/1990 Gibbar, Jr. ..... 52/204
4,932,134 A 6/1990 Meadows
4,936,540 A 6/1990 Boeshart
4,938,449 A 7/1990 Boeshart
5,014,480 A 5/1991 Guarriello et al.
5,038,541 A 8/1991 Gibbar, Jr.
5,050,358 A 9/1991 Vladislavic
5,065,561 A 11/1991 Mason
5,072,569 A 12/1991 Van Tassel
5,107,648 A 4/1992 Roby
5,120,162 A 6/1992 Parker
5,209,039 A 5/1993 Boeshart
5,319,884 A 6/1994 Bergeron
5,337,532 A 8/1994 Reid
5,375,809 A 12/1994 Goto
5,404,685 A 4/1995 Collins
5,408,798 A 4/1995 Hohmann
5,444,947 A 8/1995 Miller
5,475,950 A 12/1995 Palmer
5,488,806 A 2/1996 Melnick et al.
5,544,464 A 8/1996 Dutil
5,611,182 A 3/1997 Spude
5,618,602 A 4/1997 Nelson
5,634,302 A 6/1997 Lee
5,649,401 A 7/1997 Harrington, Jr.
5,655,336 A 8/1997 Azar
5,658,483 A * 8/1997 Boeshart ..... 52/285.1
5,704,174 A 1/1998 Dal Lago
5,744,076 A 4/1998 Baxter
5,778,546 A 7/1998 Williamson
5,791,103 A 8/1998 Coolman et al.
5,809,721 A 9/1998 Antropius
5,809,726 A 9/1998 Spude
5,855,806 A 1/1999 Caltrider
5,896,714 A 4/1999 Cymbala et al.
5,941,035 A 8/1999 Purse
5,966,885 A 10/1999 Chatelain
5,987,830 A 11/1999 Worley
5,992,114 A 11/1999 Zelinsky et al.
6,000,194 A 12/1999 Nakamura
6,026,620 A 2/2000 Spude
6,250,033 B1 * 6/2001 Zelinsky ..... 52/275
6,349,520 B2 * 2/2002 Kubica ..... 52/426

OTHER PUBLICATIONS

"GlobalTECH Introduces the Newest ICF in the Business," 2 pages, date unknown. Based on Applicant's present belief, this reference was publicly available before Dec. 1999.

Brochure from Premere Forms, Inc., 2 pages, date unknown. Based on Applicant's present belief, this reference was publicly available before Dec. 1999.

Brochure entitled "LITE–FORM Insulation of Pre–Assembled or Site–Assembled Insulating Concrete Forms" cover page, pp. 1–22 and business card last page, with a copyright date of 1994.

Brochure entitled "Lite–Form Adds Strippable Feature to ICF Line," from Lite–Form, Sioux City, IA, dated May 2000.

Brochure entitled "Enermizer™ Building System" from Plasti–Fab, Calgary, Alberta, Canada, copyright date 1999.

Brochure entitled "Diamond Snap–Form, EPS Insulated Concrete Forming System" from AFM Corporation, 8 pages, copyright dates 1994 and 1995.

Brochure entitled "Wisconsin EPS," 1 page, with the copyright dates of 1986 and 1996.

Brochure entitled Unique Benefits Of The TF System,™ 1 page, Dec. 1999.

Brochure entitled "Perform Guard®," 8 pages, with tech bulletins dated Mar. 1999.

Report entiled "SBCCI Public Safety Testing And Evaluation Services, Inc.," 12 pages, with the copyright date 1999.

Document entitled "TF System Construction Details," 57 pages, with a date stated as "Rev. 11/99" and including pages with dates stated as "Updated 2–97," "Updated 7–98," "Updated 11–98" and "Updated 4–99."

Brochure entitled "Insulated Concrete Walls System, Revolutionizing The Building Industry From The Ground Up," 4 pages, date unknown.

*Brochure entitled "Thermalwall Building System," from www.thermalwall.com, date unknown. Based on Applicant's present belief, this reference was publicly available before Dec. 1999.*

* cited by examiner

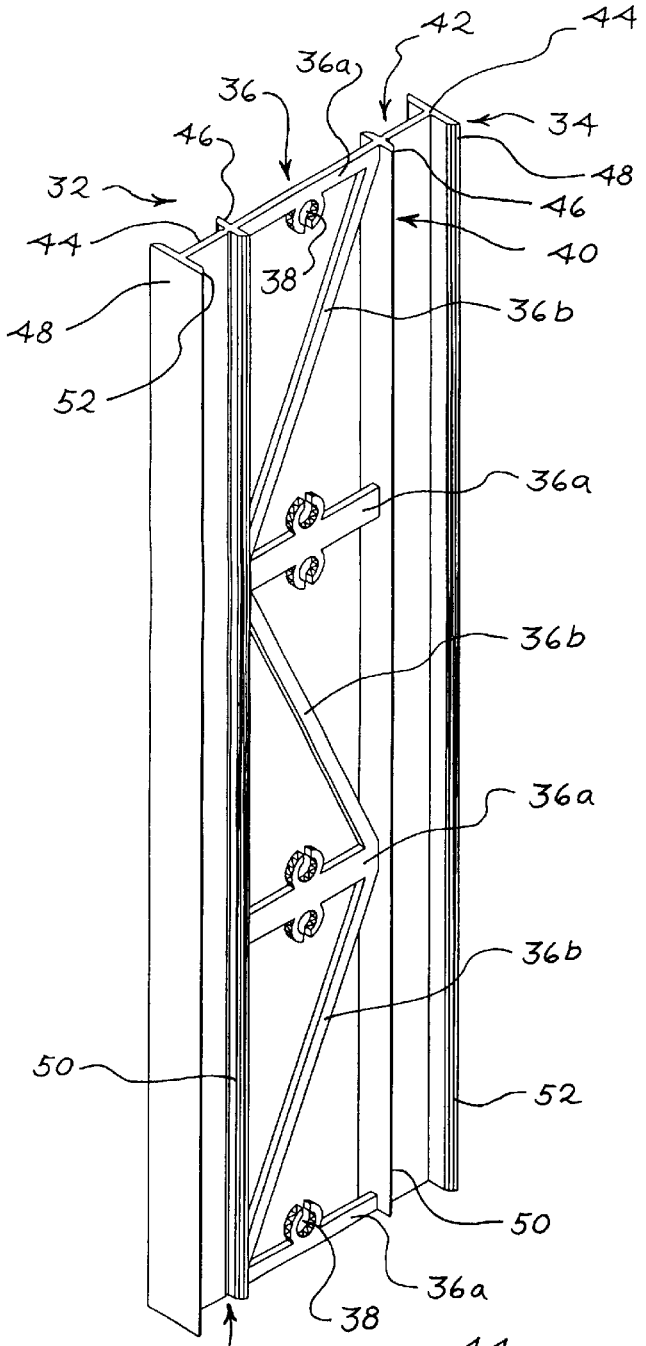
Fig. 4
Fig. 5
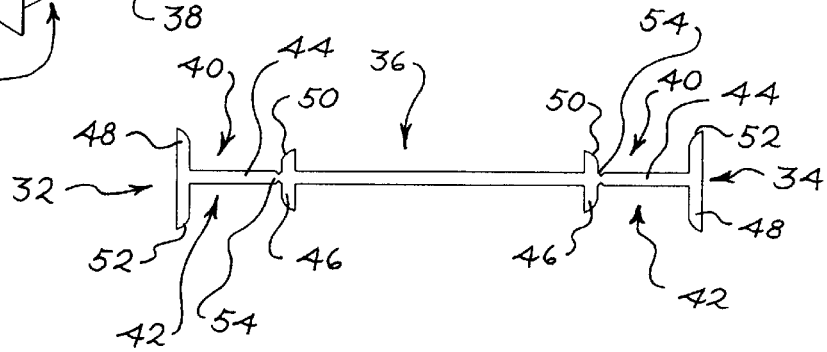

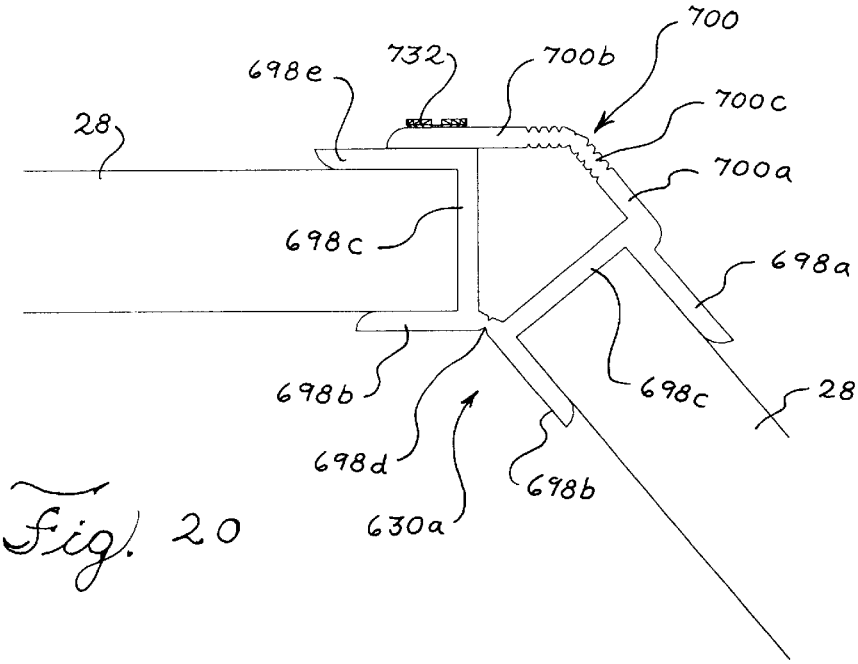
Fig. 20
Fig. 21
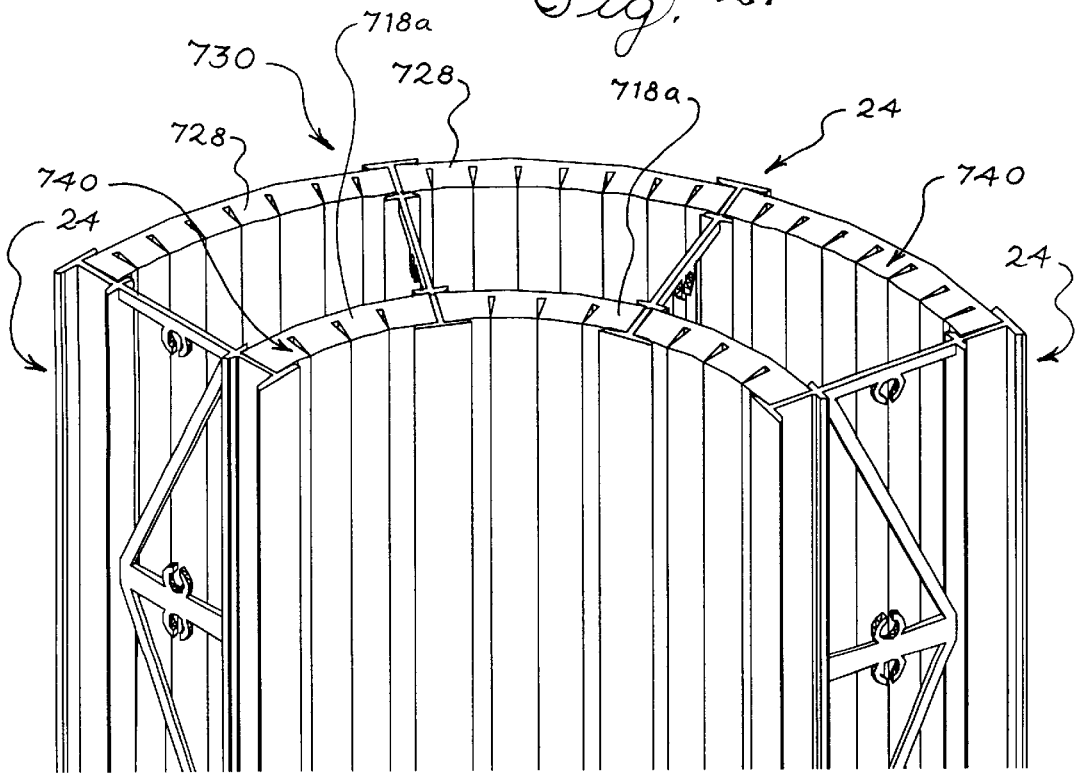

26
26a
154
266
150
152
16
152
150
26b
26a
26
170

26
26a
156
26b

SYSTEM FOR THE CONSTRUCTION OF INSULATED CONCRETE STRUCTURES USING VERTICAL PLANKS AND TIE RAILS

FIELD OF THE INVENTION

The invention generally relates to forming systems for constructing structures of a variety of shapes and sizes using concrete or other pourable, hardenable materials. The invention more specifically relates to a system for the use of rigid panels as forms for constructing such structures, including systems where the panels remain on the formed structure.

BACKGROUND OF THE INVENTION

An important technique for the construction of durable structures utilizes pourable, hardenable materials to provide structural elements, such as foundations, walls, pillars, beams, floors and similar structural elements. The most common materials used in such techniques are various forms of cementitious concrete. Cements and concretes generally are readily available, cost effective, provide advantageous structural characteristics, can be adapted for a variety of uses and applications, and are well known in the construction field.

The use of cements and concretes as structural building materials further provides many advantages over other building materials. For example, concrete foundations, walls, floors, pillars and beams, structural elements, etc. generally are considered resistant to adverse weather conditions, such as high winds and heavy rains, fire damage, insect damage, fungus damage, mildew damage, and. moisture induced rot damage. Furthermore, cement and concrete structural elements, under most conditions, are very durable and can be used to form structures that provide superior stress and weight bearing properties in a variety of building designs. Concrete materials further may be formed into a wide variety of shapes, forms, applications, and structural elements. This flexibility in use largely is due to the ability to install cement and concrete materials in a liquid, semi-liquid, or slurry state into a forming system where the materials harden and cure in place to form a permanent shape or element. Moreover, a wide variety of reinforcing elements may be incorporated in the concrete structure, including metal bars, mesh, metal and plastic fibers, pre- and post tensioning systems, etc.

In one important and frequent use of cement and concrete materials, a concrete slurry is used to provide pre-formed or formed in place elements in a variety of building structures such as foundations, building walls and building floors. In such applications, a set of opposing forms are provided and installed at the work site in a desired configuration. Sufficient spacing is allowed between the sets of forms to provide a cavity that is filled with concrete or with other cementitious materials. The forms are commonly made of wood, metal or a combination of such materials. It also is common to place reinforcing metal bars or mesh between the forms at various locations which are then embedded in the concrete or cementitious materials to strengthen the resulting structure.

In such systems, the forms maintain their proper position by a combination of metal tie plates between adjacent forms and metal tie rods between opposing forms. Such tie systems hold the forms in place during the assembly of the forming system and resist the movement of the forms from their proper alignment positions when concrete or other cementitious materials are poured and worked between the forms.

After the concrete or other materials are hardened and at least partially cured, the conventional forms are typically removed from the structures and reused in other installations.

As an alternative to conventional forming systems, there is considerable interest in the use of forming systems utilizing pre-formed, expanded polymeric foam forms, which are often referred to as Insulating Concrete Form or "ICF" systems, to replace conventional wood and metal forms. Many ICF forming systems use forms made of blocks and panels molded or manufactured from low density polymeric foam materials and are retained as permanent or semi-permanent components of the completed structure.

The blocks and/or panels that are left in place after the concrete hardens provide substantially enhanced insulating characteristics for the structure, reduce moisture passage through the structure walls, provide a substrate into which utility lines and piping can be installed, provide a surface for the attachment of finishes and provide other related benefits. As a result, ICF systems offer the possible use of concrete or other hardenable materials in building foundations and in above-ground walls of buildings or other structures. Thus, ICF systems have applications in residential, commercial and governmental building projects and programs.

Prior ICF systems utilizing insulating foam forms, however, possessed disadvantages that reduced their effectiveness in many building construction applications. Forming systems utilizing a hollow block, horizontal panels or other non-standard forms, such as panels or blocks with a gridded surface, typically require special assembly and forming procedures, construction techniques and equipment that are significantly different than those used with conventional forming systems, employing the well known wood and metal forms. In many systems, it is difficult to obtain consistent dimensions in the manufacture of the blocks or other components, and the expense of using the system is increased due to the shape and difficulties in shipping and assembling the forming components.

For example, in some systems, the concrete structures have inconsistent cross-sections, which results in uncertainty concerning the thickness of the concrete and foam panels in substantial portions of the structure. This can be a problem where knowledge of the wall and panel thickness is necessary for attaching structural elements to the formed wall structure, such as wall systems, shelving, floor members etc. The same can be true with systems that employ horizontal panels or blocks of foam materials with cavities in the shape of columns or tubes for receiving concrete or other hardenable materials.

Moreover, corner, door and window openings and other aspects of such systems were necessarily made during assembly or construction of the system, and could not reliably be made in advance offsite or at one time on site.

In some systems, multiple blocks or panels must be stacked on top of each other or side by side and in multiple layers to make wall forms of the same dimensions as forming systems using significantly fewer and larger conventional forms. Such systems using block forms and some horizontal panel systems also frequently encounter difficulties with form floating and compression. In such systems, the lower density of the forms and the higher density of the concrete can result in instances where the forms begin to float on the concrete, separating and permitting leakage through the form seams. This can be a particular problem in the upper sections of wall forms, and can also affect the wall ties, i.e. the wall ties also are urged upward by the concrete creating openings in the wall seams. In other instances, the weight in of the concrete in the system imposes sufficient downward force on the system to compress the foam members changing the wall height and, at times, the spacing between the forms.

As a result, it frequently is necessary to make repeated cuts and adjustments to the forming panels, blocks or similar forms during construction of the forming structure. Such ICF systems, in addition, typically are not familiar to contractors and construction workers and require significant special training or retraining in the use of the system, and the time and labor required for the assembly of such systems can significantly exceed that required for conventional systems.

Many potential users, regulatory agencies and inspectors, in addition, are unfamiliar and reluctant to accept the non-standard forming materials and the additional or unique procedures and equipment required in prior ICF systems. Thus, additional construction, engineering and regulatory considerations typically apply to such systems that are undesirable or unacceptable in many applications.

Nearly all ICF systems, in addition, require the use of specially formed, proprietary foam panels or other such specialized panels with recessed grooves, overlapping joint structures, pre-embedded gripping members or similar features that are necessary to the assembly and function of such systems. As a result, they were "closed" systems and were not suitable for use with generally available generic components, or with use from alternative competitive components. Thus, suppliers and competition among suppliers for the components was reduced limiting cost reductions and wide spread acceptance of the systems.

For example, one approach to developing ICF forming systems requires specially configured, vertical foam panels with slots formed or cut into the panels. These slots must be incorporated in the panel when it is manufactured, or must be added to the panels at the work site. In such systems, the modification of the forms at the work site to accommodate non-standard dimensions, design changes made on site, etc. can require significant additional time and labor to cut and properly align such slots which increases the cost of the system and may hamper such systems' use as a replacement for conventional forming systems.

In some prior systems, particularly those using horizontal panels, tie elements spanning the ICF panels are used to stabilize the system and hold the forms in a predesired relative position. In some such systems have utilized many individual, tie elements, where multiple tie elements must be installed across each individual set of opposing panels. In other systems, the panels placed on top of channels or H-type channel members, which then require the installation of multiple tie members between opposing channel pieces. In other systems, short rail members are installed between the panels through pre-embedded gripping members.

Prior systems utilizing substantial numbers of individual tie elements typically require significant labor and time to install properly, and may not provide gripping surfaces on the cavity side of the forms. Prior systems using channel members frequently use channels dimensioned to require substantial force to insert the panel edges into the channels, which also increases the labor and expense of using the systems.

In some systems, particularly those using flat panels, the formation of corners, curves and turns in the forming system is a further concern and may require complicated forming and construction techniques. Due to the geometry of various corners and turns, it often is necessary to provide specially designed corner forms that are pre-configured to certain corner shapes. Most prior corner systems also require extensive and heavy bracing and reinforcement in order to maintain the proper alignment and required corner strength.

Moreover, in most systems utilizing flat panel forms, it is very difficult, if not prohibitive, to use such systems to form curves in corners or other wall sections. Similarly, the prior systems frequently were difficult to adapt for use to provide a corner with a range of corner angles and many were useable to form only right angle (90 degree) corners.

Thus, the panels and other form components of other systems required extensive modifications, custom made parts and significant additional engineering and expense, to provide such corners and curves, if they could be produced at all by such systems. As a result, such systems often require the maintenance of significant inventories of the preformed corner sections and additional expense of installing and maintaining the corner bracing. Such limitations reduce the flexibility of the system and materially increases inventory, installation, shipping and storage costs of the systems. Furthermore, if the required corners are not available during the construction of the forming systems, the construction process may be significantly slowed or halted until the corners are available. This could result in considerable additional expense due to idled labor and missed deadlines.

In many prior systems using ICF forms, the various reinforcing and joining structures also create other inefficiencies in the basic structure of the formed and cured concrete materials. For example, in some instances electrical conduit, plumbing and other piping must be installed in or along the foam forms walls. To install such conduit or piping, channels may be cut into the foam panels to accommodate the conduit or piping. The presence of numerous metal parts, sections, panels, or other reinforcing members can substantially interfere with that procedure and may require the use of additional insulating parts between the piping and conduit and any metal parts in the conduit or piping.

In some applications, siding or other outer surface treatments are added to the above ground wall sections formed with ICF systems. Such surface treatments typically use conventional siding or paneling materials designed for installation on conventional wooden frames along conventionally spaced attachment points. Many ICF systems also lack continuous or semi-continuous attachment points along the full height of the wall and corner structures permitting the fastening of materials, paneling, siding or other material to the structures. Such systems further lack integral structures providing a drainage plane or rain screen behind such surface treatments to permit the flow or other movement of water penetrating siding or other surface treatments out from behind the siding.

As a result, in many ICF systems extra attachment systems of wood or other materials must be added to the exterior wall of ICF systems to permit the installation of such surface treatments on the ICF system, as well as for use alone or in conjunction with other rain screen materials, to provide a drainage plane behind the surface treatment. These additional construction steps also will increase the cost and difficulty of use of such ICF systems.

In most forming systems, conventional and ICF, window and door frames or "bucks" must be mounted in the forms to provide a frame for installing the windows or doors in the formed concrete structure. Such window or door bucks commonly are custom fabricated on-site during the assembly of the system, and, thus the resulting bucks are non-standard sizes or fail to conform to the dimensions of the window or door that is to be installed in the buck.

As a result, considerable time and effort may be required to fit and adjust the windows or doors and the corresponding bucks to ensure the proper installation of the windows and doors in the formed structure. Thus, it was difficult and in most instances impractical to achieve construction efficiencies and cost reductions that can be obtained with prefabricated parts and to increase the efficiency of the on-site construction procedures resulting in increased costs and labor expenses in using such systems.

Similarly, most forming systems are installed on a base of a concrete footing or other level base which often is uneven and irregular and require time consuming shimming procedures to properly level the forming system. The surfaces adjacent to the footing also typically are unfinished and may be unstable dirt, clay, mud or other such surfaces. A concrete floor or slab may later be poured over those adjacent surfaces, but usually not until after the walls are constructed. In prior systems, there has been little, if any, attention given to the possibility of preforming floors or other surfaces adjacent to the footing to provide improved and stabilized work surfaces adjacent to a wall forming system prior to pouring the wall structures.

For at least the above reasons, there is a need for improved forming systems utilizing insulating foam forms that are adaptable for use with standard construction techniques similar to conventional forming systems, and specifically those using vertically oriented forms similar to the conventional wood and metal forms. There further is a need for "open" forming systems that utilize standard, preformed low density, insulating foam panels, or rigid panels of other materials such as plastics, polymeric composites, cementitious wood and foam panels, etc. that can be supplied in generally generic, standard shapes and panels dimensions. There also is a need for systems that are readily adaptable for use in circumstances where fire resistance, insect and/or pest resistance, impact resilience, form removability, high energy efficiency, and flexibility to accommodate changes in material availability and cost is important.

In addition, there is a need for a forming system that can be relatively simply adapted at the work site for a variety of shapes and applications, including relatively simple to construct corner assembly and easily adaptable corner assemblies of a variety of corner angles, as well as a variety of curved wall corner shapes. Moreover, there is a need for a forming system that provides a versatile wall construction that can be relatively easily adapted to a variety of post-forming construction and wall treatment techniques. Similarly, there is a need for an improved footing and window systems for such forming systems as well as for other related systems.

SUMMARY OF THE INVENTION

The invention provides an improved system for forming foundations, walls, buildings and other structures having one or more walls made of concrete or other pourable, hardenable materials (together referred to herein as "concrete"). The system uses substantially rigid forming panels and is "open" in that forming panels from a variety of sources can be utilized in the system with limited (if any) changes or alterations to the components used in the system. Such panels particularly include insulating foam panels, and also include substantially rigid panels of wood, plastic, polymeric composites, cementitious composites of foam, fibers, metals etc. and other such materials, many of which provide additional insulating properties.

The system in an important aspect provides wall tie rail and corner tie rail components that are adaptable for use in a variety of construction applications using forming procedures and techniques readily adaptable from conventional forming system construction and assembly procedures. The tie rails and corner rails may be used to form a wide variety of wall and corner shapes that substantially reduce the need for specialized corner components and extensive bracing such as that required in prior systems. The tie rails also may be made of a variety of materials to provide properties such as reduced weight and cost, and/or fire and insect resistance. The choice of the tie rail materials, in addition, in most instances, may be made without regard to the panel materials.

The forming system of the invention, in addition, is relatively easily adapted to provide corners with a variety of angles and curved corner and wall sections. The system also provides exterior components that are adaptable for use with a variety of wall treatments, providing drainage planes beneath such treatments, and providing readily accessible and predictable attachment locations for wall and surface treatments, appliances etc. that may be applied to the surfaces of the completed structure.

The forming system of the invention further provides improved footing systems, and window and door construction components that provide for substantial improvements in construction efficiencies. The forming system of the invention, in addition, minimizes the number of specialized forms and forming equipment necessary for the variety of applications suitable for the systems.

In one aspect, the invention provides a system of low density, expanded foam panels with relatively high insulating properties to provide forming systems for concrete walls and corners of a variety of dimension and shapes, including without limitation standard wall and corner configurations, angled walls and corners, and curved walls and corners. The forming systems may employ generally available insulating foam panels, or panels of other materials, having standard dimensions and thicknesses, and such panels need not possess specially designed slots, grooves, lap joints or the like.

Such foam panels may be provided especially for use in the system of the invention, or may be of a generic construction that is utilized in other insulating applications. Such panels, and the above mentioned panels of other materials, typically are of dimensions familiar to contractors and others responsible for assembling forming systems, typically have a dimensional consistency that provides substantial efficiencies in manufacturing and use that reduce the costs associated with the panels, can be selected to provide a variety of properties and potential applications, frequently do not require additional engineering or specialized knowledge to use, and provide a consistency in dimensions and structural elements of the completed structure that often is not present in other systems.

In one aspect of the invention, insulating foam panels are provided as generally vertical panels that are assembled in a configuration and using procedures similar to conventional concrete forms. In this system, one or more of pairs of generally vertical panels are positioned so that the panels are spaced a predetermined distance apart to provide a forming cavity to receive concrete materials. The pairs of panels are positioned adjacent to other panels of a similar orientation to form a generally continuous inner wall defined by one set of panels and an outer wall defined by the other opposing set of panels and forming a cavity sized to form a concrete wall structure (or multiple walls) with a predetermined thickness, height and length.

The wall panels are positioned and maintained in the proper alignment by a series of wall tie rails disposed between the adjacent wall panels that tie together and reinforce the opposing sets of wall panels. The wall tie rails assist in resisting the displacement of the panels from their proper position due to pressures and forces imposed on the panels during the filling of the forming cavity with concrete, the working of the concrete between the forms and the curing of the concrete, as well as incidental stress encountered during assembly of the system.

Each of the wall tie rails is provided with a first retaining section disposed between the adjacent outer wall panels that engages and holds the vertical edges or borders of the wall panels. The first section generally extends along a substantial length of the vertical edges of the adjacent panels, and in one aspect along substantially all of the length of the vertical edges of the panels. The wall tie rails similarly include a second retaining section disposed between the adjacent inner wall panels that engages and holds the surfaces of each of the inner wall sections, and also extends generally along a substantially the length of (and one aspect along substantially all of) the vertical edges of the adjacent inner panels. The wall tie rails further include at least one web section extending and joining the first retaining section to the second retaining section.

The wall tie retaining sections hold the edges of the wall panels in a channel defined by exterior and an interior flange, spaced apart a distance effective to allow for the insertion of the panel edges in the channel. The flanges hold the panel edges, and, in one aspect, this is a functional engagement enhanced by locking ridges, adhesives or other engagement elements on the surfaces of the flanges defining the interior of the channels. In one aspect, the spacing of the flanges permits the placement of the panel edges into the channels using relatively low insertion force. The combination of inner and outer retaining sections and the connecting webs cooperate to maintain the foam wall panels in the proper orientation and relative position.

The flanges of the retaining sections, in addition, extend over the panel surfaces a distance effective with the engagement of the panel edges in the above mentioned channels to restrain the outward movement of the panels when the forming cavity is filled with concrete, and which the concrete is subsequently worked within the system and cured. The wall ties, in addition, generally seal and prevent or limit the leakage of concrete through the joints between the wall during such operation.

The system also provides, where necessary, corner assemblies defined by the intersection of at least two outer wall panels at a preselected angle and the intersection of at least two inner panels at a preselected angle, together defining a corner forming cavity. In this aspect of the invention, the corner panels and adjacent wall panels are of the same general configuration as the wall panels and are positioned at a predetermined angle by a corner tie assembly. The corner tie assemblies provide corner tie rails, and inner and outer brackets located at the angular intersection of the inner and outer corner panels, respectively.

The corner tie rails include outer retaining sections that, in one aspect, hold the vertical edges of the corner panels, generally along a substantial length of the vertical panel edges in a manner similar to that described above for the wall tie rails. The corner tie rails further include webs with a connecting end extending between the outer retaining section and the inner corner bracket. The webs may be removable from a corner bracket with a web end that is insertable into tie channels on one of the corner brackets.

One or more webs also extend from the outer corner bracket to the inner corner bracket, which generally is the greatest distance between the form (i.e., between the intersections of corner inner panels and the outer corner panels). These webs also may be removable from the corner bracket as discussed above for the corner tie rails.

The retaining sections of the corner brackets include walls defining engagement channels sized to accept and hold the vertical edge of the corner panels, in much the same manner as the above referenced wall tie rail retaining section. These channels are disposed in an angular disposition that is generally the same as the angular disposition of the corner panels.

The corner tie rails and corner brackets that cooperate to maintain the panels in the correct orientation and position during the assembly of the system. The corner tie rail retaining section and webs, further cooperate to form a self-reinforcing system that resists the displacement of the corner panels from their relative alignment and position by the outward forces exerted on the panels by the pouring, working and curing of the installed concrete between the corner forms, and do so where those forces may exceed the forces expected on other aspects of the system as a result of the geometry of the corner forms and forming cavity.

In yet another aspect of the invention, the wall and corner tie rails are made of a polymeric material or a metal that is relatively easily molded or formed. The corner tie rails may include a web with one or more ends that may be disengaged from the inner corner bracket so that the rails and corner system may be collapsed for easy shipping and storage.

In another aspect of the wall and corner tie rails of the system, a line of weakness is incorporated in retaining sections that permits the detachment of the exterior flanges of the first or outer retaining section from the completed, cured wall or corner section. This provides a relatively consistent surface on the exterior surfaces of the forming panels that is adaptable for wall treatments of stucco, plaster or other such treatments best applied to such flat or planar surfaces. The removable aspect of the retaining sections, in addition, allows for the selective removal of one or more panels from the completed, cured structure to expose the surface of formed concrete wall or corner.

Alternatively, the exterior flanges of the wall and corner ties and the corner brackets are used as attachment parts for shelving, plumbing exterior conduit, and wall treatments requiring the use of securement points. The regular, vertical arrangement without interruption of the exterior flanges of the wall ties is particularly useful in the installation of siding or paneling materials. In another aspect, the wall and corner tie rails and corner brackets are rails of a light weight metal to improve the system's fire and pest resistance, and to provide improved attachment points on the exterior of the system. In another aspect, these flanges on the external surface of the forms also may provide channels or drainage planes behind siding and other surface treatments without the need for additional spacers, boards, furring strips and the like.

In one aspect of the system of the invention, the system can be adapted to form wall sections and corner sections of a variety of different thicknesses. In that aspect, the wall tie rail webs are provided with a width corresponding to the desired wall thickness. The inner corner bracket of the corner assembly is adapted to provide multiple channels to webs of variable widths extending from the outer corner bracket having widths corresponding to the desired wall thickness, and to allow the adjustment of the size of the corner forming cavity without changing the corner bracket assemblies.

In another aspect, the corner brackets are provided with channels having a common hinged corner and opposing freely movable corners. As a result, the channels and corner panels can be positioned at a wide range of corner angles by pivoting the channels around the hinged corner. The corner channels also may be locked in place by locking plates fixed over the freely movable corners of the brackets.

In yet another aspect, curved corners or walls may be formed using the wall tie rails and panels of the system. In one such aspect, slots or recesses are formed or cut in one or more in the surfaces of the foam panels so that they can be curved by arching the panels in the desired direction of curvature. Opposing pairs of such curved panels with corresponding curvature may be positioned and held in place by adhesives and the above mentioned wall tie rails to form the desired curved forming cavity without the need for specialized forming devices or apparatus.

In another aspect of the invention, the forming system includes a footing bracket system that engages the bottom edges of the wall panels to support and retain the panels in their proper position. The footing includes a first and second generally "L" shaped footing bracket spaced apart a distance sufficient to accommodate the above mentioned and corner assemblies, and the desired forming cavity between the brackets. Each bracket may be provided with drainage channels, and, in one aspect, may include a base plate extending towards the other bracket to provide a generally level base for the wall and corner assemblies.

The vertical segment of the "L" shaped brackets also may extend upward a distance effective to serve as an outer form for concrete slabs, floors, walkways and similar structures adjacent the forming system. This provides the capability for forming such prepared structures before assembly of the wall and corner forms to provide stable, prepared work surfaces to efficiently install the wall and corner forming systems.

Another aspect of the system of the invention provides supporting channels or base plates for use in utilizing the system to construct multi-level or storied structures. Such channels and base plates may be installed along the upper borders of the wall and corner forms of the system in a previously installed system. After the base system is filled with concrete, and the concrete is at least partially cured, a second system is then installed on and above the first system using the base plates to locate and reinforce the bottom borders of the second system in a manner similar to the above mentioned footing brackets. The base plates also assist in resisting leakage of the concrete poured to form the second wall structure formed by the panel system with the panel forms of the second system installed in the channels formed on the upper border of the first system.

In another aspect of the forming system of the invention, preformed window or door bucks that are matched to preconstructed windows or doors are provided. The bucks are installed in the forming system of the invention to provide attachment frames for the matching windows and doors.

BRIEF DESCRIPTION OF THE DRAWINGS

FIG. 4 is a perspective view of a wall tie rail used to connect the wall forms shown in FIGS. 1, 2 and 3.

FIG. 5 is a top plan view of the tie rail shown in FIG. 4.

FIG. 20 is a top plan view of an alternative aspect of a corner bracket for use in the corner form and tie rail assembly shown in FIG. 18.

FIG. 21 is a perspective view of an alternative aspect of a corner assembly which provides an adjustably curving corner for use in the forming system of the invention.

It should be understood that the above figures are not necessarily to scale. In certain instances, details of the actual structure shown in the Figures which are not necessary for the understanding of the present invention have been omitted. It should also be understood that the Figures are provided to illustrate an example of the invention and that the invention is not necessarily limited to the particular example and aspects discussed herein.

DETAILED DESCRIPTION

Figure 1:
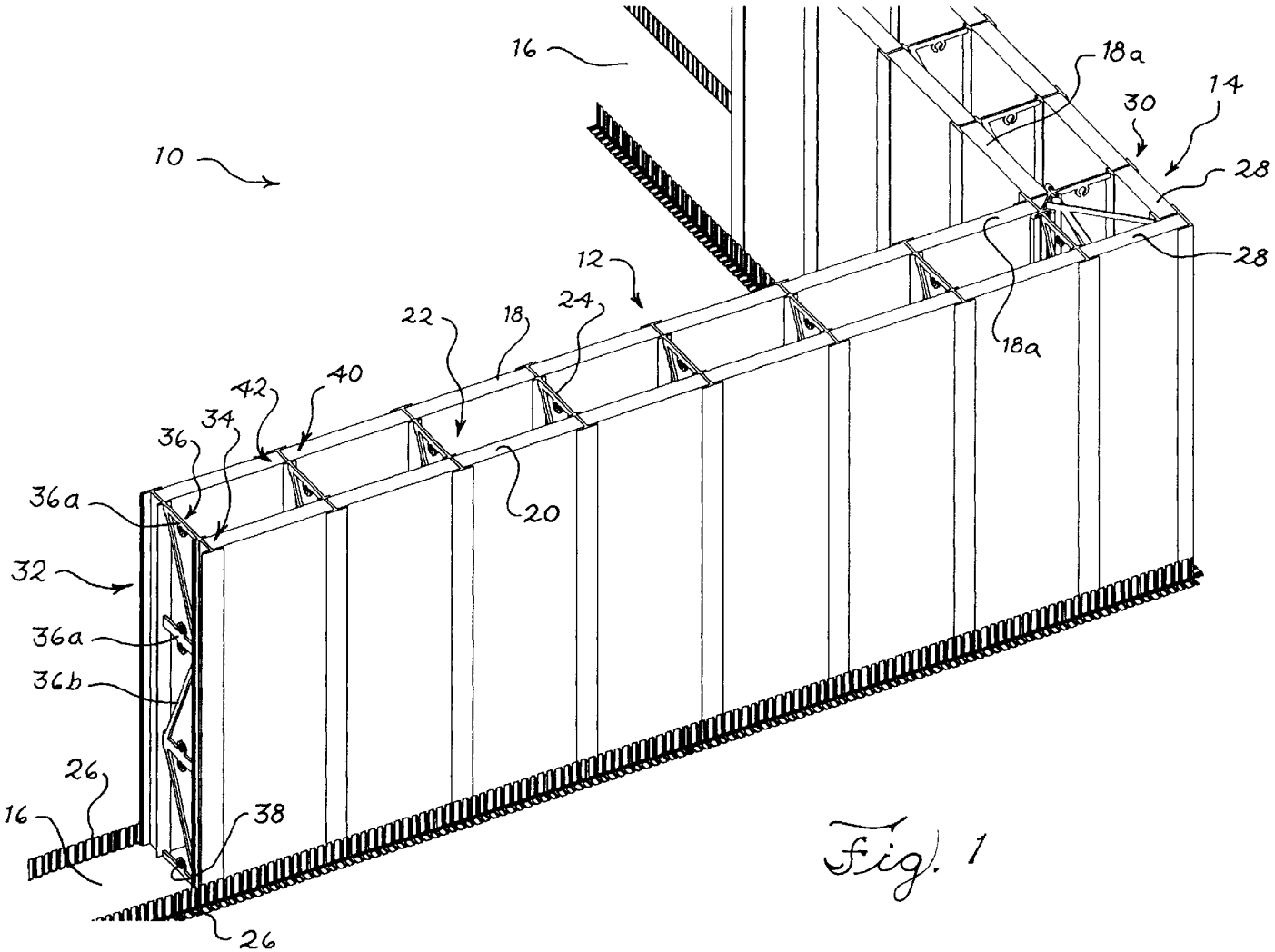
FIG. 1 is a perspective view of one aspect of the forming system of the invention illustrating a portion of the assembled system providing forms for wall structures and a corner structure before the system is filled with concrete.

One aspect of the forming system 10 of the invention is generally illustrated in FIG. 1 showing a partial section of the assembled forming system. The portion of the system shown in FIG. 1 includes partial wall sections 12 and a corner assembly 14. Most forming systems 10 will include multiple wall sections 12 and corner sections 14 to form the foundation or walls for a larger structure built on a footing 16 of concrete or other footing materials to define a space within the formed walls. Such spaces may include a basement space or a first or upper story of a residence, business space or other structure. Similarly, the system 10 may be adapted to form internal wall structures using the approaches discussed below.

Figure 2:
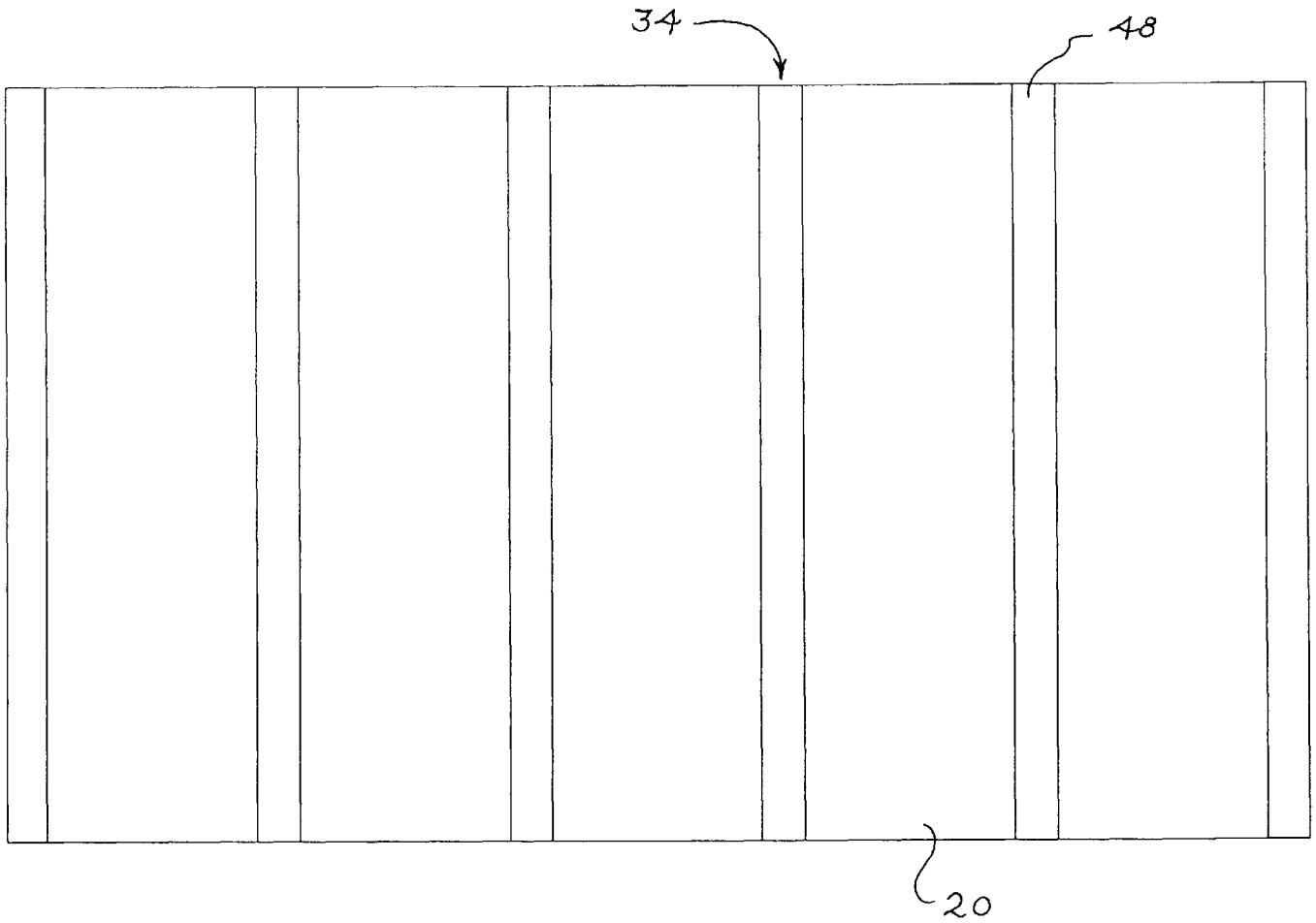
FIG. 2 is an elevational view of a portion of the wall system forms of the aspect of the invention shown in FIG. 1 (footing brackets not shown).
Figure 3:
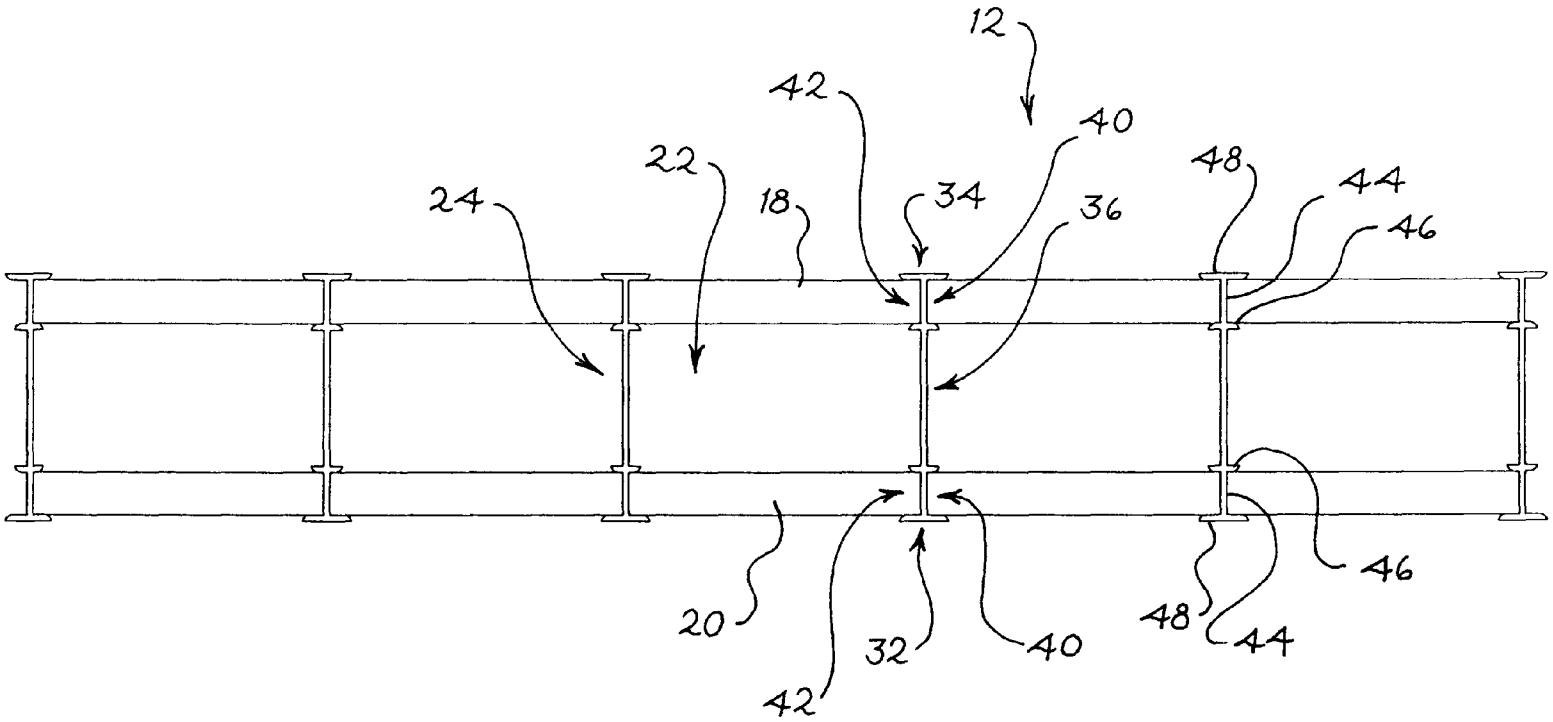
FIG. 3 is a top plan view of a portion of the wall system forms shown in FIGS. 1 and 2 (footing brackets not shown).

As shown in FIGS. 1, 2 and 3, the wall sections 12 includes a series of pairs of vertical forming panels, where one of each pair is positioned as vertical, inner forming panel 18 and the other is positioned as a vertical outer forming panel 20. The panels 18 and 20 are positioned opposite each other to provide a cavity 22 sized to receive poured concrete or other hardenable materials such as those mentioned above between the panels. When cured, the concrete or other materials (hereinafter collectively "concrete") forms a wall structure of a predetermined thickness, height and length. The panels 18 and 20 further are held in position relative to each other and relative to adjacent pairs of panels by wall tie rails 24 and by adhesive to the concrete. The bottom edges of the wall panels 18 and 20, and in some instances the tie rails, also are engaged and held in place by footing brackets 26 mounted on the footing 16.

Figure 8:
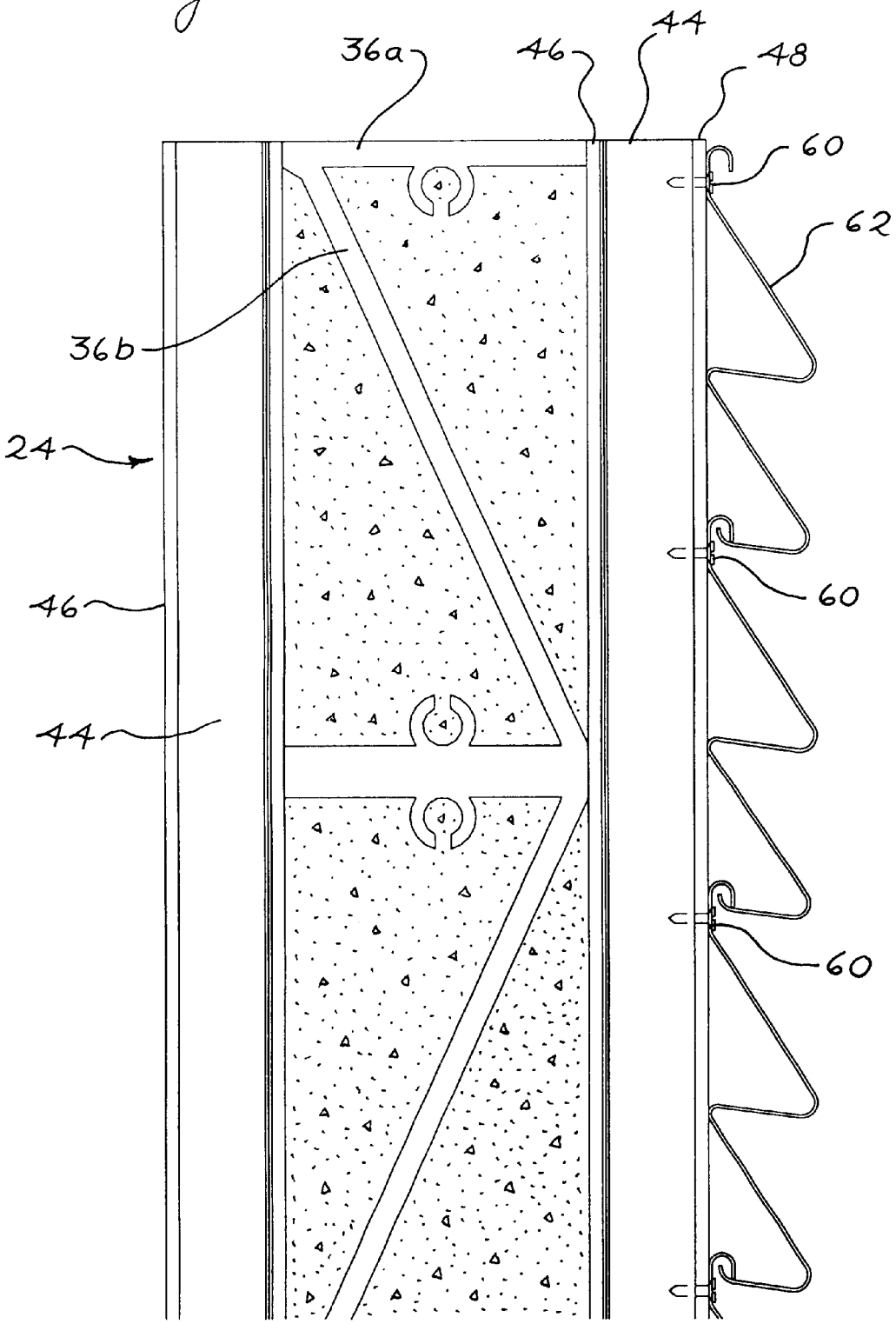
FIG. 8 is a cross section view through the lines 8—8 of FIG. 7.

As shown in FIGS. 1 and 8, the corner assembly 14 in this aspect includes the vertically positioned inner corner panels 18*a* and outer corner panels 28, that may (but do not necessarily) have dimensions, that differ from those used in the wall sections 18 and 20. The dimensions of corner panels 18*a* and 28, such as their width, typically are adjusted to provide the correct corner geometry, and may be adjusted to minimize the need for extensive changes to the wall section panels 18 and 20 to provide wall section 12 of the desired length. This provides additional flexibility to the system 10 by permitting the on-site compensation for unforseen deviations of the length of the wall systems 12 from expected or planned lengths, and allows for the placement of the corner assemblies 14 in a preselected location that are not determined solely by the size or number of the panels used in the wall systems 12.

The corner assemblies 14 further utilize a corner rail assembly 30 which typically comprises corner tie rails and corner brackets further discussed below to provide a self reinforcing, angular junction of two or more wall systems 12. The corner assemblies 14 assist in maintaining the respective corner panels 18*a* and 28, and wall systems 12 in the proper relative positions during the construction of the forming system, during filling of the system with concrete, and during working and curing of the concrete formed within the wall sections 12 and corner assemblies 14. Moreover, in some applications, the corner assemblies 14 will assist in maintaining the wall forms 18 and 20, and corner forms 18*a* and 28 in place, after the concrete is fully cured. As with the wall sections 12, the bottom borders of the corner assembly 14 may be held in position by the footing brackets 26.

The wall panels 18 and 20 and corner panels 18*a* and 28 used in one aspect of the invention are standard, rigid or semi-rigid expanded foam insulating panels, such as those known in the art for use in building construction. As mentioned above, other panel materials such as those mentioned above also may be used, such as cementious panels mixed with fibers or foam, polymeric composites, and other such materials.

In the aspect using insulating foam panels, the foam panels are made from expanded polystyrene foam, formed into sheets or panels of a substantially similar thickness, such as thickness of about one inch to about 3 inches. The panels are typically formed or cut into a variety of standard widths and heights, such as a typical height of 8 feet and a typical height of 12 feet. The panels, in addition, may be cut into width and heights that correspond to the conventional concrete forms made of wood and metal parts mentioned above, which typically are from about 10 feet in height and 24 inches in width.

The foam panels generally have relatively high insulating value, and relatively low bending strength, surface toughness and crush strength relative to conventional wood and metal forms. Such strength properties vary depending on the material used in the panel, and the manufacturing process used to make the panels. Examples of such panels are supplied by Premier Industries and are made of expanded polystyrene, and may be generally available at typical building supply outlets.

The insulating values of the foam panels 18, 20, 18*a* and 28 may range, without limitation, from R-0.5 to R-14, and the thickness of the panels generally varies in proportion to the panels' insulating value as indicated by their "R" value. Other types of panels, such as cement based panels may have lower R values, while panels made of other foam materials may have high R values. In the construction of residential and many commercial buildings, the typical foam panel of extruded polystyrene has thicknesses ranging from about one inch to about two inches, with R values in the range of about 4 to 10.

In other aspects of the invention, the panels may be made of other foamed or plastic materials that provide similar or better strength qualities for use in concrete forming systems. Similarly, the foam panels may include additives such as insecticides, fungicides, fire retardants, colorants and other such additives to increase the utility of the panels and systems in specific environments.

The panels may be printed or provided with other utilitarian or decorative and festive surface designs. Furthermore, depending on the application, the panels typically are not provided with grooves, joint members or similar construction customization, but can be used in the system 10 as a generic product. Similarly, the foam panels typically are shipped in flat containers containing multiple panels to ease handling and transportation of the system, reduced shipping damage, and reduce shipping and handling charges.

As shown in FIGS. 1 through 4, the dimensions of the wall panels 18 and 20 and the wall tie rails 24 are selected to provide a cooperating, generally self-supporting, and interconnecting system. In one aspect, the wall tie rails 24 typically extend to a length generally equivalent to the vertical height of the wall panels 18 and 20, although they may be cut to shorter lengths depending on the application. As shown in FIGS. 3 through 5, the wall tie rails 24 in this aspect are generally symmetrical with a first inner wall retaining section 32 and a second outer wall retaining section 34, and one or more webs 36 spanning the distance between, and connecting, the retaining portion 32 and 34. The webs 36 extend a distance generally equivalent to the width of the cavity 22, which is generally the width of the concrete wall portion of the desired wall section. The webs 36 may include one or more horizontal webs 36*a*, and angled reinforcing webs 36*b* to tie together the retaining sections 32 and 34, and add additional rigidity and strength to the wall tie rails.

The webs 36, in addition, may include one or more loops 38 positioned to hold standard and conventional metal reinforcing bars or other reinforcing materials (not shown) between the panels 18 and 20. Such reinforcing bars are provided to strengthen and increase the durability of the poured, cured and hardened final wall structure, and often are located at various positions within the forming system and final wall depending on the needs of the particular application.

Each of the retaining sections 32 and 34 of the wall tie rails 24 further include at least two channels 40 and 42 defined by a center wall 44, and outwardly extending interior flanges 46 and exterior flanges 48. The openings of the channels 40 and 42, in this aspect of the invention, are generally disposed in opposing directions to receive at least a portion of a side, edge or border of adjacent forming panels 18 and 20, such as shown in FIGS. 1 through 3 and 6.

The flanges 46 and 48 defined by the channels 40 and 42 of the inner retaining section 32 and the outer retaining section 34 typically are spaced apart a distance sufficient and are dimensioned to accommodate the edge or side of a panel 18 or 20 within the channels. In one aspect, the flanges 46 and 48 are spaced a distance sufficient to permit the use of relatively low forces to insert or slide the panels 18 and/or 20 within the channels. In other aspects, the flanges 46 and 48 may be spaced a distance apart sufficient to exert significant compressive, frictional engagement with the surface of the panels when the panels are inserted in the channels, depending on the specific application and panel materials. This engagement may be supplemented with appropriate adhesives, tapes or the like where desirable.

The fit between flanges 46 and 48 and the edges or sides of the panels 18 and 20 should be sufficiently secure to resist the accidental or incidental dislodgement of the panels' edges from the channels 40 and 42. The forces that might cause such dislodgement include, without limitation, those incurred during the assembly of the system 10 as other panels are added to a wall 12 or corner assembly 14, during adjustment to a wall system after it is partially or completely assembled, during pouring and working of the concrete between the panels or due to other forces on the wall system.

The flanges 46 and 48 of the retaining sections 32 and 34, in addition, extend from their respective center walls 44 to overlap the panel edges. The flanges 46 and 48 overlap the panel edges a distance effective to resist the dislodgement of the panels 18 and 20 in an outward direction relative to the cavity 22, and to assert in maintaining the panels 18 and 20 in a generally vertical alignment when outward pressure is exerted on the panels. Such forces may be exerted by the concrete or other material as they are poured between the panels 18 and 20 to fill the forming system cavity 22, when the concrete or other materials are worked by tamping or probing to eliminate air pockets in the concrete filling the cavity 22, or due to other situations where forces are exerted against the forming system outwardly from the cavity 22 towards the panels 18 and 20.

As shown in FIG. 5, in this aspect, the flanges 46 and 48 also may include angled inner edges 50 and 52, respectively positioned at an acute angle, inwardly directed towards the channel center wall 44. The angled inner edges 50 and 52 can provide an expanded opening to the channels 40 and 42 to ease the insertion of the edges or sides of the panels 18 and 20 into the channels 40 and 42. The angled edges 50 and 52, in addition, may provide a ramp-like surface that eases the proper placement and mounting of the panel edges in the channels 40 and 42. Other flange configurations and angular edges also may be used to accomplish similar results depending on the application. In a further aspect, the surfaces of the flanges 46 and 48, disposed within the channels 42 and 44 may be provided with ribbing, texturing, ridges, cross hatching or other surface treatments to increase the frictional engagement between the flanges 46 and 48, and the panel edges or sides disposed within the channels 40 and 42.

The wall tie rails 24 may be made of a variety of materials or combination of materials, as long as the selected materials are sufficiently rigid to provide the rails 24 with adequate structural strength to support and resist the displacement of the panels 18 and 20 from their proper orientation and position. For example, the tie rails 24 may be formed from polymeric materials, aluminum or steel compositions, stamped metals and other similar formable materials.

Figure 6:
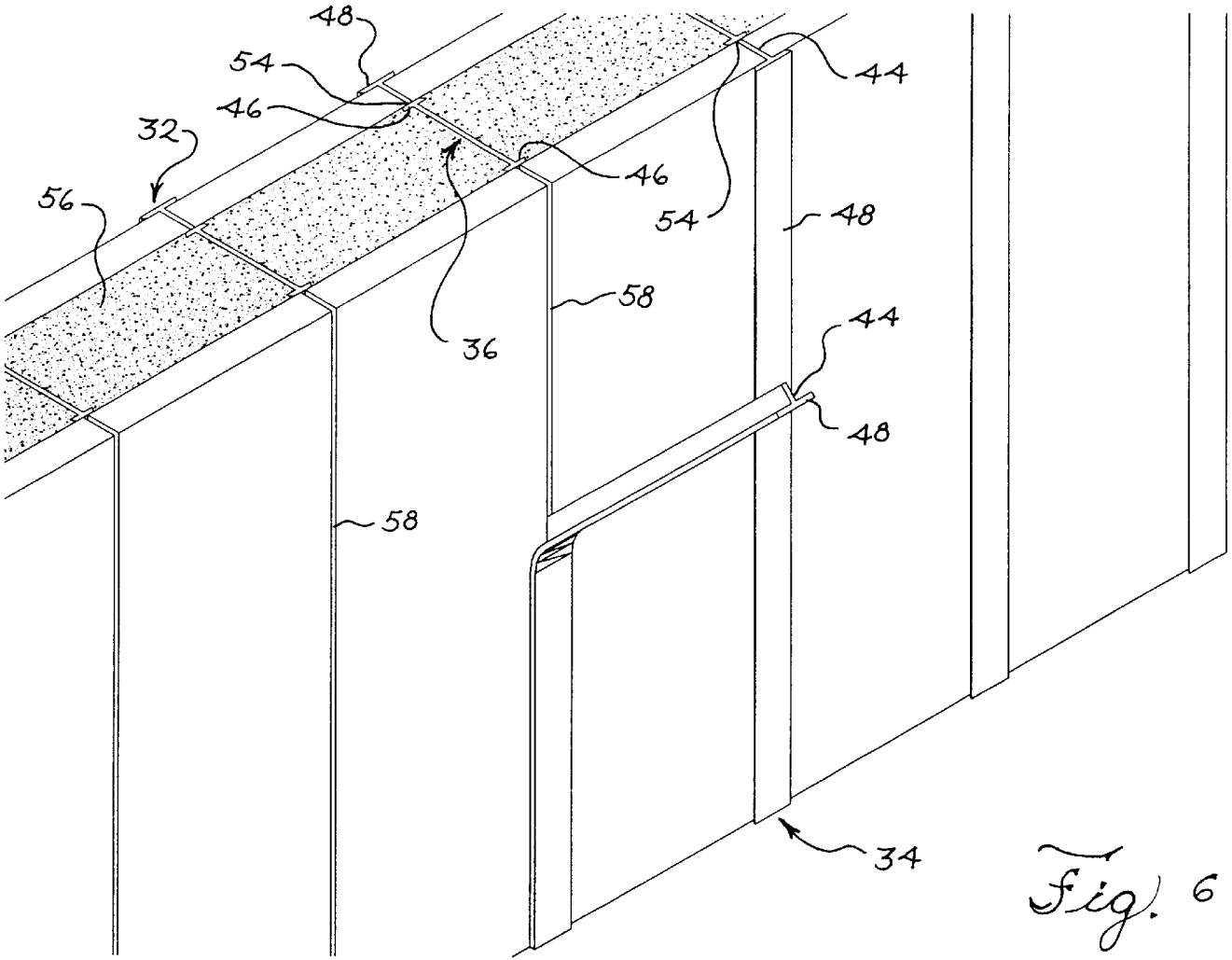
FIG. 6 is a perspective view of a portion of the wall system forms shown in FIG. 1, after that system is filled with concrete and with a portion of the wall tie rails shown in FIGS. 4 and 5 is removed or in the process of being removed.

In one aspect of the invention also shown in FIGS. 4 through 6, the wall tie rails 24 are made of polymeric materials or certain metal, such as steel or aluminum, with the appropriate strength characteristics. The choice of materials will depend on the applications for the system. For example, in residential construction it may be desirable and permitted under local regulations to use polymeric materials. In commercial construction, local building codes may require metal tie rails.

The wall ties 24, in one aspect, may be formed with one or more optional lines of weakness 54 in the center walls 44 of the restraining portions 32 and 34. Such lines of weakness 54 may be formed by score lines, molded separation lines, perforations of a variety of configurations or other weakening techniques. As shown in FIG. 6, which depicts a wall segment with the forming cavity 22 filled with concrete 56, the lines of weakness 54 permit removal of the exterior flanges 48 (and center wall 44) of the retaining portions 32 and 34.

The removal of the exterior flanges 48 may be desirable to provide a relatively consistent surface to apply a surface treatment to the exterior surface of panels 18 and 20. Similarly, the groove or opening 58 between the panels 18 or 20 resulting from the removal of the exterior flange 48 and center wall 44 of the retaining section 32 or 34 also may provide anchoring locations for surface treatments such as stuccos, plasters, cementitious coatings and related materials.

In other applications, the exterior flanges 48 and center walls 44 may be removed to permit the selective removal of one or more panels 32 and 34 to expose the surface of the concrete formed and cured in the system. Thus, the completed structure may have some wall sections where the panels 32 and 34 are left in place, and others where they are removed.

When maintained in place, the exterior flanges 48 of the wall tie rails 24 also may act as anchor points along the finished wall sections 18 and 20. In this aspect, the wall tie rails 24 are made of a polymeric or metal compositions with sufficient strength to provide locations for the attachment of wall fixtures, electrical conduit and plumbing piping, wall treatments, wall boards, sheeting materials, paneling or other such wall mounted materials.

In one important aspect, the wall ties 24 provide substantially continuous attachment surfaces for the vertical length of the panels. In other aspects, the attachment surfaces may be interrupted over limited lengths of the ties 24 by the partial removal of the exterior flanges 28 where attachment surfaces of such a configuration is desirable. The wall tie rails 24 also, when made of the appropriate metal or other similar composition, act as anchor locations for scaffolding or other construction equipment. Such attachments may be made using a variety of screw type or driven fasteners, as well as adhesives, or fastening systems.

Figure 7:
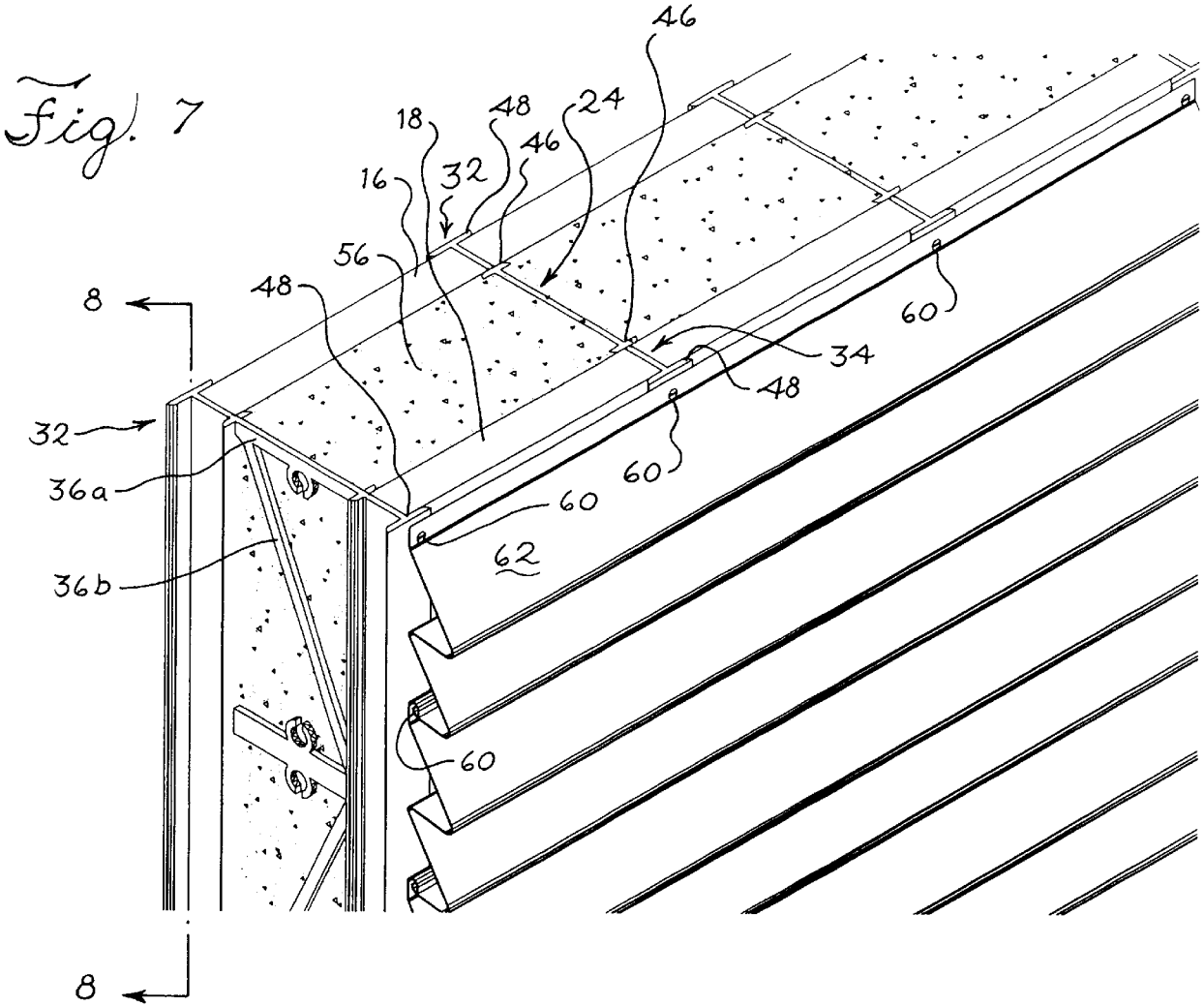
FIG. 7 is a perspective view of a portion of the wall system shown in FIG. 1 filled with concrete, where a siding wall treatment is attached to the exterior portion of the wall system and showing a drainage plane provided by the wall system.

In addition, as shown in FIGS. 5 to 7, the exterior flanges 48 may be used to provide raised anchor points 60 for exterior siding 62. In prior systems, wooden strips or planking were attached to ICF concrete wall constructions to provide anchoring locations for exterior siding at a significant additional cost in time and labor when compared to wooden frame structures. The exterior flanges 48 of the forming system 10, may be used as an alternative to such added materials, as they can provide attachment locations that are integral to the forming system and can be spaced at standard distances along to wall system. As a result, the system 10 can reduce both the time, funds, labor and inconvenience associated with installing exterior, or for that matter, interior wall treatments such as paneling or wall board.

Moreover, because the flanges 48 protrude a distance from the wall surfaces, that can provide an air gap and drainage plane behind siding or paneling that can drain any water that may seep into the space between the siding or paneling and the wall surface. As shown in FIG. 7, such a drainage plane is provided on each form panel and further grooves or embossments may be added to assist in the flow of moisture down the panels and from behind the siding, similar advantages can be realized for internal siding and wall treatments.

Figure 9:
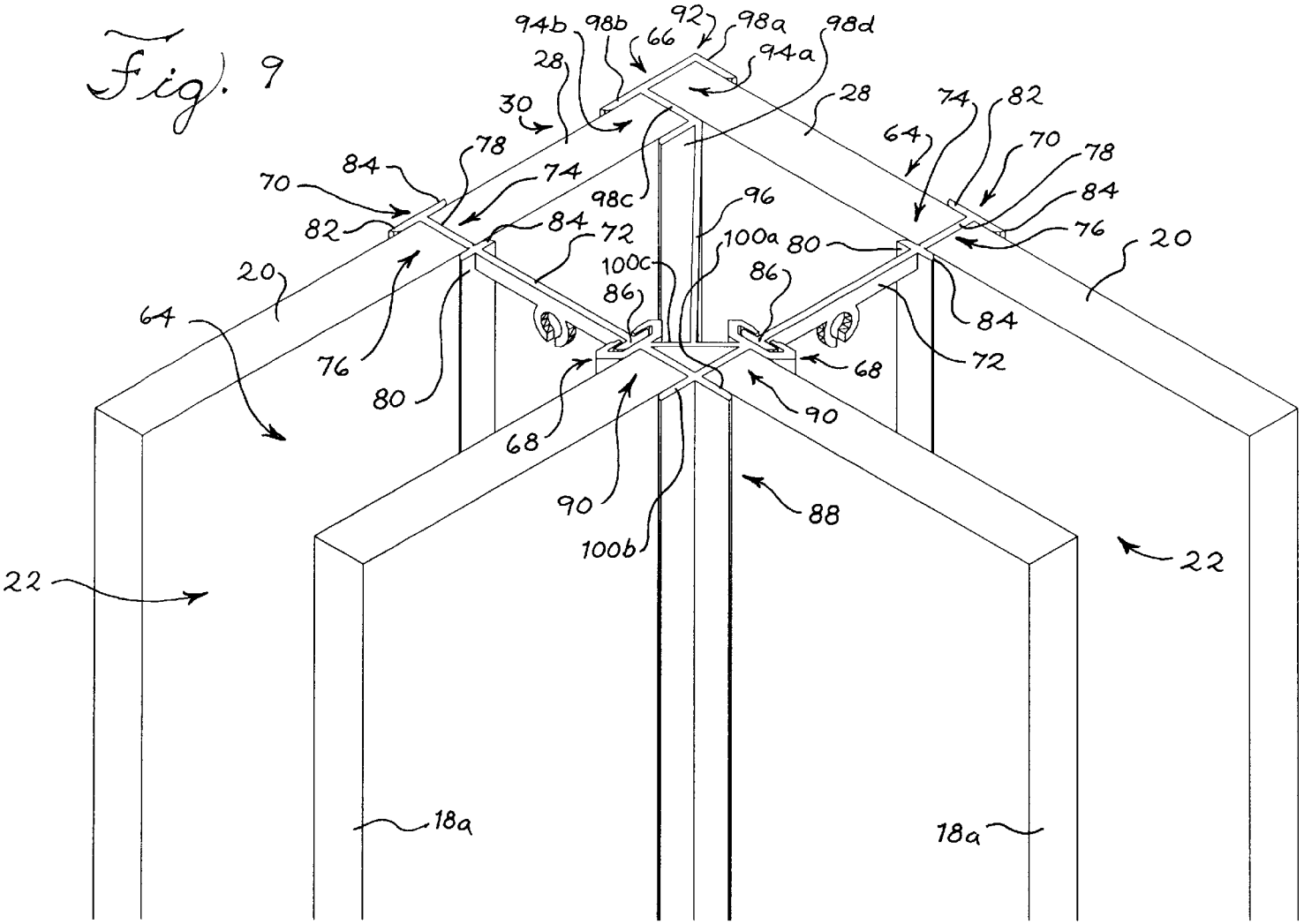
FIG. 9 is a perspective view of the corner form system and corner tie rail assembly of the forming system shown in FIG. 1.
Figure 10:
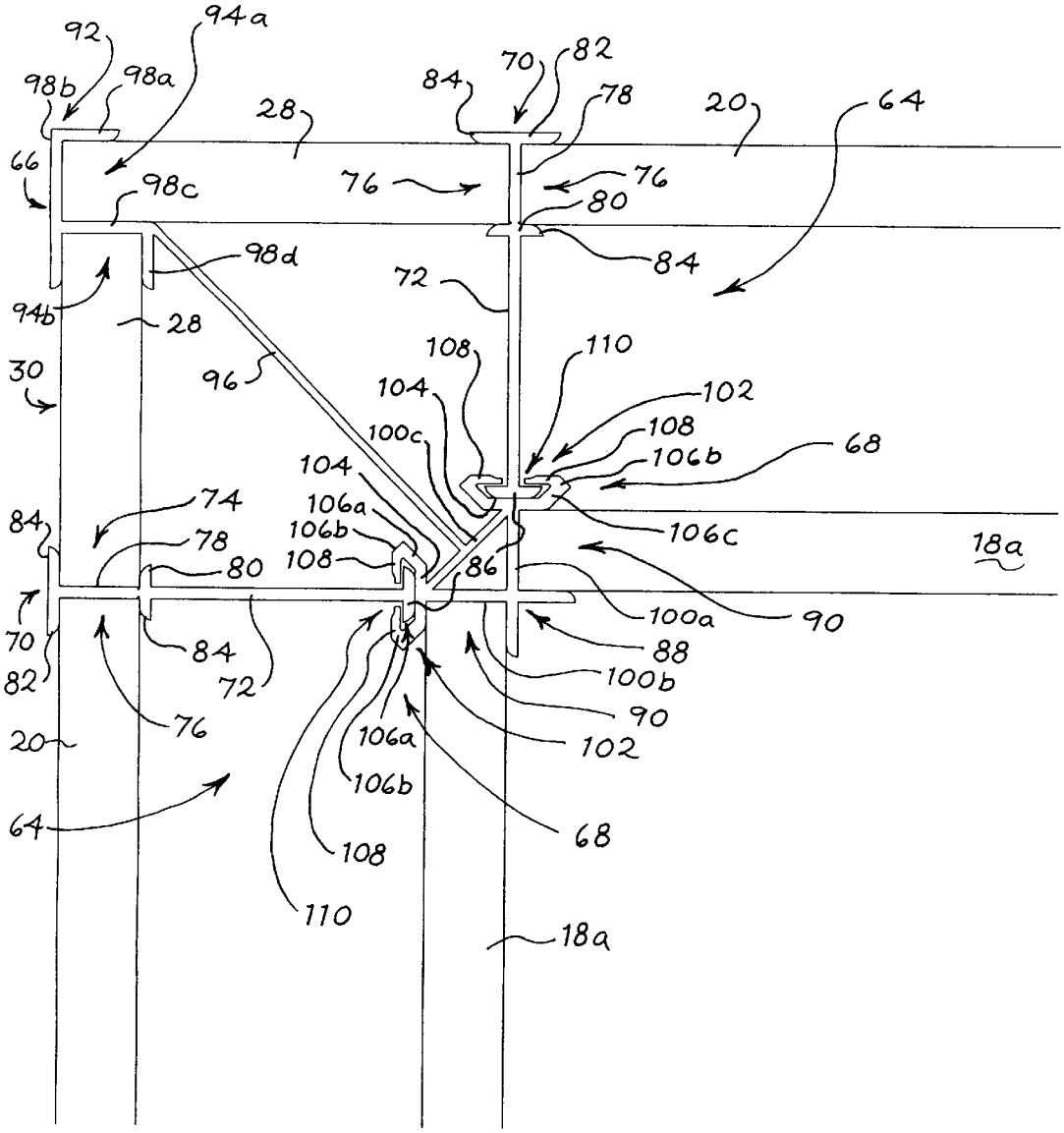
FIG. 10 is a top plan view of the corner form and tie rail assembly shown in FIG. 9.

As shown in FIGS. 1, 9, and 10, and as mentioned above, the corner assemblies 14 include inner corner panels 18*a*, and outer corner panels 28 and one or more corner tie rails 64 and corner bracket rails 66. As shown in FIGS. 1, 9 and 10, the corner assembles are located at the angular intersection of at least two wall systems 12. In one aspect, the corner tie rails 64 may be adopted from a wall tie rails 24 by the removal of the exterior flange 48 a center wall 64 of the wall tie rail. Typically this is accomplished by removal of the flange 48 and center wall 64 along the line of weakness 54 discussed above. Alternatively, a corner tie rail 64 may be independently provided for use in the system 10.

The corner tie rails 14 include an inner corner retaining section 68 and a second outer corner retaining section 70, and may extend generally the vertical length of the panels 20 and 28 (on a substantial portion of the vertical length). One or more webs 72 span the distance between, and connect, the corner retaining portions 68 and 70. As in the wall tie rails 24, the corner tie rail webs 72 may (but do not necessarily) include one or more horizontal webs and one or more angled webs to increase the rigidity of the tie rails. The web sections (not shown), also may include one or more bracket loops to hold conventional reinforcing bars or other such materials, between the panels 18*a* and 28. The corner tie webs 72 also have a width generally equivalent to the width of the forming cavity 22.

Each of the outer retaining sections 70 of the corner tie rails 64 further include at least two channels 74 and 76 defined by a center wall 74 and 76 and outwardly extending interior flanges 80 and exterior flanges 82. Like the wall tie rails 24 discussed above, the openings of the channels 74 and 76, in this aspect of the invention, are generally disposed in opposing directions to receive at least a portion of the side or edge of adjacent wall forming panels 20 in channel 76 and the corner panels 28 in channel 74. As with the previously discussed retaining sections 32 and 34 of the wall tie rails 24, the flanges 80 and 82 defining the channels 74 and 76 of the corner tie rail 64 typically are spaced apart a distance sufficient to allow the insertion of the panels in the channels 74 and 76 with relatively low force and to hold the vertical edges or borders of the wall panels 20 in the channels 74 and 76 (for corner panels 28). As with the wall ties 24, the flanges 80 and 82 also may be spaced to positively grip the panel edges, which may require greater insertion force.

As with the wall tie rails 24, the fit between flanges 80 and 82 and the edges or borders of the panels 20 and 28 typically is sufficient to resist the accidental or incidental dislodgement of the panel edge from the channel. The flanges 80 and 82, in addition, extend a sufficient distance from the outer retaining section center wall 78 to further engage the panel edges or sides and resist the dislodgement of the panels from their respective channels 74 and 76 during the filling of the system with concrete, working the poured concrete, and during the curing process. Such dislodgement, for example, may occur when forces are exerted in such directions outwardly from the cavities between the panels by the concrete or as a result of tamping, probing or other working of the concrete.

As with the wall tie rails 24, and as indicated in FIGS. 9 and 10, the surfaces of the flanges 80 and 82 defining the channels 74 and 76 may include angled edges inwardly directed towards the center wall 78 to ease the insertion of the edges or sides of the panels 20 and 28, and into the channels 74 and 76. As with the wall tie rails 24, other flange configurations and angular displacements also may be used to accomplish similar results depending on the materials used. The surfaces of the flanges 80 and 82 disposed in the channels 74 and 76 may be textured or ribbed to increase the frictional engagement between the flanges 80 and 82 and the panel edges or sides disposed within the channels 74 and 76, and appropriate adhesives or tapes also may be used to further enhance the engagement.

As shown in FIGS. 9 and 10, the inner corner retaining portion 68 of the corner tie rail 64 includes an outwardly extending flanges 86 at approximately the terminal end of the corner tie rail web section 72. The flanges 86 extend in opposite directions relative to the web section 72, to form a generally T-shaped configuration. The inner corner retaining portion 68 may be formed as an integral part of the corner tie rail 64, or may be formed from wall tie rails 24 with the weakened line 54 discussed above, such as those shown in FIG. 5 above. In that latter instance, the center wall 44 and exterior flange 48 of the inner retaining portion 32 of such wall tie rails 24 are removed along the weakened line 54, leaving only the inner flange 46, which may serve as the retaining portion 68.

As shown in the aspect of FIGS. 9 and 10, the corner rail assembly 30 also includes the inner corner bracket 88 with two inner corner panel channels 90*a* and 90*b*, and an outer corner bracket 92 providing two inner corner panel channels 94*a* and 94*b*. A corner bracket web section 96 spans the distance between and joins the outer 88 and inner 92 corner brackets. As in the wall tie rails 24, the corner bracket webs 96 may (but do not necessarily) include horizontal web sections, angled web sections (not shown) and one or more bracket loops to hold conventional reinforcing bars or other such materials.

The corner brackets 88 and 92 and web 96 cooperate to assist in maintaining the inner 18*a* and outer 28 corner panels in a predetermined angular alignment. For example, in the aspect shown in FIGS. 9 and 10, the inner 88 and outer 92 brackets engage and hold corner panels 18*a* and 28, respectively, at generally a right angle (90°) to each other, although other angles may be employed depending on the desired configuration of the completed wall forming system 10. The inner bracket channels 92*a* and 92*b* and outer bracket channels 94*a* and 94*b* grip the edges of the panels 18*a* and 28 to resist the panels' displacement from the brackets 88 and 92.

The web 96 further acts to restrain the movement of the brackets 88 and 92, maintain the brackets 88 and 92 in a generally vertical alignment, as well as to maintain their predetermined spacing to provide a cavity 22 of proper general dimensions. The corner assembly 30, in addition, may act to stabilize and reinforce the corners of the forming system 10 by spreading the stress and strains created by the forces acting on the corner assembly 30 among the panels 18*a* and 20, the corner tie rails 64, the corner brackets 88 and 92 and the corner web 96.

The channels 94*a* and 94*b* provided by the outer corner bracket 92 are formed by the channel walls 98*a*, 98*b*, 98*c*, and 98*d*. In this aspect, the wall 98*b* forms both the rear wall of the channel 94*a* and the outer side wall of channel 94*b* opposite wall 94*d*. Similarly, the wall 98*c* forms the rear wall of channel 94*b* and a side wall of channel 94*a*, opposite wall 98*a*. The portions of the walls 98*a* through 98*d* defining the channels 94*a* and 94*b*, typically are spaced apart a distance sufficient to accommodate the edge or side of a panel 28 within the wall or channel as discussed above with respect to the wall ties 28.

The engagement between 98*a* and 98*c*,and 98*b* and 98*d* and the edges or sides of the panels 28 should be sufficient to resist the accidental or incidental dislodgement of the panel edges from the channels 94*a* and 94*b*. Similarly, the segments of the walls 98*a* through 98*d* forming the sides of the channels 94*a* and 94*b* should extend a sufficient length to resist the dislodgement of the panel edges or borders from the channels 94*a* and 94*b* due to the pressures on the panels 28 during the pouring, working and curing of the concrete in the cavity 22.

As with the wall tie rails 24, the surfaces of the walls 98*a* through 98*d* forming the interior channels 94*a* and 94*b* may be textured, ridged, cross hatched, or provided with other surface treatments to increase the frictional engagement of between the edges or sides of panels 28 and the interior surfaces of the channels 94*a* and 94*b*, and appropriate adhesives or tapes may also be used to enhance the engagement. The edges of the walls 98*a* through 98*d* forming the opening to channels 92*a* and 92*b*, in addition, may be angled as discussed above to ease the insertion of the panels 28 into the channels 92*a* and 92*b*.

In the aspect shown in FIGS. 9 and 10, the channels 90*a* and 90*b* of the inner corner bracket 88 are defined by walls 100*a* through 100*c*. In this aspect, similar to the outer corner bracket 92, the wall 100*a* forms both a side wall of the channel 90*b* and the rear wall of channel 90*a*. The wall 100*b* forms the side wall of channel 90*a* and the rear wall of channel 90*d*. Also, as with the outer corner of bracket 92, the portions of the walls 100*a* through 100*c* defining the channel 90*a* and 90*b* typically are spaced apart a distance sufficient to hold the edges or sides of panels 18*a* within the channels 90*a* and 90*b*.

The walls 100*a* through 100*c*, in addition, extend a length sufficient to assist in resisting the dislodgement of the edges of panels 18*a* from the channels 90*a* and 90*b* due to the pressures exerted on the panels 18*a* during the pouring, working and curing of the concrete in the forming cavity 22, as well as the inadvertent dislodgement of the panels 18*a* from the channels 90*a* and 90*b* during assembly of the system 10. The surfaces of the walls 100*a* through 100*c* may be textured, ridged, cross hatched, or provided appropriate adhesives or tapes, and with other surface treatments to increase their engagement with the edges or sides of the panels 18*a*, and may be angled to ease the insertion of the panels in the channels 90*a* and 90*b*.

The inner corner bracket 88 further provides corner tie rail channels 102 formed or mounted on the cavity side of the bracket 88, and generally are located at or near the intersection of the bracket walls 100*a* and 100*c*, and 100*b* and 100*c*. The corner tie rail channels 102 are positioned generally opposite adjacent borders of the outer wall panel 20 and outer corner panel 28, to cooperate with the corner tie rails 64. As shown in FIGS. 9 and 10, the inner corner retaining section 68 of the corner tie rail 64 is inserted into the tie rail channel 102 and is held within the channel 102, as discussed below.

The tie rail channels 102 include a base wall 104, first angled side walls 106 and inward, laterally extending front walls 108 configured to define the channel enclosure, with an opening 110 providing access to the channel 102. The openings 110 are sized to permit the insertion of the corner tie rail retaining flanges 86 within the channels 102 so that the flange sections 86 are retained within the channel 102, with the corner tie web 72 extending through the channel opening 110 and out of the channel 102.

The angles of the channel side walls 106*a*, 106*b* and wall 108 correspond to the angled and linear segments of the corner tie rail retaining flanges 86. As a result, the walls 104, 106*a*, 106*b*, and 108 provide an enclosure that engages the corner tie rail flanges 86 in a substantially interlocking relationship to resist, and in many instances prevent, the removal of the tie rail flanges 86 from within the channel 102. As a result, once inserted within the corner tie rail channels 102, the inner flanges 86 of the corner tie rails 64 are substantially locked in place to hold the wall panels 20 and 28 in the proper position relative to the wall 18 and corner panels 18*a* during the pouring, working and curing of concrete in the cavity 22 between the panels.

As shown in FIG. 1 (and in FIG. 25 further discussed below) the panels and tie rails of the system 10 may further be reinforced along the bottom border of the panels and rails by the footing brackets, bracket 26, or similar bottom bracing. The footing brackets 26 assist in maintaining the wall panels 18 and 20 and corner panels 18*a* and 28 in the proper alignment during the assembly of the system and further act to inhibit the outward movement of the bottom edges of the panels during the pouring and working operations as the cavity 22 between the panels is filled with concrete.

Other bracing systems may be used with the forming system 10, including wooden planks or boards, metal plates or channels, or similar systems. Such bracing may be positioned support one or more wall sections. Similar bracing may be used to reinforce the corner sections of the system, and, in many applications such corner bracing may be substantially reduced relative to prior systems. Bracing systems, in addition, may be arranged along the panel bottom border that are fixed in place and assist in holding the panels in their predetermined orientations.

An example of such a system 10 utilizing expanded foam insulating panels utilizes foam panels made of expanded polystyrene foam with a thickness of about 2 inches, a width of about 12 inches, and a height of about 8–10 feet. The wall tie rails 24, corner tie rails 64 and corner brackets 66 are made of polyvinyl chloride or light gauge steel. In such a system, the wall tie rail 24 includes retaining portions 32 and 34, with channels 40 and 42 having a width of about 2 inches. The corner tie rails, rail channels 74 and 76, and corner bracket channels 90, 94*a* and 94*b* also have width of about 2 inches.

The flanges of the wall ties 24 extend about one inch from the center walls 44 for a total width of 2 inches. The flanges of the corner ties 64 and corner brackets 66 similarly extend about 2 inches. The flanges' angled edges are displaced at an angle of about 30 to about 60 degrees relative. The adhesives and tapes that may be used with such a system include those well known to those of ordinary skill such as wood adhesives, low expanding foam adhesives, fiber glass tapes and other construction adhesives and tapes approved for use with the selected panel materials.

For a structure with concrete walls about 4 to 12 inches thick and a height of 8 feet, the panels have a vertical height of about 8 feet and a width of about 12 inches. The wall tie rails and corner tie rails have a height of about 8–10 feet, with the rail webs 36 having a width of about 4–12 inches, providing a forming cavity about 8' in height and 4–12" in width. Sufficient space should be provided between the webs 36 to permit an appreciable flow of concrete through and around the webs 36. Following conventional pouring procedures, the concrete system would be filled in passes depositing 2–4 feet of concrete in the forming cavity until the cavity is filled, with time permitted between passes to allow the concrete to harden to a certain extent.

The forming system 10 of the invention, in addition, is relatively simple to install and use. As mentioned above, the system is assembled on a prepared footing of concrete or other materials 16. The footing brackets 26 first may be installed on the footing, spaced a distance apart sufficient to provide for the forming cavity 22 and the forming panels 18, 18*a*, 20 and 28, as well as the wall tie rails 24 and corner assemblies 14. Alternatively, the footing brackets may be installed after the assembly of the system 10.

Figure 25:
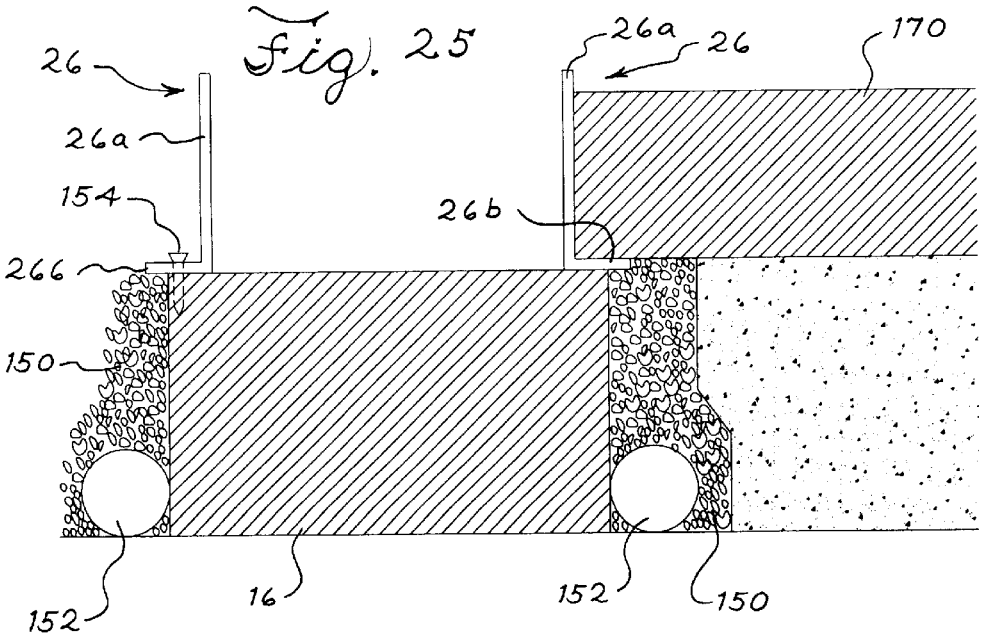
FIG. 25 is a side elevation view of one aspect of the forming system of the invention which provides a footing and footing brackets to hold and support the bottom edges of the forms used in the system.

Each set of inner panels 18 and outer panels 20 are inserted into at least one wall tie rail 24 or corner rail 64 and is placed between footer brackets 26 such as those shown in FIGS. 1 and 25. The next set of panels 18 and 20 then are added to the system 10 by inserting them within the footer brackets 26 by inserting the side peripheral borders of the panels 18 and 20 into the open wall tie rail channels 24 holding the previously installed panel sections. As the corner assemblies 14, edges of the last outer panels 20 in the wall sections are inserted into the wall tie channels 76. The panels 18 and 18*a*, and 20 and 28 are joined by a series of wall tie rails 24 to form a wall section which continues into a corner assembly 14.

The corner assemblies 14 may be first constructed by inserting the retaining flanges sections 86 of the corner tie rails 64 into their corresponding tie rail channels 102 of the inner corner bracket 88. The peripheral edges of the outer corner panels 28 then may be inserted into the channels 94*a* and 94*b* of the outer corner bracket 92 to form the outer wall portion of the corner assembly 14. The opposite edges of the panels 28 similarly are inserted into the corner wall tie channels 74. The edges of the inner corner panels 18*a*, which are typically the last panel in the wall section, may be inserted into the channels 90*a* and 90*b* of the inner corner bracket 88 to complete the corner assembly.

The system 10 then is completed by installing and connecting sufficient forms on the footing 16 to provide a sufficient length of walls and sufficient numbers of corners to enclose the desired area. As mentioned above, suitable bracing also may be used if needed in the specific application at the corner assemblies or along the wall sections.

The desired amount of concrete or other hardenable materials is then poured into the cavity 22 between the panel forms and the concrete is tamped, worked and otherwise treated to eliminate air pockets, occlusions or other faults in the concrete wall. The concrete is permitted to cure, and after the curing step is complete, the panels are left in place on the walls to add insulation to the cured concrete walls, reduce moisture seepage, and provide the other advantages of insulated concrete forming systems.

Further construction steps may include, for example, attaching siding or other wall treatments to the exterior flanges 48 of the wall tie rails 24. Alternatively, the tear off feature of the wall tie rails 24 may be used to remove the exterior flange 48 to provide a smoother outer surface. It is believed that the panels adhere to the formed concrete through chemical or mechanical bonding in most such systems when the exterior flange 48 is removed. In other applications, one or more panels may be removed from the formed walls to expose the formed concrete surface, after removal of the flanges 48 of the wall tie rails 24.

Passages may be cut into the panels 18, 18*a*, 20 and 28 also may be cut to provide recessed passages for electrical conduit and plumbing. In this aspect, the wall ties rails 24, corner tie rails 64 and corner brackets 88 and 92, are made of polymeric plastic materials that are relatively easy to cut and frequently do not require additional insulating elements (electrical or thermal) to hold the conduit or piping.

By providing a system with vertical, panel forms, the system 10 permits the use of more conventional forming techniques familiar to those in the field and reducing training and, in some instances, may reduce governmental approval expenses.

The system 10 further reduces the number and amounts of cutting of the forms relative to block systems and other systems that are not as adaptable to work site modifications. The corner and wall forms can be pre-cut to the required dimensions, as can the openings for doors and windows, as the system is more predictable and well suited for prefabrication.

The system's 10 use of vertical forms and its wall and corner tie rails reduce the potential for form lifting or floating due to the difference in densities between the forms and the concrete as they are fewer horizontal joints and seams and the tie rails may run the height of the wall. Similarly, the use of the tie rails of hardened materials, with gaps between the webs reduces the compression of the system by the concrete as in other systems utilizing foam insulating blocks and panels. If floating does become a concern, the panels and rails may be adhered to the footer brackets 26 further discussed below.

Moreover, by providing continuous vertical tie rails with portions raised above the surface of the panels, the system provides predictable and highly visible attachment points, including points at the corner intersections which permit the use of conventional siding, paneling and other construction techniques when materials, appliances and structures are attached to the walls and corners. Further, when metal tie rails are utilized, the attachment points can carry substantial loads, such as that required for scaffolding. The tie rails also provide uniform spacing of the wall panels and corner panels and are spaced at regular intervals improving the ability of the installer to properly align the walls and corners.

Similarly, the use of a vertical panel and tie system reduces the need for custom cutting and the waste associated with other systems where cut pieces cannot be reused in the system. Moreover, where appropriate heavier duty rails may be used to provide for floor anchors or other strength dependent attachment joints. This reduces or eliminates the need for redundant posts or other supports for such application.

The system also provides walls with consistent and predictable cross-sections. Thus, unlike other systems utilizing blocks and tubes, there is a reduced, if any, need to probe or measure the walls to locate concrete sections of sufficient thickness for a particular use, or for panel areas free of concrete for utility boxes and the like.

As a further advantage, the wall and corner tie rails are adaptable for use with conventional foam and the other above mentioned panel materials. These may be "off the shelf" products with known, generally consistent dimensions and properties. The system's adaptability and "open character" further permits the substitution of panels of different materials and strength properties in the system. For example, polymeric or cementious panels may be substituted in a system where insect resistance is required by building codes (such as in below ground level installations).

Similarly, such polymeric or cementitious panels may be selectively used in the system 10 where increased panel strength, toughness on surface properties are required, for example in corners, exterior walls, and certain wall segments. Alternatively, the system is adaptable for use where it may be desirable to provide exposed concrete surfaces over part of the system, and insulating panels over other parts of the system. The removable flanges of the wall ties permit such adaptation of the system to specific project needs relatively simply and at relatively low cost in terms of labor and time.

The "open" nature of the panels that may be used in the system also permits the use of panels from a variety of sources and manufacturers. Thus, this system provides for an opportunity to encourage competition and cost savings for such panels. The system also may be in relatively flat, compact containers further reducing shipping costs.

The above mentioned corner assembly, in addition, is internally self-supporting in many applications requiring less, if any, external bracing. If adhesives and tapes are used to fix the panels in the corner ties and brackets, the corner assemblies can be significantly strengthened and may not require any bracing. The corner rail system of the corner assembly which may reach the full height of the panels also is easier to plumb and align than prior comparable systems, and requires fewer parts. The corner brackets and rails also provide attachment points at or proximate the corner intersections, without the need for additional lathing, boards or other attachment points. Similarly, the continuous or semi-continuous flanges on the outer surfaces of the system provide greater flexibility for securing wall treatments or fixtures to the walls.

In an alternative aspect of the wall tie rails and corner rail assemblies (not shown), the inner corner retaining flanges may be disposed at an angle to form longer openings to their respective channels. In addition, the retaining flanges 86 of the inner corner retaining section 68 of the corner tie rails 64 may be offset at an angle and the walls of the corner tie rail channels 102 may be similarly altered to form a tight interlocking relationship with the inner corner bracket 88.

As shown in FIGS. 11 through 15, an alternative aspect of the corner rail assembly 214 is shown that is adjustable for a variety of wall thickness as determined by the spacing between the wall panels 18 and 20 and corner panels 18*a* and 28. In this aspect, the corner rail assembly 214 includes a corner tie rail 264, and an inner corner bracket 288 and outer corner bracket 292, and wall tie rails 24. As with the previously discussed tie rails and corner bracket, the corner tie rails 264 and corner brackets 288 and 292 generally extend the full or a substantial portion of the vertical length of each corner panels 28.

The corner tie rails 264 may be a modified wall tie rails or a preformed corner tie rail, and include an inner corner retaining section 268 and an outer corner retaining section 270. One or more webs 296 span the distance between, and connect, the corner retaining portions 268 and 270. The outer retaining section 270 includes exterior flanges 282 extending from a center wall 278 in a generally "T"-shaped configuration.

Figure 11:
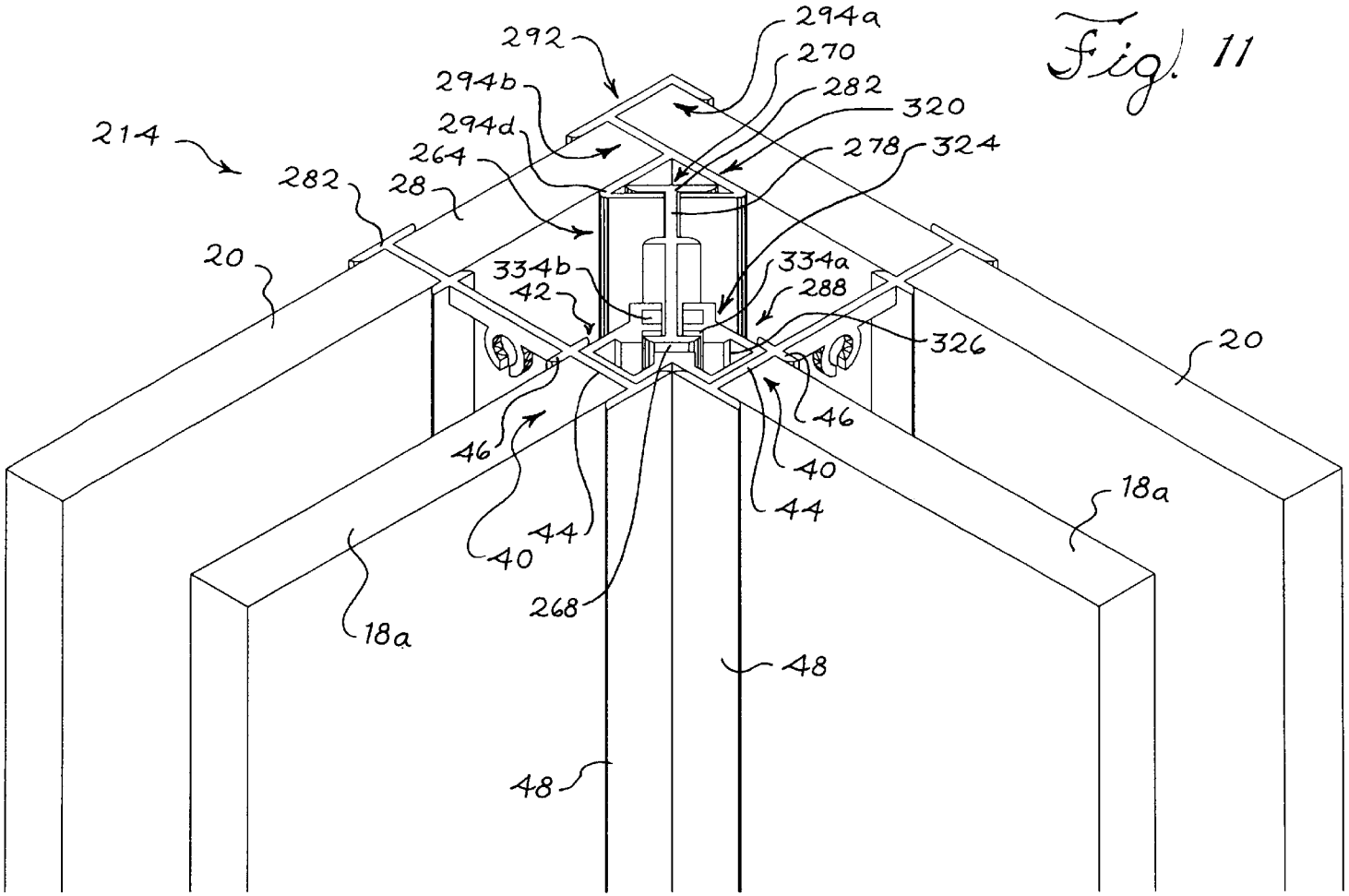
FIG. 11 is a perspective view of another alternative aspect of a corner form and tie rail assembly which provides an adjustable corner assembly for use in forming multiple wall thicknesses, where the assembly is positioned to form structures with a first predetermined wall thickness.
Figure 12:
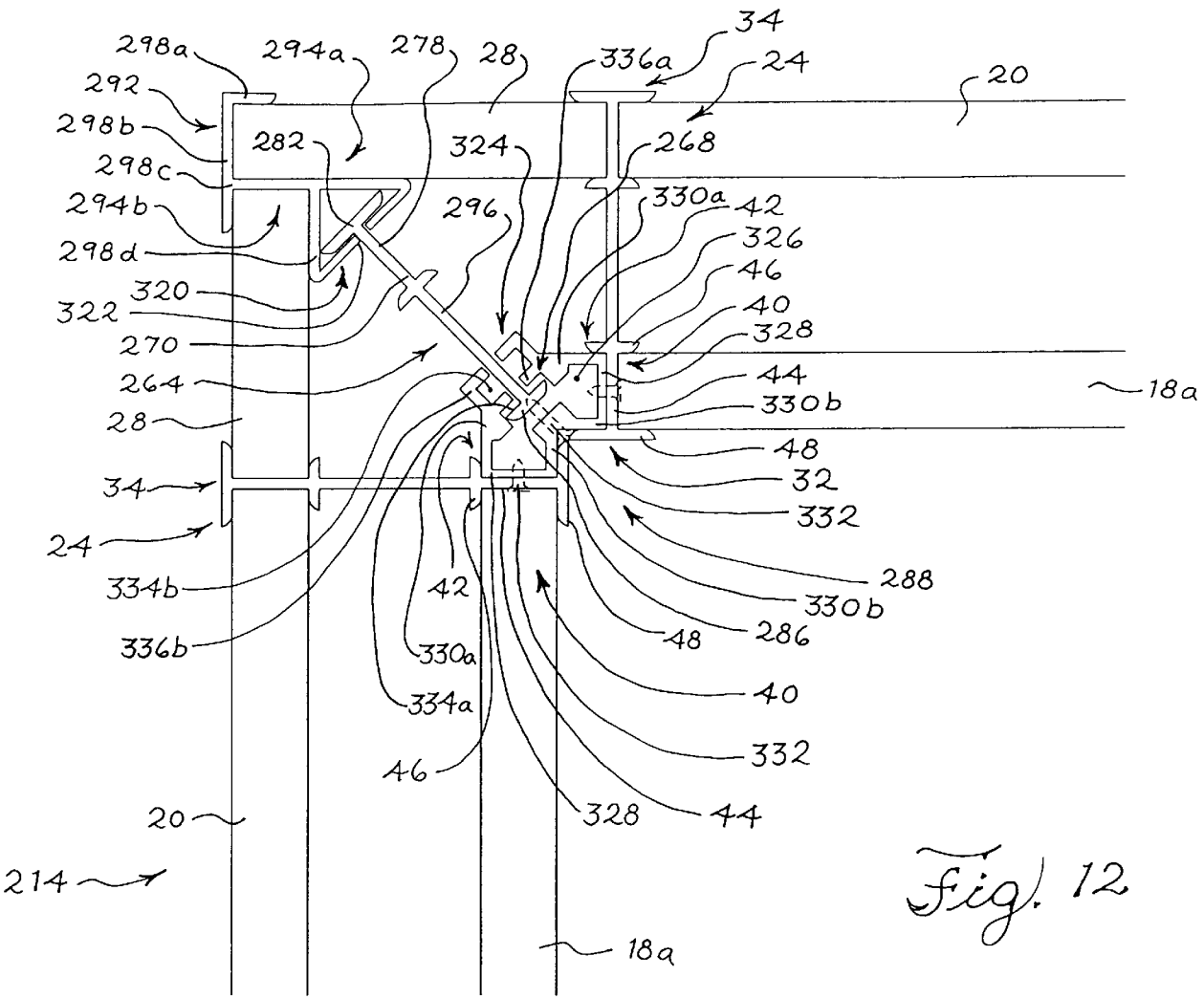
FIG. 12 is a top plan view of the alternative corner form and tie rail assembly shown in FIG. 11.

As shown in FIGS. 11 and 12, the inner corner retaining portion 268 of the corner tie rail 264 includes outwardly extending flanges 286 at approximately the terminal end of the corner tie rail web section 296. The flanges 286 extend in opposite directions relative to the web section 296 also to form a generally "T"-shaped configuration. As also shown in FIGS. 1 and 12, the corner assembly 214 includes the wall tie rails 24 discussed above having the inner wall retaining section 32 and outer wall retaining section 34, with the exterior flanges 48, interior flanges 46 and center wall 44.

In this aspect, a weakened line (not shown) in the tie rails 24, also provides the opportunity to convert the retaining sections 32 or 34 into the corner tie rail 264. As shown in FIGS. 7A and 7B, the exterior flange 48 and center wall 44 of the wall tie rail retaining sections 32 or 34 may be removed along a weakened line (not shown), leaving only the inner flange 46, which can serve as the inner retaining section flange 286 in a corner tie rail 264. Similarly, the remaining outer flange 48 may serve as the outer corner retaining flange 282 in the corner tie rail 264. This aspect of the invention reduces the number of specialized parts for the forming system of the invention and thereby provides greater cost and time efficiencies in the use of the system.

In the aspect shown in FIGS. 11 and 12, the outer corner bracket 292 provides two outer corner channels 294*a* and 294*b*, and an outer corner tie channel 320. As with the previously discussed corner brackets 92, in this alternative aspect the channels 294*a* and 294*b* of the outer corner bracket 292 cooperate to assist in maintaining the outer wall corner panels 28 in a predetermined angular alignment. As shown in FIGS. 11 and 12, the panels 28 are maintained at a right angle although other angles also may be employed.

The outer corner channel walls 298*a* to 298*d* define channels 294*a* and 292*b* and are disposed to receive and hold the vertical sides or edges of the corner panels 28. The terminal section of the outer corner channel wall 298*c*, and the terminal section of the outer corner channel wall 298*d* further are turned back and angled to form the outer corner tie channel 320 with a channel opening 322.

The outer corner tie channel 320 is sized to accept and engage the exterior flange 282 of the corner tie 264, and the outer corner tie channel opening 322 further is sized to accommodate the corner tie center wall 278. Both the corner tie channel 320 and channel opening 322 are sized to permit the insertion of the tie flange 282 into the channel 320 by sliding the flange 282 through the channel 320.

The terminal sections of the walls 298*c* and 298*d* overlap and engage the tie flange 282 sufficiently to resist or prevent the dislodgement of the flange 282 and tie center portion 278 from the channel 320 when subject to the pressures and forces occurring during the assembly of the system, and during pouring, working and curing of concrete or other similar materials in the cavity 22 between the forms 18 and 20, and 18*a* and 28.

As shown in the aspect of FIGS. 11 and 12, the inner corner bracket 288 is formed by the second, inner retaining sections 32 of the wall ties 24, which further include the channels 40 and 42. As previously mentioned, the channels 40 and 42 are defined by the interior 46 and exterior 48 flanges, and center wall 44 of the ties 24.

The channels 40 and 42, in addition, are sized to engage and hold edges or sides of the corner panels 18*a* inserted in the channels. The inner corner bracket 288 also includes a generally "Y" shaped inner bracket body 324, which typically extends a length similar to the length of the corner panels 18*a* (but need not do so). The inner bracket body 324 includes insert sections 326 each of which is formed by the body end walls 328, and side walls 330*a* and 330*b*. The insert sections 326 are sized to fit within and engage the channel 42 on each of the tie rails 24 of the corner assembly 288 opposite the channels 40.

The insert sections 326 further may be anchored to the tie rails' inner retaining sections 34 by fasteners 332, adhesives, or other fastening systems. The intersection of the insert sections 326, in addition, forms a backing section that is of size and thickness to serve as the base for an anchor member 332. The anchor member may be a screw, adjustable pin, spring, biasing member or other similar member useful as an anchor as described below.

The bracket body 324 further includes side walls 330*a* and 330*b* generally defining interior anchor channel 334*a* and exterior anchor channel 334*b*. The anchor walls 336*a* extend inwardly from the side walls 330*a* to define an opening into the interior anchor channel 334*a*. The anchor walls 336*b* also extend inwardly from the side walls 330*a* to define an opening into the exterior anchor channel 334*b*, as well as provide a rear wall portion for the interior channel 334*a*.

As shown in FIGS. 11 and 12, the anchor walls 336*a* and 336*b* extend to provide openings to the interior 334*a* and exterior 334*b* anchor channels sufficiently wide to accommodate the web portion 296 of the corner tie rail 264. The anchor walls 336*a* and 336*b* further extend a distance sufficient to form an abutment surface engageable with the flange 286 of the corner tie rail 264. Thus, as also shown in FIGS. 11 and 12, when the corner tie rail flange 286 is inserted into one of the anchor channels 336*a* or 336*b*, the flange 286 and corner tie rail 264 is engaged and interlocked within the anchor channels 336*a* or 336*b*.

For the aspect FIGS. 11 and 12, the wall system 10 is arranged for use in forming relatively thin walled structures, such as structures with an about four inch concrete wall thickness. In this aspect, the wall ties 24 are provided with web sections 72 sized for the proper wall thickness. A corner tie 264 is provided with a web sized for the proper wall thickness. The corner tie flange 286 of the tie 264 is positioned within the inner tie anchor channel 334*a*, and one or more anchor members 332 are fixed to and through the backer section formed by the intersection of the side walls 330*b*. The anchor member 332 is advanced into engagement with the corner tie rail inner flange 296 and further is advanced a distance sufficient to exert significant pressure against the flange 286 to assist in maintaining the flange in interlocking engagement within the bracket body walls 330 and/or anchor walls 336*a*.

Figure 13:
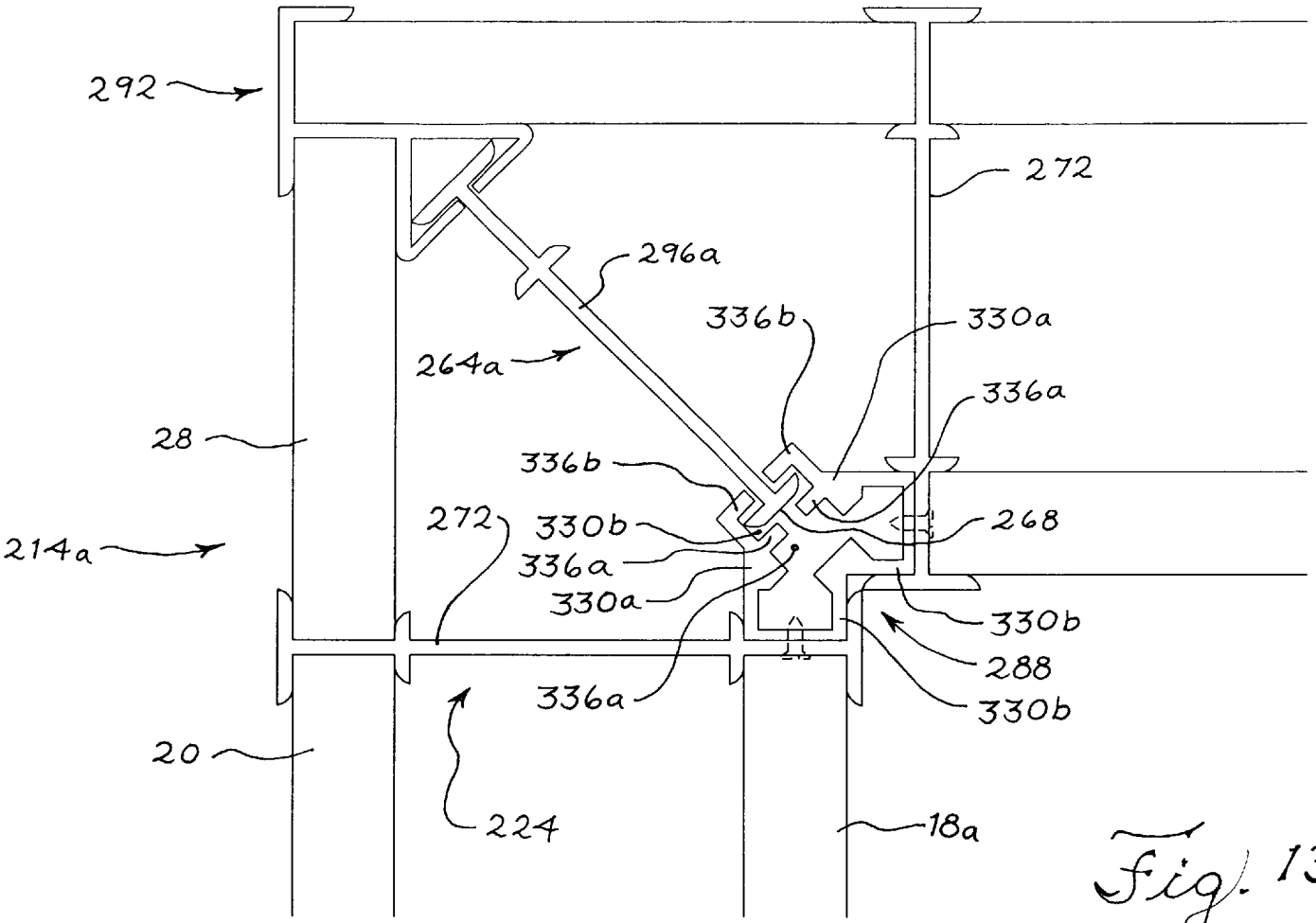
FIG. 13 is a top plan view of the alternative corner form and tie rail assembly shown in FIG. 11 where the assembly is positioned to form structures with a second, increased predetermined wall thickness.

As shown in FIG. 13, the corner assembly 214*a* shown in FIGS. 11 and 12 is adapted for use in forming somewhat thicker structure walls, such as about six inch thick walls. In this aspect, the wall tie rails 224 used in the forming systems 10 and the corner tie rails 264 include a lengthened web sections 272 and 296*a*, respectively increasing the overall width of the rails. The lengthened web 272 and 296*a* provide an expanded forming cavity between wall panels 18 and 20, and corner panels 18*a* and 28 sufficient to accommodate the increased wall thickness.

The flange 268 of the inner corner retaining section of the corner tie rail 264*a* is inserted and mounted in the inner anchor channel 336*b* increasing the spacing between the outer corner bracket 292 and inner corner bracket 288 to provide the properly sized corner cavity within the forms. In this aspect, the surfaces provided by the inner anchor walls 336*a* within the inner anchor chamber 330*a*, as well as the outer anchor walls 336*b* are positioned and act to maintain the flange 268 in interlocking engagement in the anchor channel 336*b*. If desired, anchor screws or similar members (not shown) or adhesives may be used to further secure the flange 268 within the chamber 336*b*.

Figure 14:
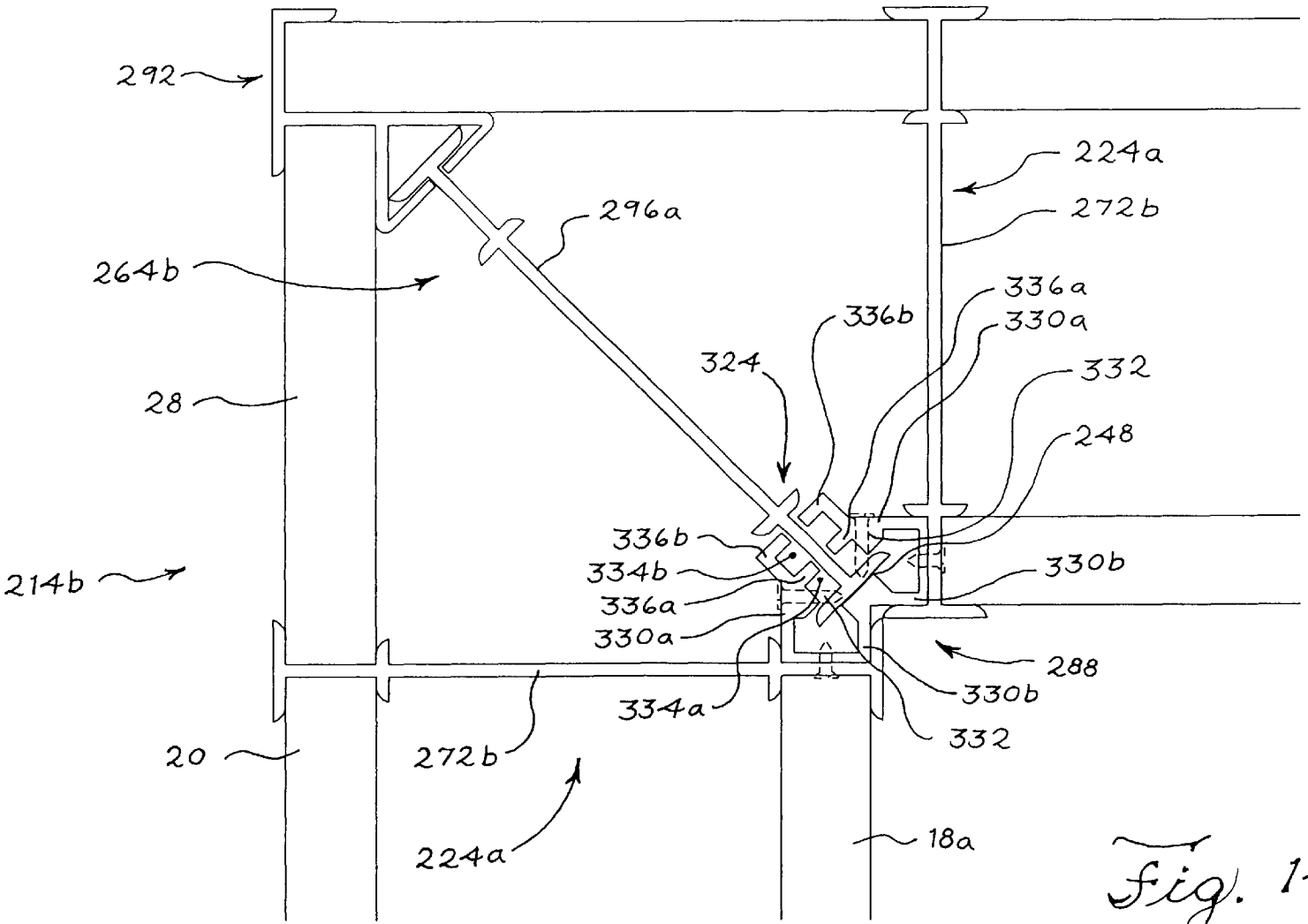
FIG. 14 is a top plan view of the alternative corner form and tie rail assembly shown in FIG. 11 where the assembly is positioned to form structures with a third, increased predetermined wall thickness.
Figure 15:
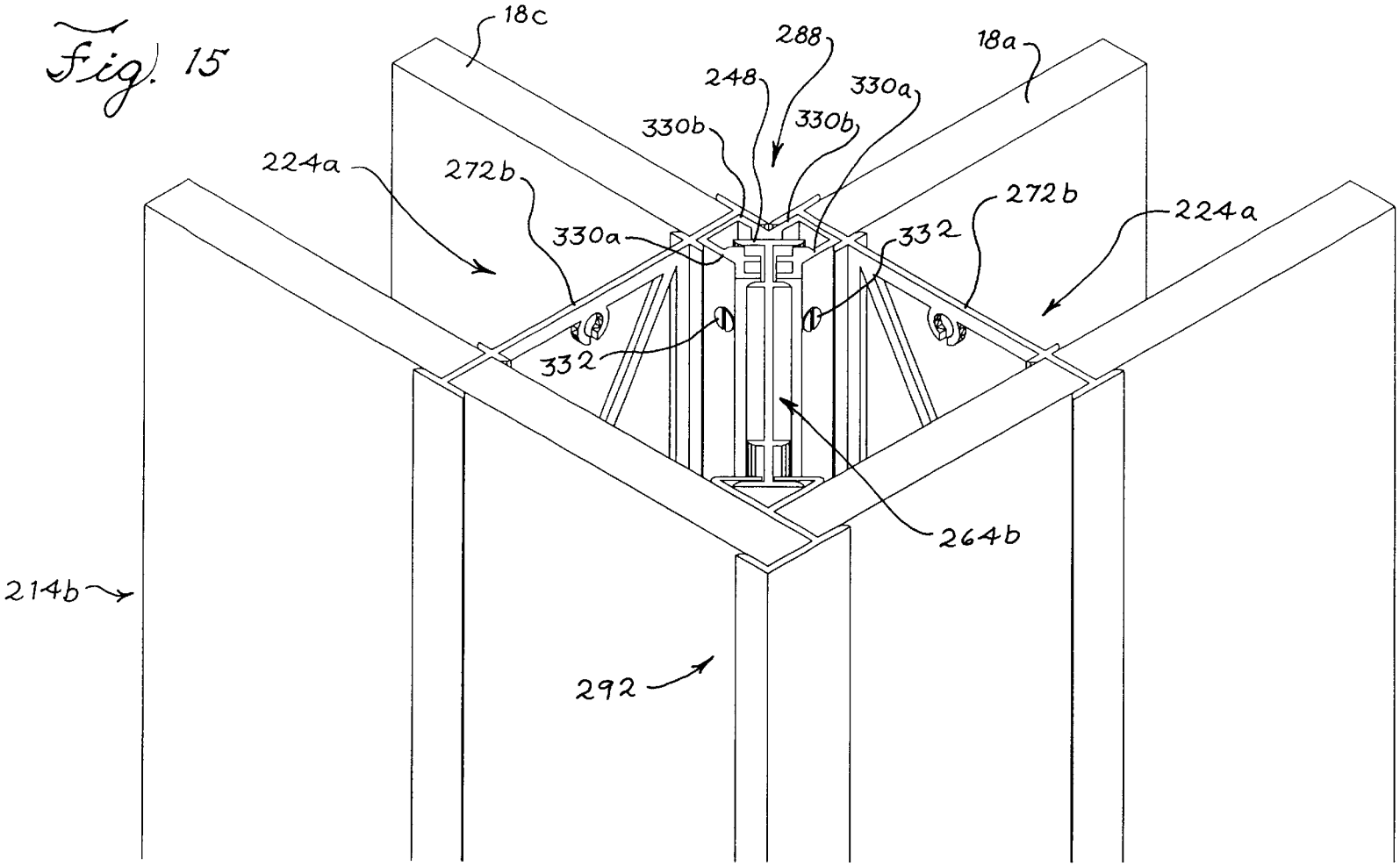
FIG. 15 is a perspective view of the corner form and tie rail assembly shown in FIG. 14.

As shown in FIGS. 14 and 15, the corner assembly 214*b* shown in FIGS. 11 and 12 is adapted for use in forming significantly thicker structure walls, such as about eight inch thick concrete walls. In this use, the tie rails 224*a* and the corner tie rail 264*b* include a lengthened web section 272*b* and 296*a*, respectively increasing the overall width of the wall tie rails 224*a* and corner rails 264*b* in the system 10 providing a forming cavity between panels sufficient to accommodate the significantly increased wall thickness.

As with the previously discussed aspect shown in FIGS. 11 and 12, the flange 248 of the inner corner retaining section of the corner tie rail 264*b* is inserted and mounted in the inner anchor chamber 334*a* also increasing the spacing between the outer corner bracket 292 and inner corner bracket 288 to provide the properly sized corner forming cavity. In this aspect, anchor fasteners 332, such as screws or similar anchoring members may be driven through the walls 330*a* to engage and press the flange 248 against the backer section formed at the intersection of the walls 330*b*. If desired, adhesives, biasing members or other elements extending engagement pressure against the flange 248 or tie section within the inner corner "Y" body 324 also may be used further secure the flange 248 and tie 264*b* within the inner corner "Y" body 324.

Thus, in the embodiments shown in FIGS. 11 and 15, the forming system of the invention provides a uniquely flexible corner form system that is relatively simple to construct, strong, stable and self-reinforcing under the stress and pressures that occur during the corner tie assembly, and the pouring, working and curing of the concrete within the system. With this aspect of the corner assembly, the forming system of the invention further can be readily adapted for use in constructing structures with a variety of wall thickness and dimensions.

Figure 16:
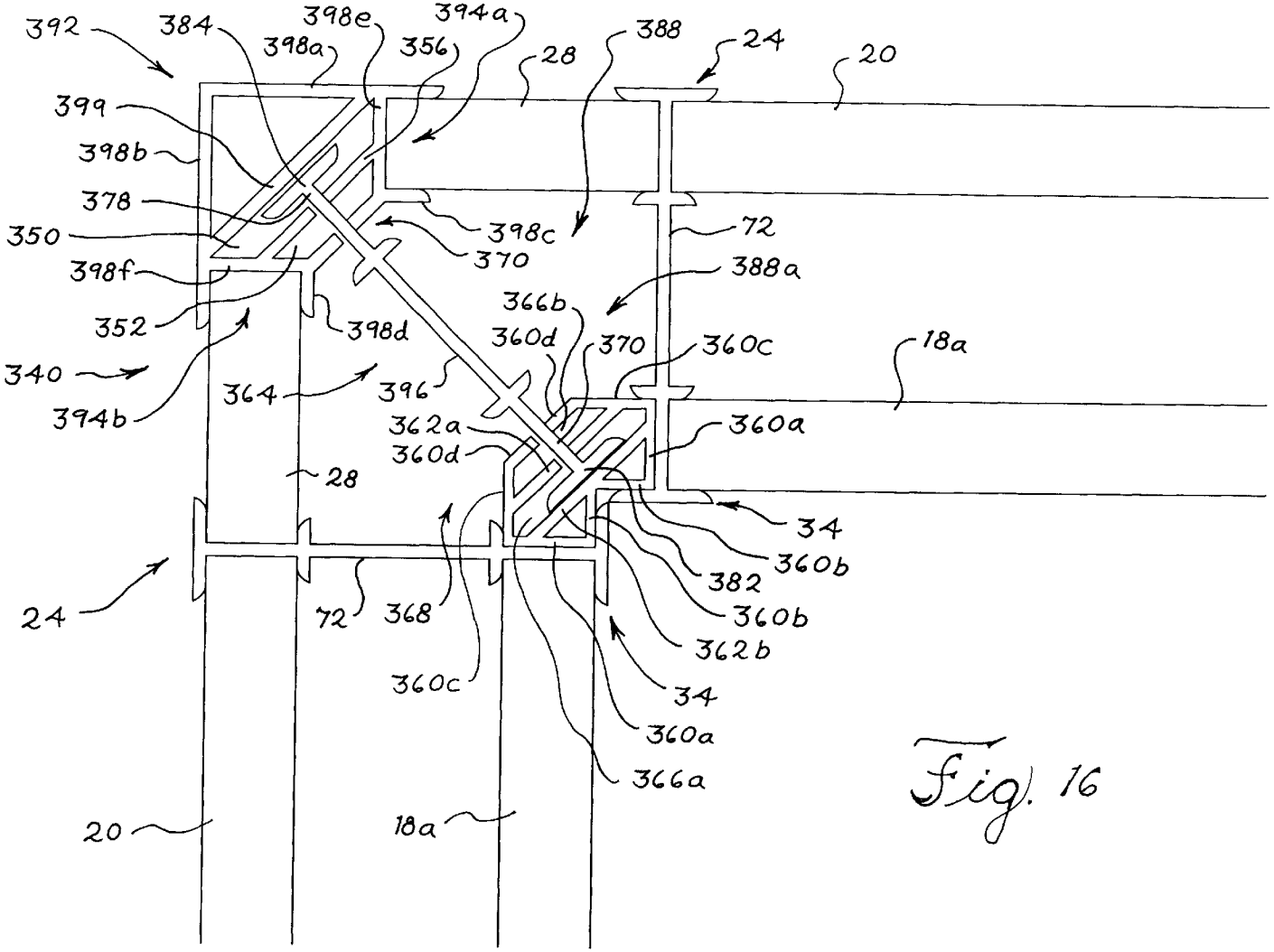
FIG. 16 is a top plan view of second alternative aspect of a corner form and tie rail assembly which provides an adjustable corner assembly for use in forming multiple wall thicknesses, where the assembly is positioned to form structures with a first predetermined wall thickness.
Figure 16A:
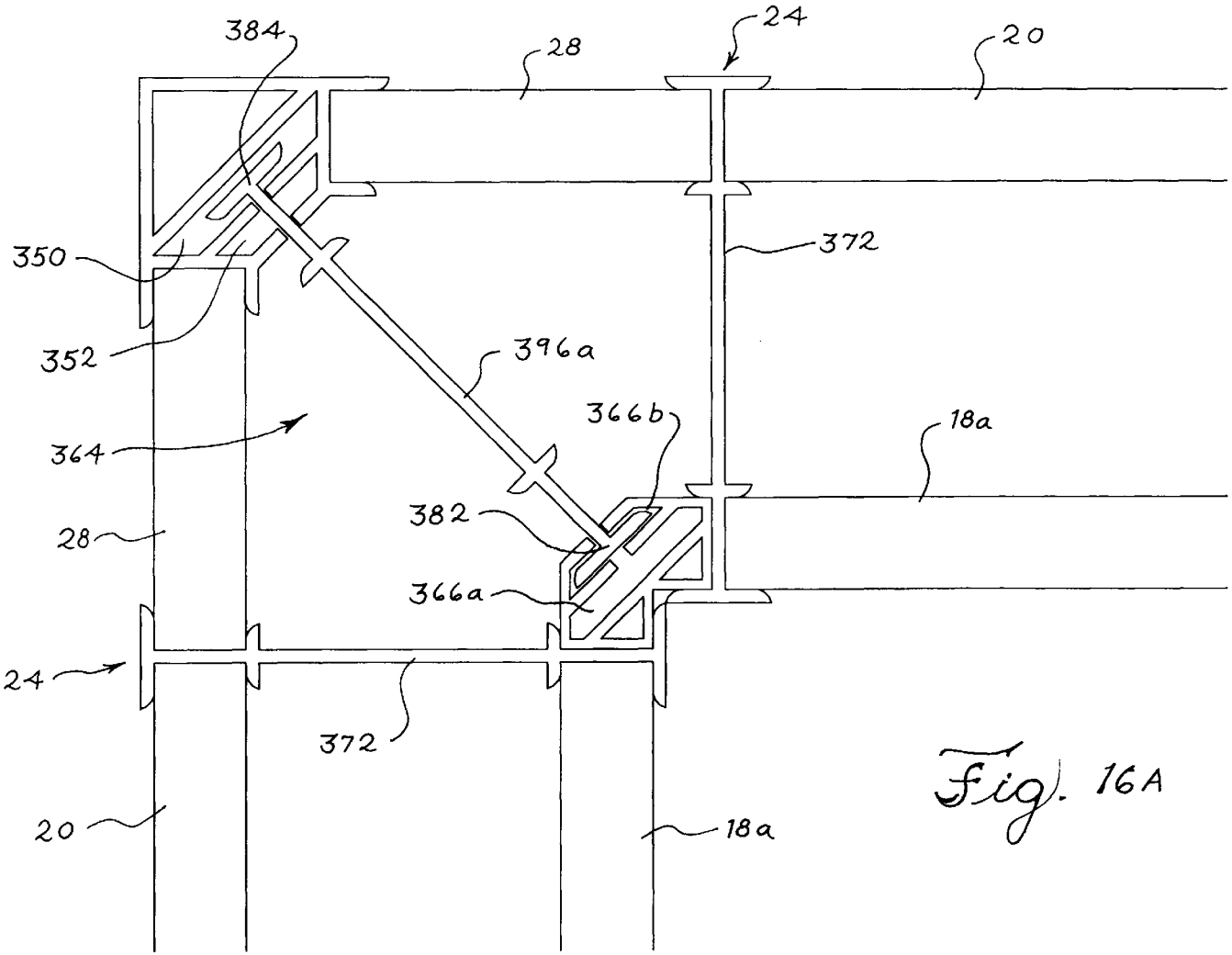
FIG. 16A is a top plan view of the alternative corner form and tie rail assembly shown in FIG. 16 where the assembly is positioned to form structures with a second, increased predetermined wall thickness.
Figure 16B:
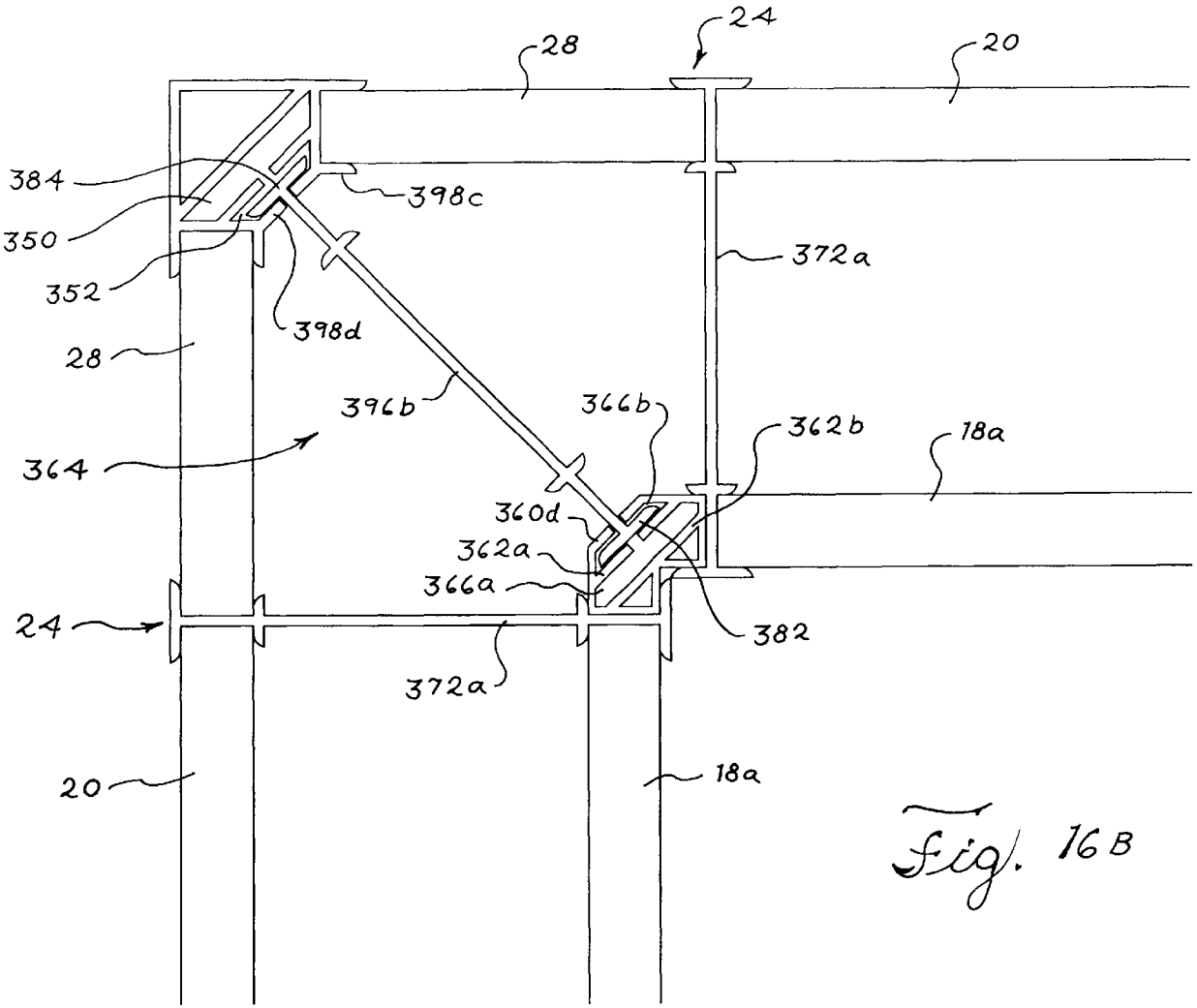
FIG. 16B is a top plan view of the alternative corner form and tie rail assembly shown in FIG. 16 where the assembly is positioned to form structures with a third, increased predetermined wall thickness.

As shown in FIGS. 16 through 16B, an alternative adjustable corner assembly 340 is shown that provides for a variety of wall thickness as determined by the spacing between the wall panels 18 and 20 and corner panels 18*a* and 28. In this aspect, the adjustable corner assembly 340 includes a corner tie rail 364, and an inner corner bracket 388 and outer corner bracket 392, and the previously discussed wall tie rails 24. As with the previously discussed wall tie rails, the corner tie rail 364 and corner brackets 388 and 392 generally extend the full or a substantial portion of the vertical length of the corner panels 18*a* and 28.

The corner tie rail 364 may be a wall tie rail, such as wall tie rail 24, or a pre-formed corner tie rail configured for that application. As shown in FIGS. 16 through 16B, a wall tie rail such as previously discussed is used for the corner tie rail 364, and when used in this capacity the tie rail includes an inner corner retaining section 368 and an outer corner retaining section 370. One or more webs 396 span the distance between, and connect, the corner retaining portions 368 and 370. The inner retaining section 368 and outer retaining section 370 include exterior flanges 382 and 384, respectively extending from a center wall 378 in a generally "T"-shaped configuration.

In the aspect shown in FIG. 16, the outer corner bracket 392 provides two outer corner channels 394*a* and 394*b*, formed by side walls 398*a*, 398*b*, 398*c* and 398*d*, and rear channel walls 398*e* and 398*f*. As with the previously discussed corner brackets, the outer corners 394*a* and 394*b* are disposed to receive and hold the vertical sides or edges of the corner panels 28. The channels 394*a* and 394*b* of the outer corner bracket 392 cooperate to assist in maintaining the outer wall corner panels 28 in a predetermined angular alignment. As shown in FIG. 16 through 16B, the panels 28 are maintained at a right angle although other angles also may be employed.

The outer corner side walls 398*c* through 398*f* and bracket wall 399 generally define anchor channels 350 and 352. The anchor walls 356 extend inwardly from the side walls 398*e* and 398*f* to define an opening into the anchor channel 350. The walls 398*c* and 398*e* also extend inwardly to define an opening to the channel 352. As shown in FIG. 16, the walls 356 and 398*c* and 398*d* provide openings to the channels 350 and 352 sufficiently wide to accommodate the well portion 378 of the corner tie rail connected to the exterior flange 384.

The walls 350, 398*c* and 398*d* further extend a distance sufficient to form abutment surfaces engageable with the flange 384 of the corner tie rail 364. Thus, when the corner tie rail flange 384 is inserted into one of the anchor channels 350 or 352, the flange 384 may be engaged and interlocked within the anchor channels 350 or 352. The walls 350, 398*c* and 398*d* also engage the tie flange 384 to resist or prevent the dislodgement of the flange 384 from the channels 350 or 352 during the assembly of the system, and during pouring, working and curing of concrete or other similar materials in the cavity 22 between the forms 18 and 20, and 18*a* and 28.

As shown in FIG. 16, the inner corner bracket 388 is formed by the second, inner retaining sections of two wall ties 24 and an inner corner bracket body 388*a*. As previously mentioned, the channels formed by the retaining portions 34 of the wall ties 24 are sized to engage and hold edges or sides of the corner panels 18*a* inserted in the channels. The inner bracket body 388*a* is generally "Y" shaped and typically extends a vertical length similar to the length of the corner panels 18*a* (but need not do so). The inner bracket body 388*a* includes insert sections formed by the body end walls 360*a*, and side walls 360*b* and 360*c*. The insert sections are sized to fit within and also engage the inner retaining section 38 on each of the tie rails 24 of the corner assembly.

The bracket body 388*a* further includes walls 362*a* and 362*b* that, with walls 360*d*, generally defining an anchor channel 366*a* and anchor channel 366*b*. The walls 360*d* and 362*a* extend inwardly from the side walls 360*c* to define an opening into the anchor channels 366*a* and 366*b*, as well as provide a rear wall portion for the channel 366*b*. The wall 362*b* provides a rear wall portion for the channel 366*a*. As shown in FIG. 16, the openings to the anchor channels 366*a* and 366*b* are sufficiently wide to accommodate the wall portion 378 of the corner tie rail 364.

The anchor walls 360*d* and 362*a* further extend a distance sufficient to form an abutment surface engageable with the flange 382 of the corner tie rail 364. Thus, as shown in FIG. 16, when the corner tie rail flange 382 is inserted into one of the anchor channels 360*a* or 360*b*, the flange 382 and corner tie rail 364 is engaged and interlocked within the anchor channels 360*a* or 360*b*, of the inner corner bracket body 388*a*. As in the outer corner bracket 392, the anchor walls 360*d* and 362*a* cooperate to resist or prevent dislodgement of the flange from the channels 366*a* and during assembly of the system and during the filling and curing of concrete within the system.

The insert sections of the inner bracket body 388*a* further may be anchored to the tie rails' inner retaining sections 34 by fasteners, adhesives, or other fastening systems, if necessary in a specific application. A backing system (not shown) also may be provided at the intersection of the side walls 360*b* to serve as a base for an anchor member, such as a screw, adjustable pin, spring, biasing member or other similar member that may be used to further secure the flange 382 within the channels 366*a* and 366*b*.

For the aspect shown in FIG. 16, the wall system 10 is arranged for use in forming relatively thin walled structures, such as structures with an about four inch concrete wall thickness. In this aspect, the wall ties 24 are provided with web sections 72 sized for the proper wall thickness. A corner tie 364 is provided with a web 396 sized for the proper wall thickness when the corner tie 364 is engaged in the corner brackets 388 and 392. In this aspect, the corner tie flanges 382 and 384 of the tie 364 are positioned within the inner bracket body channel 366*a* and the outer bracket channel 350. The tie flanges 382 and 384 also may be engaged in the other channels 366*b* or 352, respectfully, to provide the correct spacing between the corner brackets 388 and 392 for the desired wall thicknesses.

As shown in FIG. 16A, the corner assembly 392 shown in FIGS. 16 is adapted for use in forming somewhat thicker structure walls, such as about six inch thick walls. In this aspect, the wall tie rails 24 include a lengthened web section 372 increasing the overall width of the rails. The lengthened web 372 provide an expanded forming cavity between wall panels 18 and 20, and corner panels 18*a* and 28 sufficient to accommodate the increased wall thickness. In this application, the 396*a* of the corner tie rail 364*a* need not be lengthened in view of the selection of the bracket channels discussed below. However, in some applications it also may be desirable to provide a lengthened web 396*a*.

The flange 382 of the inner corner retaining section of the corner tie rail 364 is inserted and mounted in the anchor channel 366*a*, while retaining the outer retaining section flange 384 in the outer bracket channel 350. This increases the spacing between the inner corner bracket 388 and outer corner bracket 392 to provide the properly sized corner cavity within the forms. Alternatively, the outer retaining section flange 384 may be moved to the channel 352 and the inner retaining section flange 382 may be retained in the channel 366*a*. If desired, anchor screws or similar members (not shown) or adhesives may be used to further secure the flanges within the channels.

As shown in FIG. 16B, the corner assembly 340 shown in FIGS. 16 is adapted for use in forming significantly thicker structure walls, such as about eight inch thick concrete walls. In this use, the tie rails 24 includes a lengthened web section 372*a* increasing the overall width of the wall tie rails 24 in the system 10 to provide a forming cavity between panels sufficient to accommodate the significantly increased wall thickness. As mentioned above, the corner tie 364 may also include a lengthened web section 396*a*, if necessary.

As with the previously discussed aspect shown in FIGS. 16 and 16A, the flange 382 of the inner corner retaining section of the corner tie rail 364 is inserted and mounted in the corner bracket anchor chamber 366*b*, and the tie rail flange 384 is mounted in the outer channel 352. This aspect further increases the spacing between the inner corner bracket 388 and outer corner bracket 392 to provide the properly sized corner forming cavity. In this aspect, anchor fasteners such as screws or similar anchoring members may be driven through the walls to engage and press the flanges against the backer section formed at the intersection of the walls 362*b* and 399. If desired, adhesives, biasing members or other elements exerting engagement pressure against the flange 382 and 384 or the tie section within inner body 388*a* and outer bracket 392 also may be used to secure the flange 382 and tie 384 within the brackets 388 and 392.

Thus, in the embodiments shown in FIGS. 16 through 16*b*, the forming system of the invention provides another uniquely flexible corner form system that is relatively simple to construct, strong, stable and self-reinforcing under the stress and pressures that occur during the corner tie assembly, and the pouring, working and curing of the concrete within the system. Moreover, the adjustable system may be formed without substantial cutting or reformation of the system components. For example, the corner tie may be the same as the wall ties used in the rest of the system, or a wall tie that differs only in minor respects. This not only reduces installation costs, but also may reduce the number of separate or unique components that must be ordered and maintained in inventory. The system, in addition, attains these benefit using an "open" system that does not require a large quantity of custom designed parts or part inventories.

Figure 17:
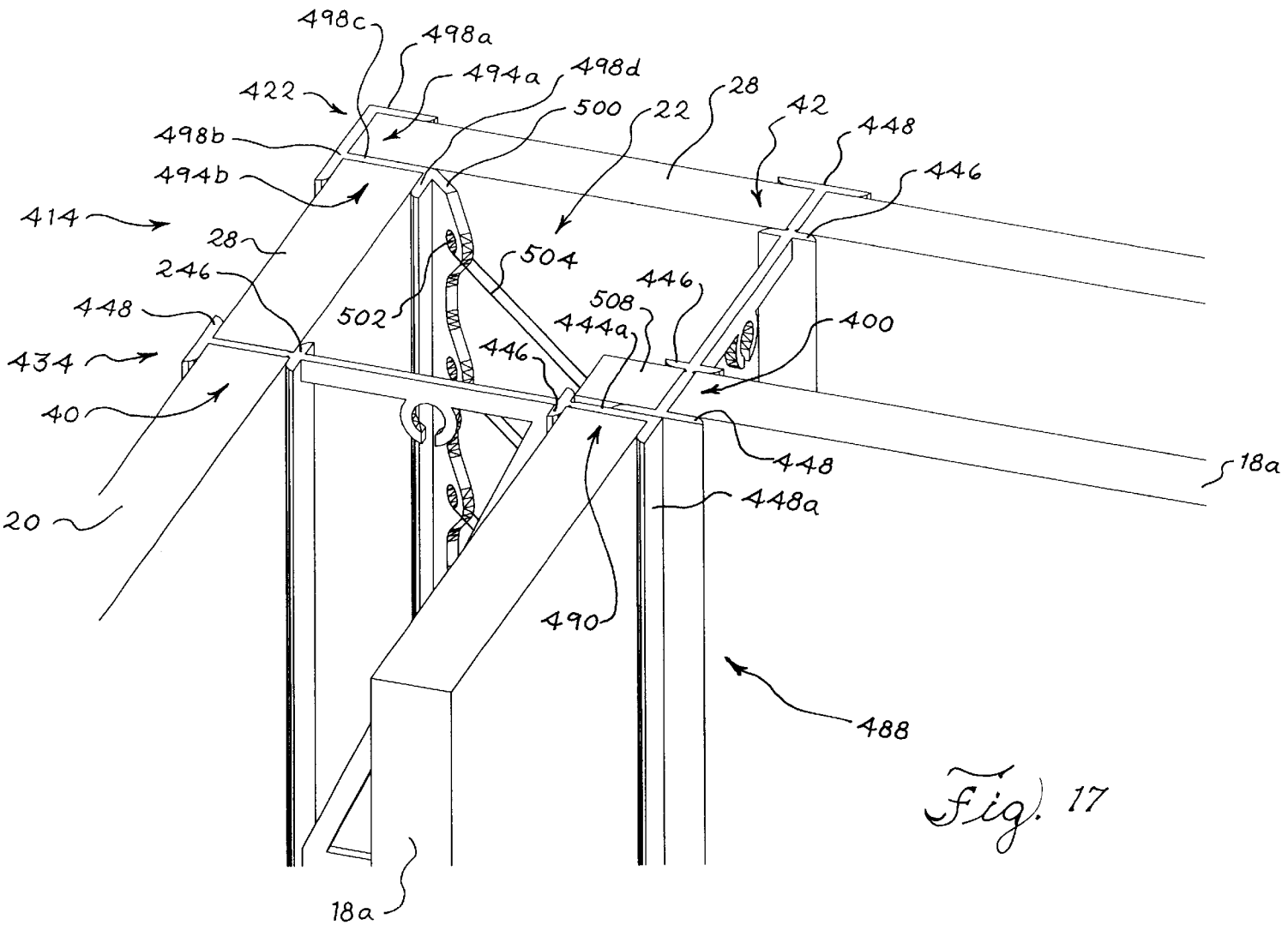
FIG. 17 is a perspective view of another alternative aspect of a corner form and tie rail assembly which provides an adjustable corner assembly for use in the forming system of the invention.
Figure 17A:
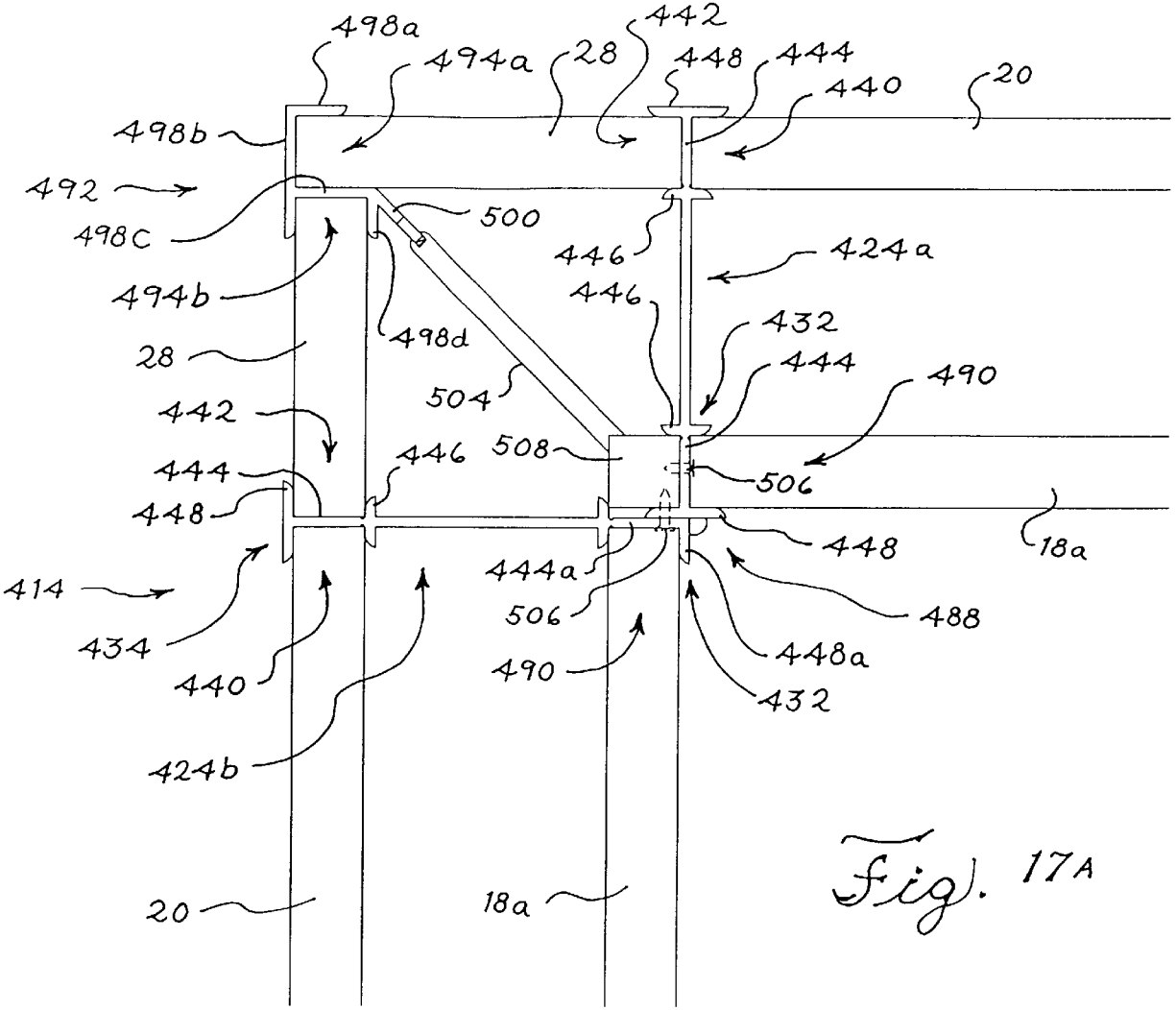
FIG. 17A is a top plan view of the alternative corner tie rail assembly shown in FIG. 17.

As shown in FIGS. 17 and 17A, another alternative aspect of the corner rail assembly 414 is shown and which also may be adjustable for a variety of wall thickness. In this aspect, the corner rail assembly 414 uses an alternative outer corner bracket 492 and modified tie rails 424*a* and 424*b* with a basic configuration such as that discussed above for tie rails 24, 224 and 224*a* (other tie rail configurations also may be used).

The modified tie rails 424*a* and 424*b* include an inner retaining section 432 and an outer retaining section 434. The outer wall engagement section 434 includes exterior flanges 448 and interior flanges 446. The inner retaining section 432 of one of the ties, for example, 424 also includes interior 446 and exterior 448 flanges. The tie rail 424*b*, include interior flange 446 and exterior flange 448*a*. The flanges 446, 448 and 448*a* define outer channels 40 and 42 for receiving and engaging outer wall panels 20 and corner panels 28, as well as the inner channels 490 for receiving and engaging inner corner wall panels 18*a*.

In the aspect shown in FIGS. 17 and 17A, the outer corner bracket 492 provides two outer corner channels 494*a* and 494*b*. As with the previously discussed corner brackets, in this aspect, the corner bracket 492 cooperates to assist in maintaining the outer 28 and inner 18*a* corner panels in a predetermined angular alignment. In the aspect shown in FIGS. 17 and 17A, the outer panels 28 are maintained at a right angle although other angles also may be employed. The outer corner channel walls 498*a* to 498*d* define channels 494*a* and 494*b* to receive and engage the sides or edges of corner panels 28.

The corner bracket 492 further provides an attachment flange 500 extending inwardly from the bracket 492 into the forming cavity 22 between the corner panels 28 and 18*a*. The attachment flange 500 is provided with attachment openings 502 sized to accept a binding member 504 within the openings 502. The attachment flange 500 extends generally the length of the corner panels 28 and corner bracket 492, and the attachment openings 502 are spaced along the flange 500. The number and spacing of the openings 502 will vary depending on the specific application and system needs.

As shown in FIGS. 17 and 17A, the inner corner 488 of the forming system is provided by the interconnection of the inner retaining sections 432 of the ties 424*a* and 424*b*, and the binding member 504. The ties 424*a* and 424*b* are interconnected by the removal of one of the exterior flanges from the inner retaining portion 432 of one of the ties 424*b*, such as 448*a*, and the center wall 444*a* thus exposed is positioned to abut the exterior flange 448 of the other tie 424*a*. A series of fasteners 506 may then be driven though the center walls 444 and 444*a* of the ties 424*a* and 424*b* to secure the center wall 444*a* and flange 448 together. Alternatively, an adhesive or other fastening system may be used for that purpose.

The binding member 504, shown as a wire, cable or cord, is then wrapped around the interconnected inner retaining portions 448 of the ties 424*a* and 424*b*. As shown in FIGS. 17 and 17A, passages may be formed by drilling, molding or other methods in the center wall 444*a* and flange 448 of the interconnected retaining portions of the ties 424*a* and 424*b*. The binding member 504 is inserted through the openings in the interconnected retaining portions to form a reinforced corner assembly where the outer corner bracket 492 and inner corner bracket 488 mutually stabilize the other.

In particular, it is expected that the binding member 504 will resist the pressures exerted outwardly from the cavity 26 between the forms during the pouring and curing of the concrete or other pourable materials used to construct the structure. Optional blocks of foam panel material 508 may be inserted into the open channels of the interconnected inner retaining portions as a filler, and, in some instances the foam filler 508 can be fixed in place with an adhesive or other fastening system.

The alternative system shown in FIGS. 17 and 17A can be utilized for construction of wall structures of different thicknesses by employing the wall ties 424*a* and 424*b*, and binding members 504 of the correct width to form the wall system 12 and the corner assembly 414 of the forming system 10. The outer corner bracket 492 may be spaced from the inner corner 488 by the ties 424*a* and 420*b* with the binding members 504 stabilizing the corner assembly.

Figure 18:
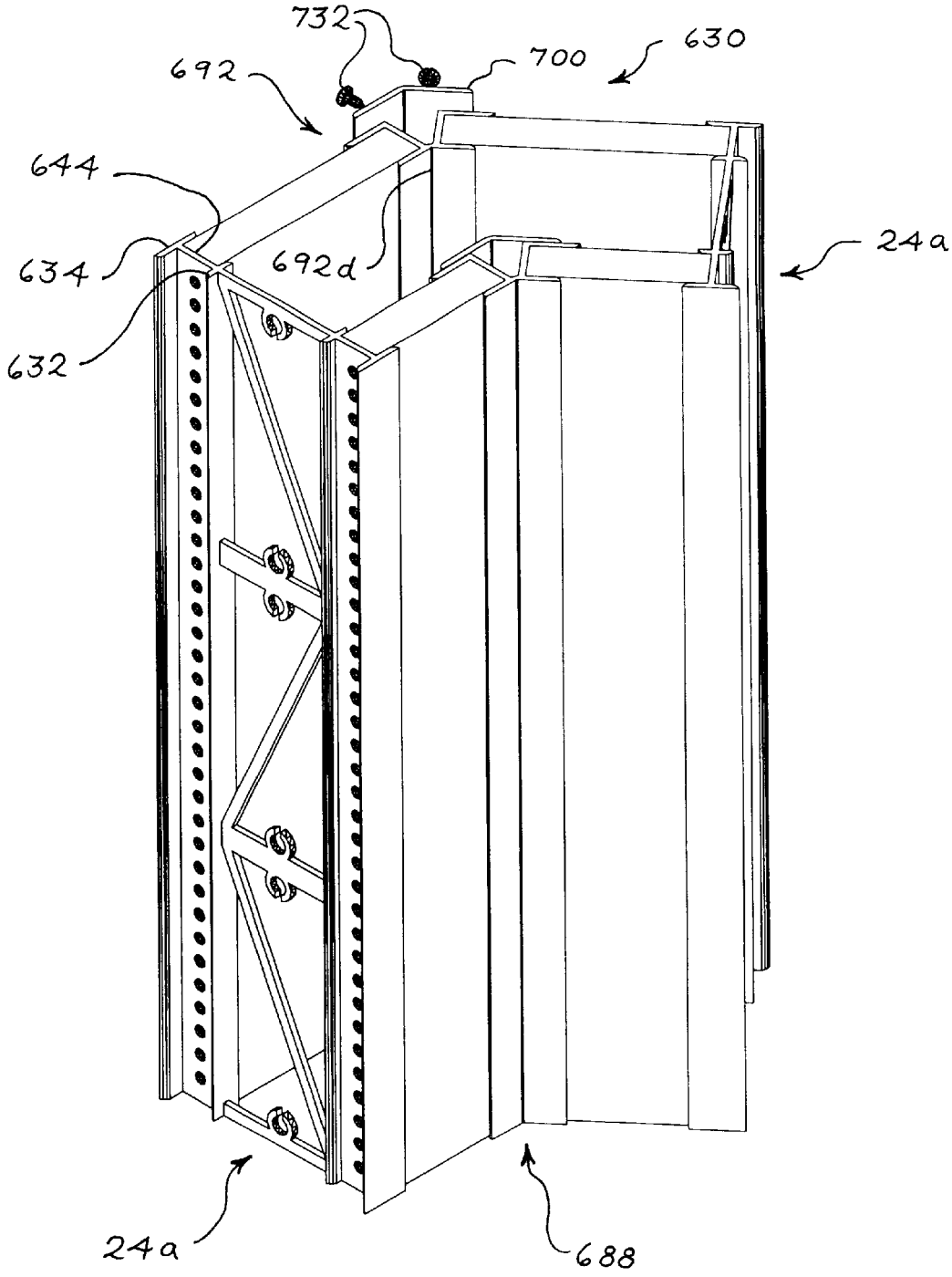
FIG. 18 is a perspective view of alternative aspect of a corner form and tie rail assembly which provides a pivotally adjustable corner assembly for use in the forming system of forming corners at a variety of angles.
Figure 19:
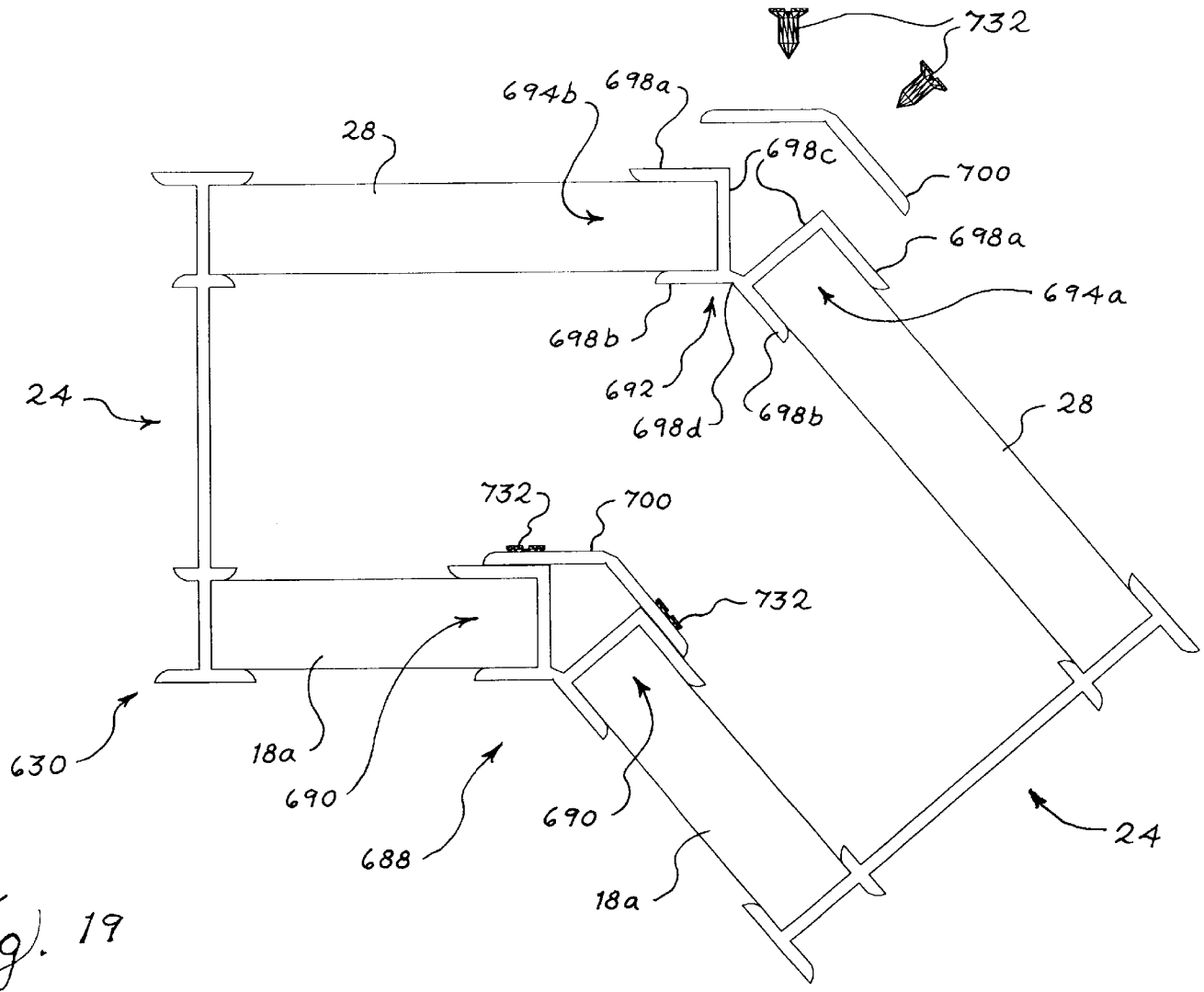
FIG. 19 is a top plan view of the partially assembled alternative corner form and tie rail assembly shown in FIG. 18.

An alternative aspect of the corner bracket assembly 630 for use in the adjustable corner assembly is shown in FIGS. 18 and 19. The assembly 630 includes the substantially similar adjustable corner brackets 688 and 692. The brackets 688 and 692 include channel walls 698*a* through 698*c*, forming channels 694*a* and 694*b* for the corner wall panels 28, and channels 690 for inner panels 18*a*. A flexible hinge section 698*d* joins and spans the distance between corner intersection of the walls 698*b* and 698*c* to forming the channels 694*a* and 694*b* (and for the inner corner, inner channels 690). The opposite corners formed by the intersection of the walls 698*a* and 698*c* are free to pivotally move from a first, adjacent position to a range of separated positions accommodating a range of angular, relative positions of the channels 694*a* and 694*b* (and corner panels 28).

As shown in FIGS. 18 and 19, the corner brackets 688 and 692 further are provided with locking plates 700 that are attached to the exterior walls 698*a* and 698*c* to fix the movable corners of brackets 688 and 692 in place at the correct angular displacement. The locking plate 700 may be fixed with attachment screws 732, pins or similar fasteners. The locking plate 700 also may be fixed in place with adhesives or other fastener approaches.

The alternative adjustable corner system 730 may be used with the above mentioned wall rails 24 as well. Alternatively, the wall tie rails 24*a* may be used with the adjustable corner system 630 and any of the other forming systems discussed herein. As shown in FIG. 18, the center wall sections 644 of the inner 632 and outer 634 retaining sections of the wall tie 24*a* are provided with openings 644*a*. The openings 644*a* provide alternative tear away properties similar in function to the weakened section 54 of the wall tie rails 24 discussed above, which provides greater strength and greater resistance to separation than the weakened section.

The corner brackets 688 and 692 may be provided with an alternative adjustable corner bracket assembly 630*a*. In this aspect, the locking plate 700 is pivotally attached or integrally formed at one end of the plate 700*a* on one of the exterior bracket walls 698*a*. The locking plate 700, in addition, includes a section 700*b* sized to engage the corresponding wall, such as 698*e*, with a free end 700*b* spanning the distance between the walls 698*a* and 698*e* of the bracket 630*c*.

As shown in FIG. 20, the free end 700*b* over laps and is fixed to the corresponding bracket wall 698*e* to hold the bracket in the proper angular displacement. The locking plate free end 700*b*, as well as the locking plate fixed section 700*a* may be attached with fasteners such as screws 732, pins, nails, adhesives or other suitable fastening systems. The locking plate 700, in addition, may include scores, recessed lines or expansion lines 700*c* on its inner and/or outer surfaces to assist in positioning the corner assembly in the proper angular alignment. The adjustable corner assembly 630*a* may be used on both the inner corner brackets 688 and outer brackets 692.

Figure 22:
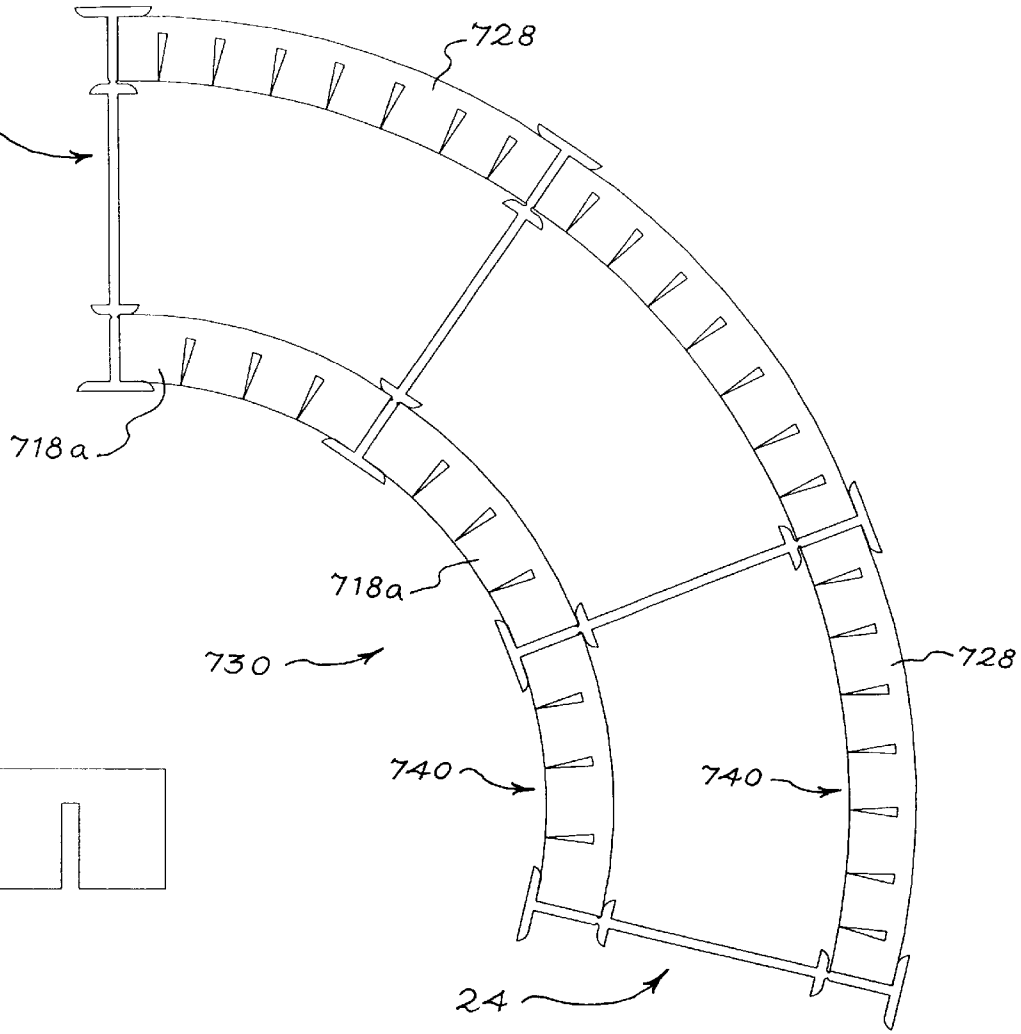
FIG. 22 is a top plan view of the alternative adjustably curving corner assembly shown in FIG. 21.
Figure 23:
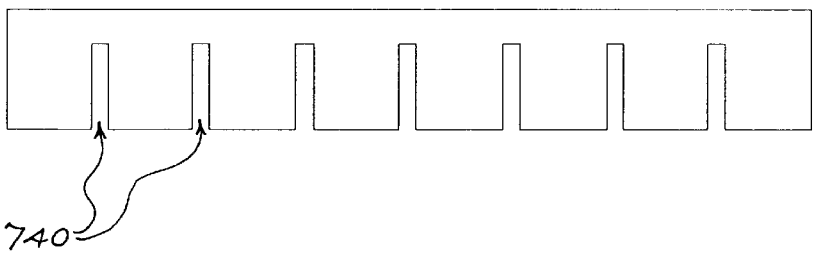
FIG. 23 is a top plan view of a panel with slots cut for use in the alternative adjustably curving corner assembly FIG. 21.

As shown in FIGS. 21 through 23, another alternative aspect of the corner rail assembly 730 for use in the forming system of the invention 10 is adjustable for a variety of radiused corners, curved corners or curved wall sections. In this aspect, a combination of modified outer corner panels 728 and inner corner panels 718*a* are combined with the wall tie rails 24 discussed above to provide a wide variety of radii or curvatures to a corner or wall section of the forming system 10.

As shown in FIG. 23, the inner corner 718*a* and outer corner 728 panels are provided with one or more shaping slots 740 formed into, cut into or milled into the side of the panels. The slots 740 extend approximately the full length of the panels 718*a* and 728. The number and size of the slots 740 are is adjustable depending on the expected maximum radius of curvature expected for the panel. The greater the radius of curvature, normally the greater number of slots and the greater the slot width. Similarly, grooves, embossments or similar methods and structures permitting the flexible bending of the panels 718*a* and 728 may be used.

As shown in FIGS. 21 and 22, the wall is assembled with the wall tie rails 20 in the same general fashion as a straight wall systems 12 discussed above. However, during the assembly procedure, the outer 718*a* and inner 728 panels are physically curved to the correct angular dimensions by arching the panels inward with respect to the slots 740 formed in the panel. The inner 778*a* and outer 728 panels typically are arched towards the side of the panels provided with the slots 740 formed in the panel surfaces so that the slots 740 fold inwardly towards themselves, and the panel shape is fixed in place with suitable adhesives in the slots 740.

Figure 24:
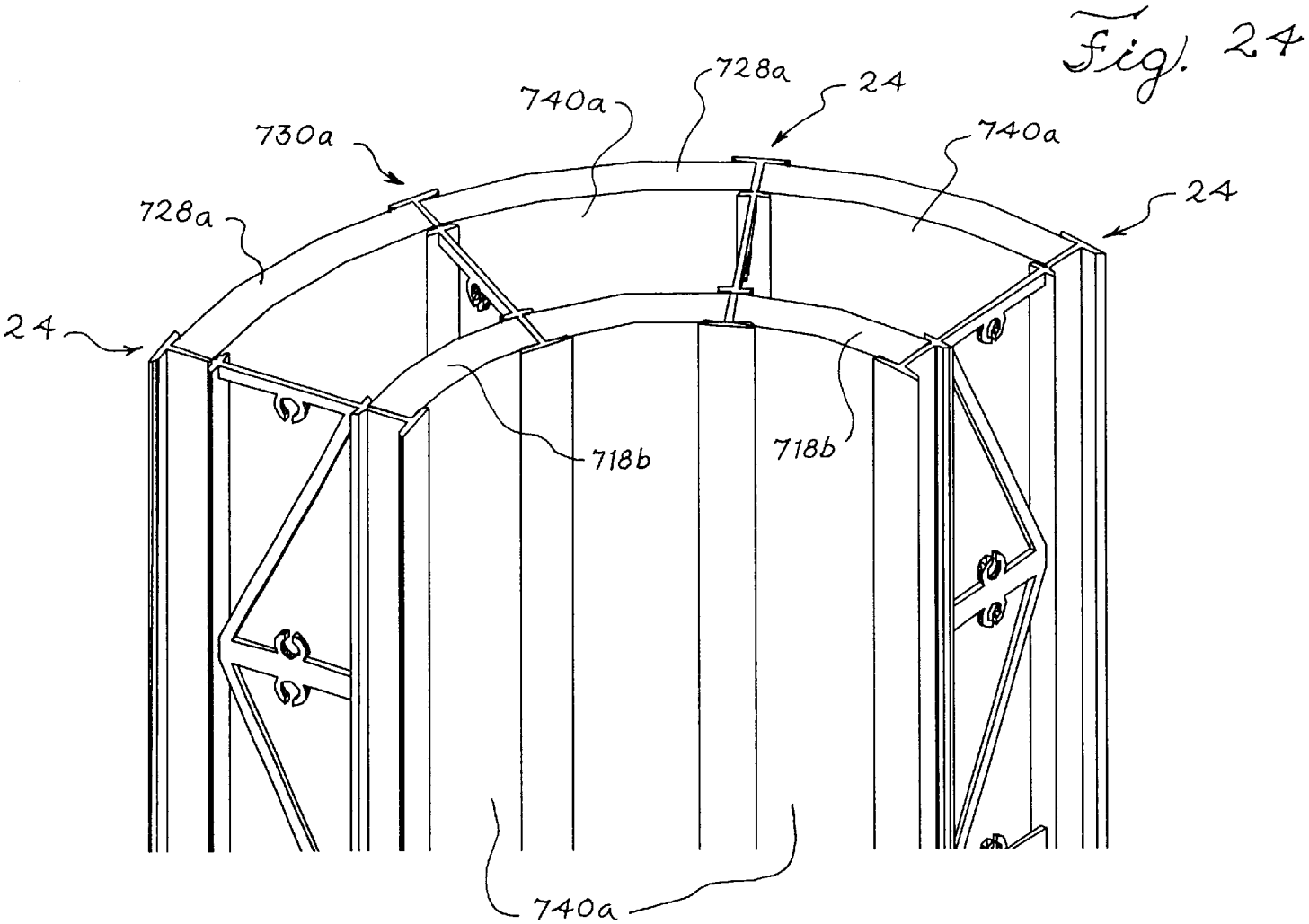
FIG. 24 is a perspective view of an alternative aspect of the alternative adjustably curving corner assembly shown in FIG. 21.

The rails 20 may be utilized to assist in maintaining the proper curvature resisting tendency (if any) of the panels to return to a planar position, and to hold the panels in the proper configuration. Thus, with the proper cutting equipment, this aspect provides a very wide range of possible curvature in a wall segment of corner assembly, and the radius of that curvature is highly variable and flexible depending on the particular construction needs. Moreover, it can be used with generic, off the shelf insulating foam panels, or custom manufactured panels provided with the slots 740, and mixed with established systems The aspect of the radiused or curved wall system shown in FIG. 24 is in many respects similar to that shown in FIGS. 21 to 23. However, rather than panels with slots in them, the aspect in FIG. 24 used pre-curved and formed inner corner 718*b* and outer corner 728*b* panels to provide a curved or radiused wall section. This system also uses the tie rails 24 to stabilize and hold the adjustable corner system in place.

As mentioned above and shown in FIGS. 1 and 25, the forming system 10 typically is installed on a footing 16 of poured concrete, other hardened materials or other suitable footing materials. Suitable drainage back fill 150 (i.e., gravel, etc.) and drain tile 152 that is well known in the art may be installed adjacent to the footing 16. In one aspect of the forming system 10 mentioned above, the system 10 is mounted between and is stabilized by the footer brackets 26. The footer brackets 26 may be fixed in place with appropriate fastening systems 154, such as screws, nails, pins, adhesives, etc.

Figure 26:
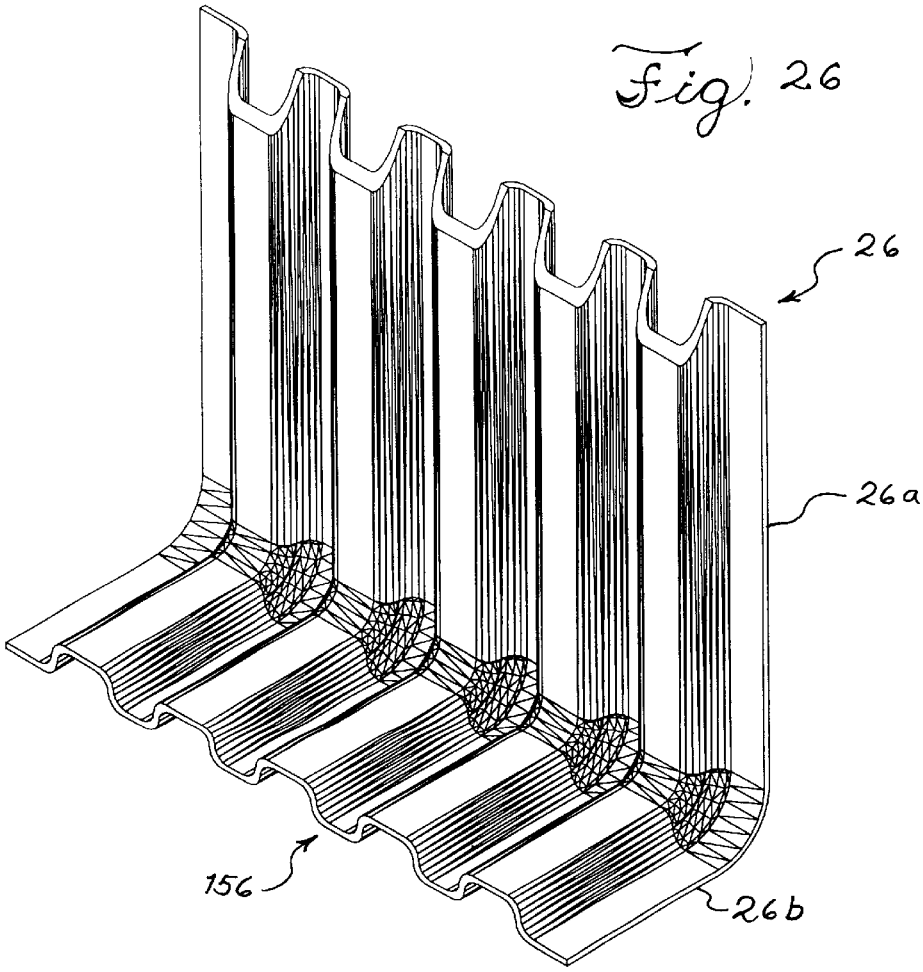
FIG. 26 is a perspective view of one of the footing brackets shown in FIG. 25.

As shown in FIGS. 1 and 25, the footer brackets 26 may be mounted along the outer wall of the system and along the inner wall of the system. As shown in FIG. 26, the footer brackets may be provided with drainage channels 156 sized and positioned to encourage the flow of water and other liquids away from the base of the formed walls and corners of the structures formed within the system 10.

In this aspect, the footer brackets 26 are generally "L" shaped, and may be corrugated to provide the drainage channels 156. The upper section 26*a* and the lower section 26*b* of the footer bracket 26 provides additional support for the lower borders of the wall panels 18 and 20, and corner panels 18*a* and 28. The footer brackets 26 also may be modified or formed to correspond with the angled, curved or radiused wall, and corner sections such as those discussed above and shown in FIGS. 1 through 24. In that aspect, the modified footer brackets 24 also will reinforce and support the lower boundaries of the wall and corner panels discussed above.

Figure 28:
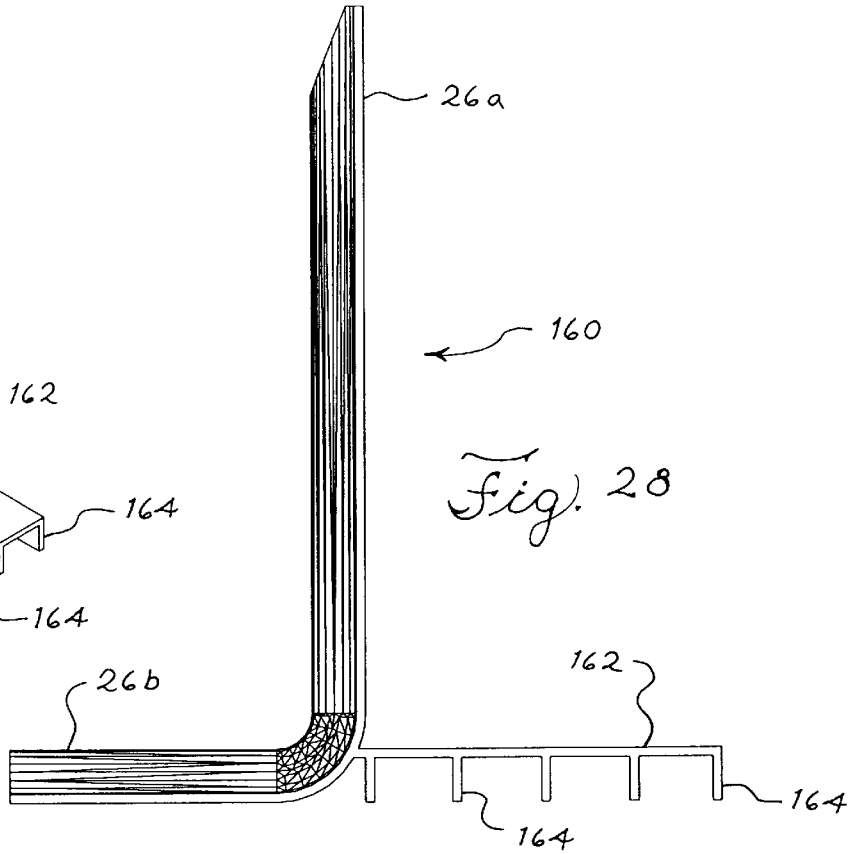
FIG. 28 is a side elevation view of the alternative footing bracket and base plate shown in FIG. 27.
Figure 27:
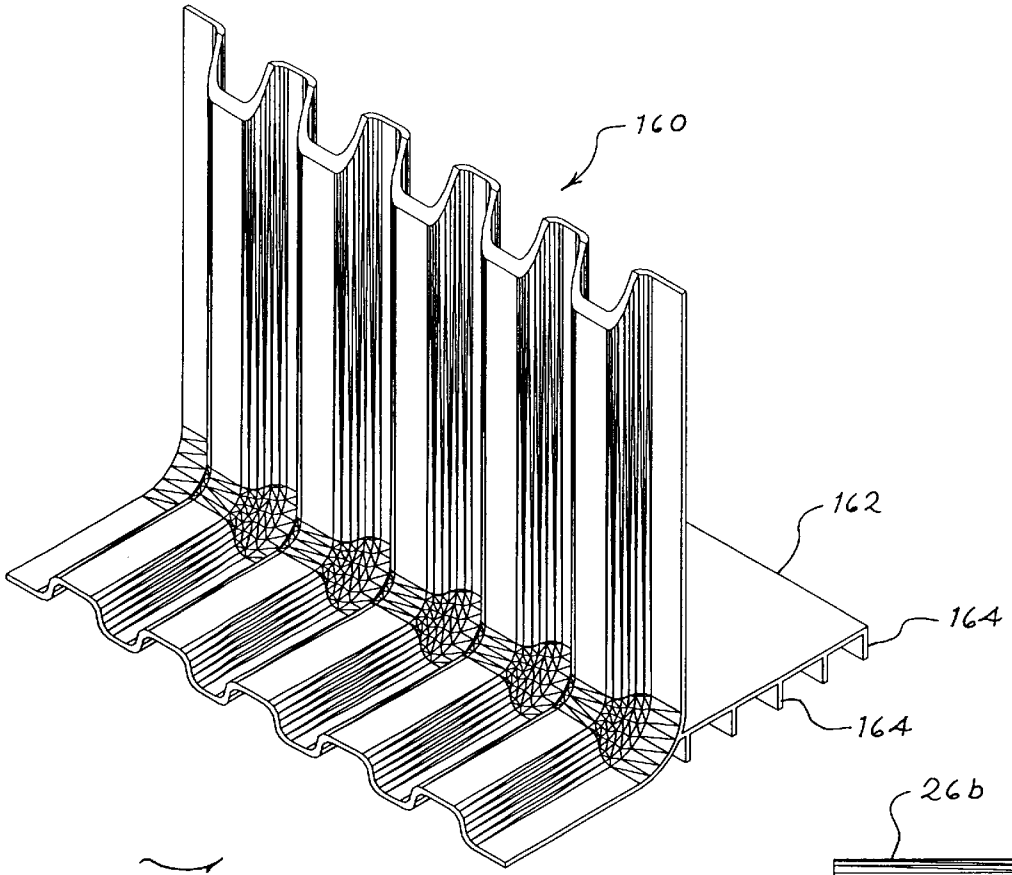
FIG. 27 is a perspective view of an alternative aspect of the footing bracket shown in FIG. 25 provided with a base plate with subtending flanges.

As shown in FIGS. 27 and 28, another aspect of the footer bracket 160 includes a base section 162, with depending flanges 164, as well as an upper section 126*a* and lower 126*b* of forming a "L"-shaped bracket. This aspect 160 provides a substantially planar and level base 162 for mounting the wall panels 18 and 20 and corner panels 18*a* and 20 between the footer brackets 160, and thus reduces the need for significant leveling or adjustments of the panels during installation of the forming system. The modified footer brackets 160 typically is set on the cured footing 16 with the flanges 164 extending to the footing surface, and shimmed in place to level the bracket 160. In other applications, the modified brackets 160 may be inserted into the partially cured upper surfaces of pre-formed footings 16 and leveled.

As also shown in FIG. 25, the use of the footer brackets 26 and 160 of this aspect of the system 10 may provide an additional important benefit. The upper section 26*a* and 126*a* of the brackets 26 and 160 mounted along the inner wall of the system may be sized to provide an outer wall form for a slab, floor, or other structure of concrete or other hardenable materials 170 that may be poured adjacent to the brackets 26 and 160. This permits the installation of such a slab, floor or other structure 170 before the assembly and installation of the forming system 10, if desired.

While not shown, the footer brackets 26 and 160 along the exterior wall may also serve as a form for walkways, floors or similar structures provided along the exterior of the forming system 10. The additional stability and working platform provided by such a slab, floor or other structure 170 adjacent the footing, in many instances, may increase the efficient assembly of the system 10, by providing a more efficient work space during assembly of the system 10. The slab or floor 170 also may provide additional support and reinforcement for the lower borders of the inner forming panels such as panels 18 and 18*a* discussed above.

The system 10, in addition, may be used without the footer bracket 26, or with substitute systems for supporting and/or reinforcing the lower boundaries of the wall and corner forms. For example, wood or metal strips or planks may be mounted to or in connection with the lower borders of the wall 18 and 20 and corner panels 18*a* and 20. Similarly, the panels may be mounted in individual channels known in the art and adapted for use with the system 10.

Figure 29:
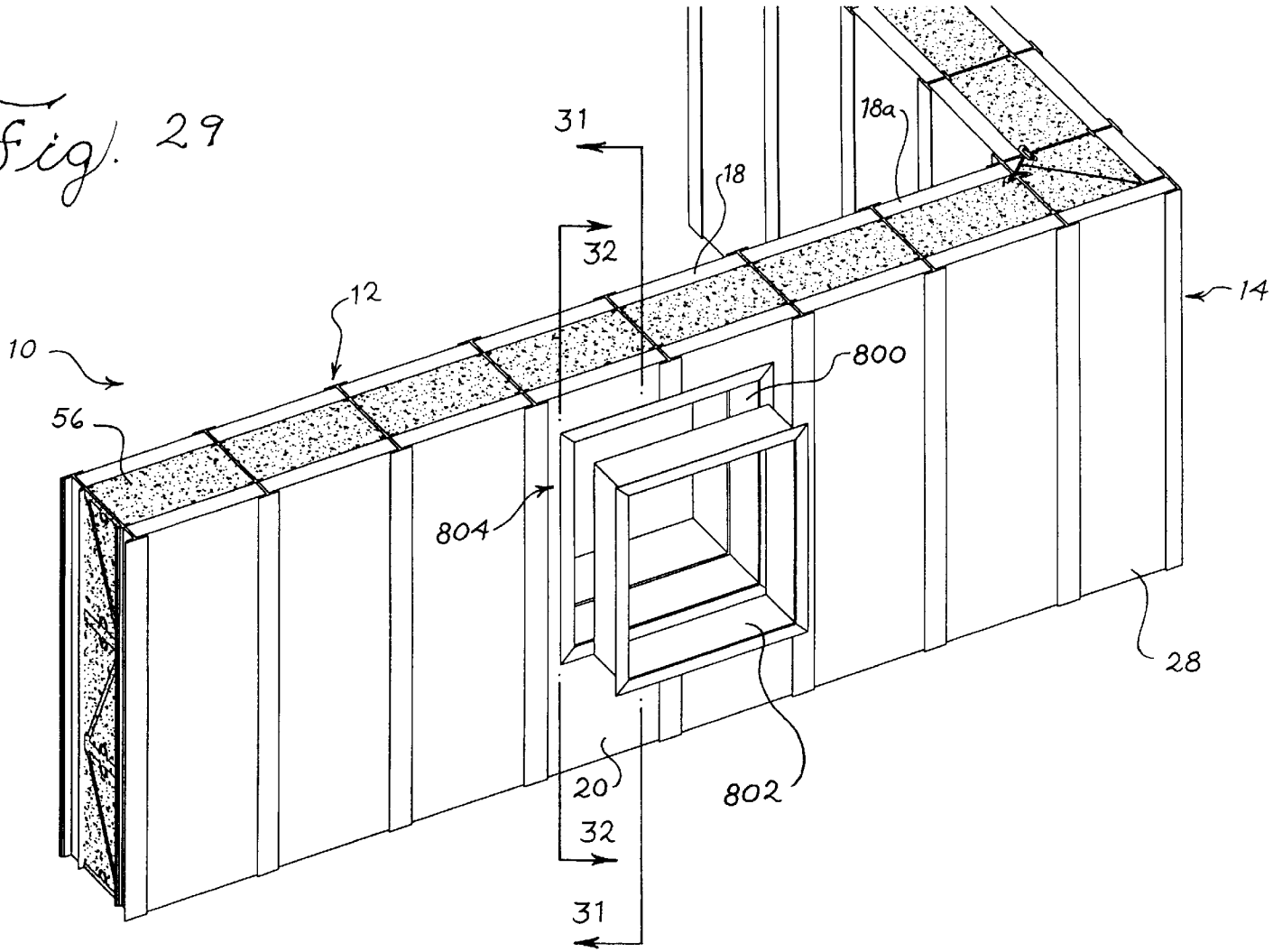
FIG. 29 is a perspective view of the system shown in FIG. 1 with a preformed window buck and window system as described herein.

As shown in FIGS. 29 to 32, the forming system 10 in another aspect may be adapted to provide preformed window frames or "bucks" 800 for windows 810 mounted in the wall 12 and/or corner sections. In this aspect, an opening 804 sized to accept the window or door buck 800 is cut or formed in one or more opposing sets of wall panels 18 and 20 and/or 18*a* and 28. As shown in FIG. 29, the window buck is inserted into the openings 804 before the forms are filled with concrete or other such materials. When the concrete 56 is poured and hardened in the system 10, the window buck 800 is embedded in the system 10, to seal the concrete out of the window opening 804, and to provide a framework for insertion and attachment of the window 802 in the formed structure. The buck 800 also may provide an interior window or door frame as well.

Figures 30, 31, 32:
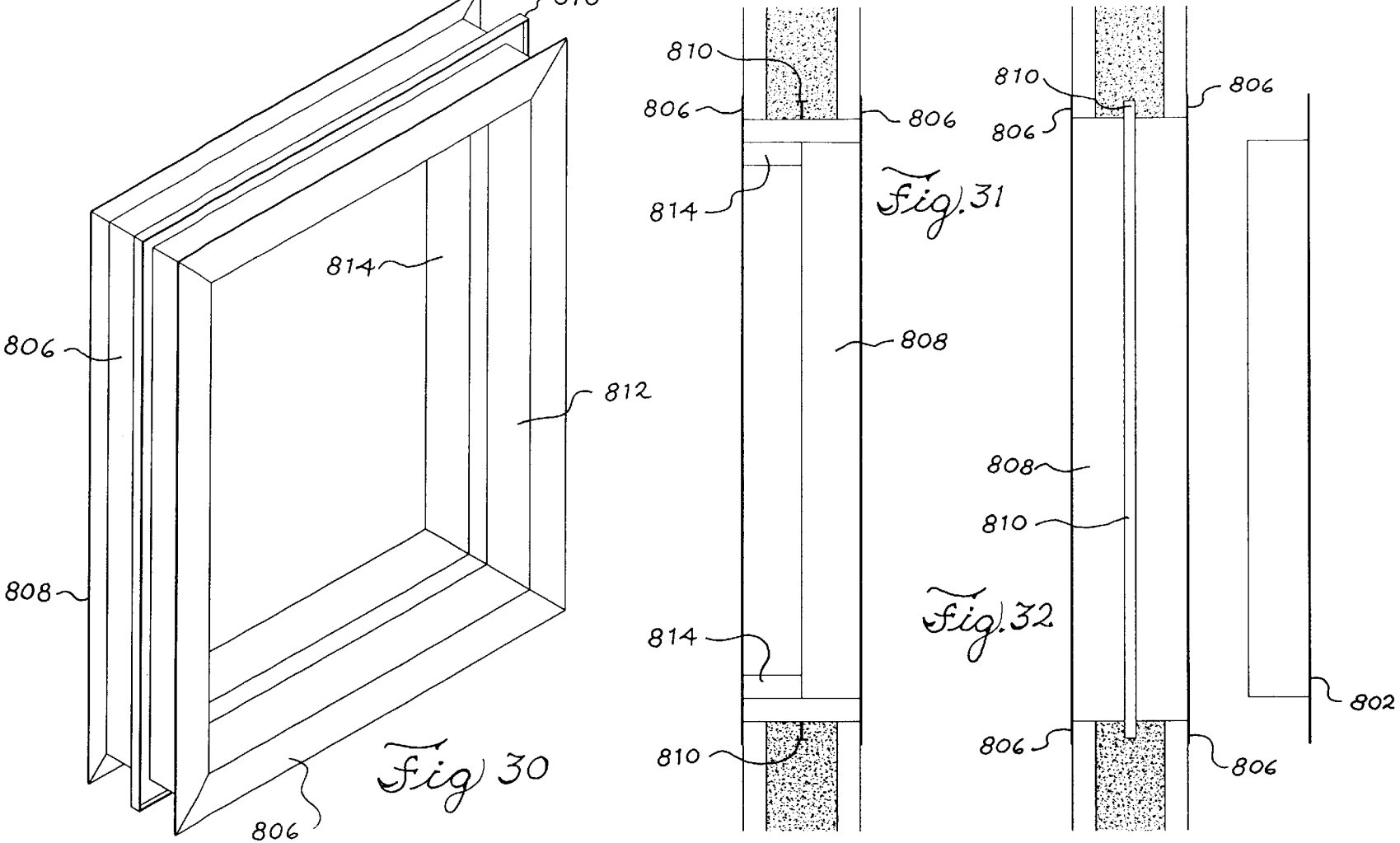
FIG. 30 is a perspective view of the preformed window buck for use in the forming system of the invention and shown in FIG. 29.
FIG. 31 is a cross-sectional view through line 31—31 of FIG. 29 of a formed wall system made using the forming system of the invention and showing a side elevation view of the window buck shown installed in the wall system shown in FIG. 29.
FIG. 32 is a vertical cross-sectional view through lines 30—30 of the formed wall system shown in FIG. 29 made using the forming system of the invention showing a side elevation view of the window buck shown in FIG. 30 installed in the wall system shown in FIG. 29.

The window buck 800 includes interior and exterior facing flanges 806 and a main body 808 disposed between the flanges. A raised flange 810 extends from the outer surfaces of the main body 808. The inner surfaces 812 of the main body 808 define an opening sized to receive a window or door assembly 802, such as that shown in FIGS. 29 and 32. As shown in FIG. 31, the inner surfaces 812 may also include a raised portion 814 providing a backing wall for a window or door assembly 802 installed in the buck 800.

As shown in FIGS. 31 and 32, the window buck 800 is inserted into the above mentioned pre-formed openings so that the flanges 806 are disposed against, typically flush against, the outer surfaces of the opposing panels 18 and 20 and/or 18*a* and 28. The main body 808 of the buck is disposed between the forming panels 18 and 20 and/or 18*a* and 28. The raised flange 810 is dimensioned and positioned to become embedded in the concrete or other hardenable materials poured between the forms to fix the buck 800 in place. After the wall structure is formed, the window assembly 802 is installed in the buck 800 with suitable fastening systems such as screws, nails, adhesives, etc.

The window buck main body 800 is preferably pre-formed and dimensioned to accept standard window assemblies to avoid the need for substantial on-site fabrication of the buck or substantial modification of the buck and window. In one aspect, the window buck 800 is pre-formed and matched with a specific window or door assembly 802 in advance of the installation of the forming system 10, and may be prematched at the window or door fabricator.

This will provide further cost and time efficiencies over current construction techniques for ICF systems where considerable fabrication, adjustment and modifications may be required to install window and door assemblies. The widow buck 800 also may be made of a variety of materials selected to provide sufficient strength to prevent substantial deformation of the buck during the pouring and curing of concrete or other hardenable materials in the forming system 10. In another aspect, a properly protected and reinforced window or door assembly 802 may be inserted in the system with or as part of the buck 800 before the system is filled with concrete for further efficiencies.

As shown in FIGS. 33 through 36, the forming system 10 of the invention also may be adapted for use in forming multi-story structures. In this application, it is typically desirable to form a first wall or story as discussed above using the forming system 10 and the aspects and variations discussed above which are suitable for the specific structure under construction. After the concrete 56 or other hardenable materials are sufficiently cured in the system to provide the wall 12 and corner 14 sections, a second forming system 10*a* is attached to the top of the first wall and corner structure. At this time, suitable beams, support structures or sockets or emplacements for floor structures may be inserted into the second forming 10 system 10*a* or between the first 10 and second 10*a* systems to provide for the construction of a floor system for the second level or story.

Additional concrete or other hardenable materials then are poured into the second system to provide a second level or story on top of the first wall and corner system. Additional stories or levels can be formed in the same manner to provide a structure of the desired height and number of levels.

Figure 33:
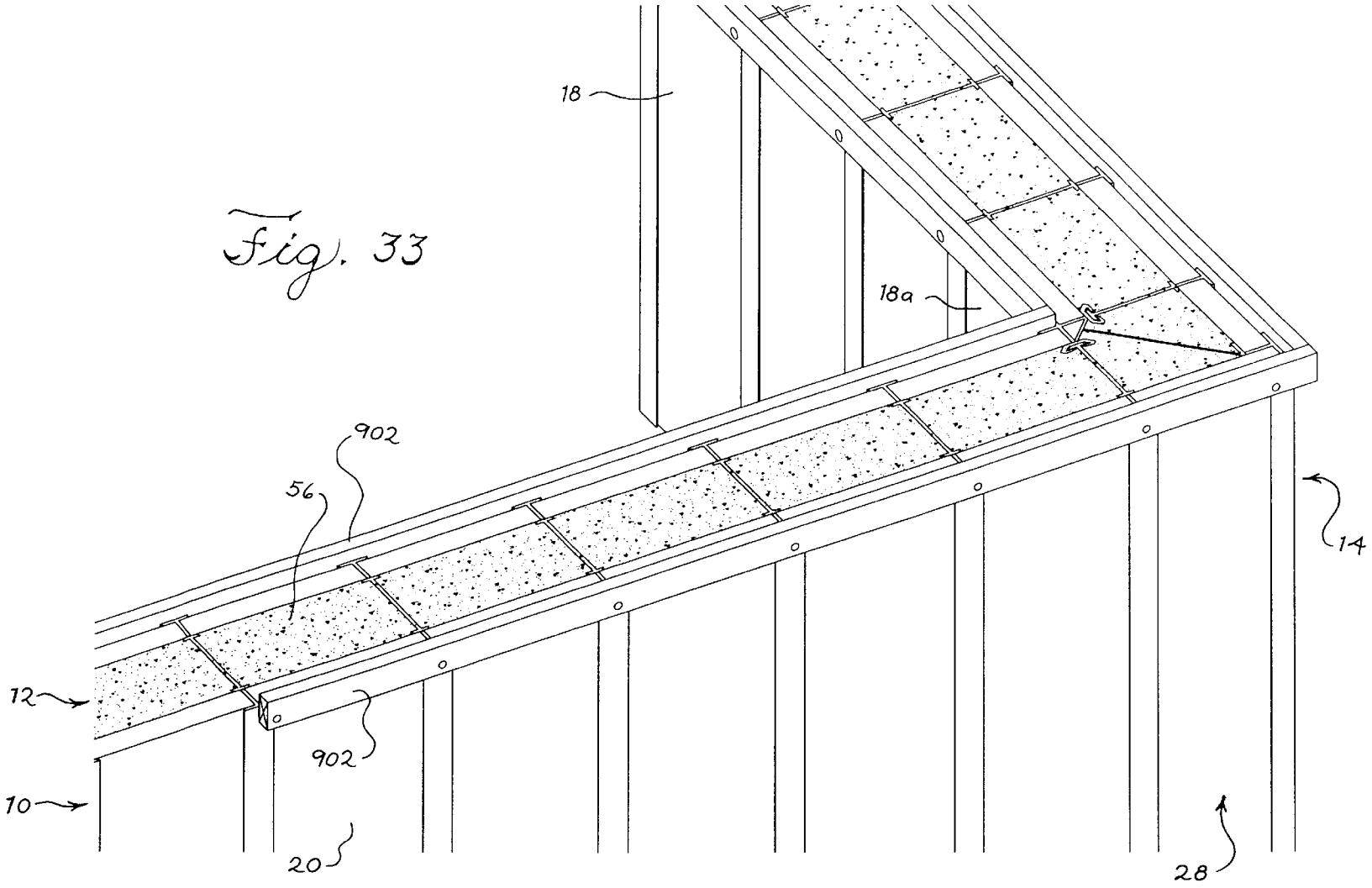
FIG. 33 is a perspective view of one aspect of the forming system shown in FIG. 1 filled with concrete as a base level and supplied with mounting plates for the addition of a second forming system to construct a second story or level on the base level.
Figure 34:
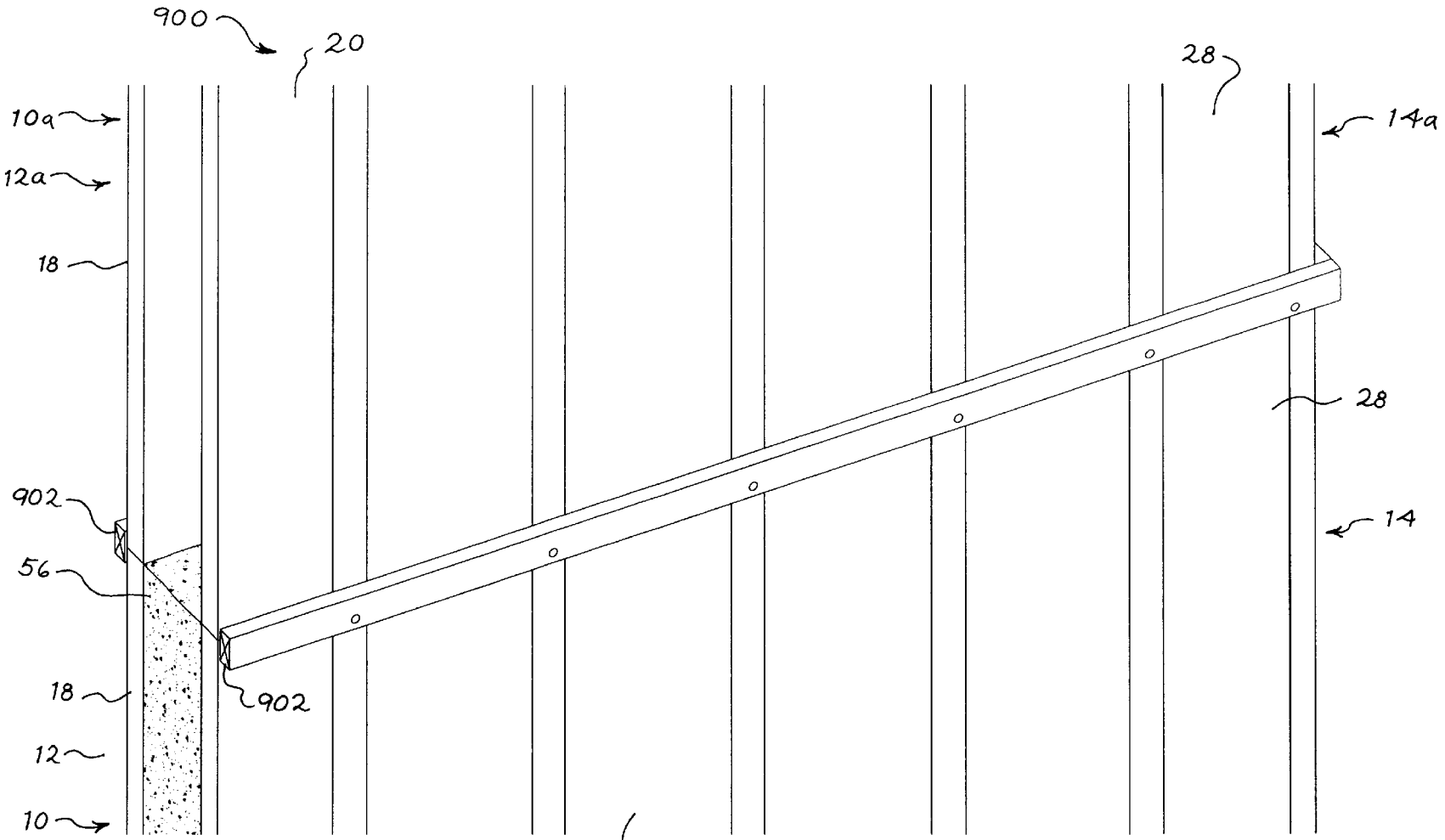
FIG. 34 is a perspective view of the aspect of the system shown in FIG. 33 with the second forming system in place to form a second story or level on the first, base level.

As shown in FIGS. 33 and 34, a multi-story or multi-level forming system 900 may be constructed by altering the mounting plates 902 to the upper borders of the wall panels 18 and 20 and corner panels 18*a* and 28 of a previously formed and poured wall concrete structure that preferably (although not necessarily) is made using one or more of the aspects of the forming system 10 discussed above. The mounting plates 902 may be wood, metal or, in some instances, polymeric, strips, planks, or braces. They may be fixed to the panels 18, 20, 18*a* and 28 with conventional fastening systems, i.e., screws, nails, adhesives, etc.

The mounting plates 902 serve a similar function as the footer brackets 26 discussed above for the forming system 10*a* installed on and above the previously formed and poured structure. Thus, as shown in FIG. 34, once the mounting plates 902 are in place, a forming system such as one or more of the aspects of the system 10*a* above, including the wall system 12 and corner assemblies 14 discussed above (and/or variations on them) is installed between the mounting plates 902 on the previously installed wall systems 12 and corner assemblies 14. As part of this installation step, the lower edges or borders of wall panels 18 and 20 and corner panels 18*a* and 28 of the second system 10*a* also may be fixed to the mounting plates 902 with suitable fastening systems. Once the second forming system 10*a* is installed, concrete or other hardenable materials may be poured between the second set of forms to provide a second level or story to the structure.

The mounting plates 902 are of a sufficient width to substantially overlap the upper borders of the wall system 12 and corner assembly 14 of the base forming system 10 and the lower border of the wall system 12*a* and corner assemblies of 14*a* of the upper, or second level forming system 10*a*. The upper portions of the wall system 12 and corner assembly 14 also may be trimmed back to the level of the concrete 56 within the forms to provide a more secure mounting for plates 902 to the base system 10.

The width, thickness and length of mounting plates 902, in combination, are sufficient to assist in restraining the displacement of the lower borders of the wall systems 12*a* and corner assemblies 14*a* for their proper portion above the base system 10. The mounting plates 902 further act to limit, if not prevent, the leakage of concrete from the bottom borders of the forming system 10 during the pouring working and curing stages of that system. For example, in one aspect, the plates are made of wood, with a width of 1.75 inches and a thickness of 3.5 inches.

Figure 35:
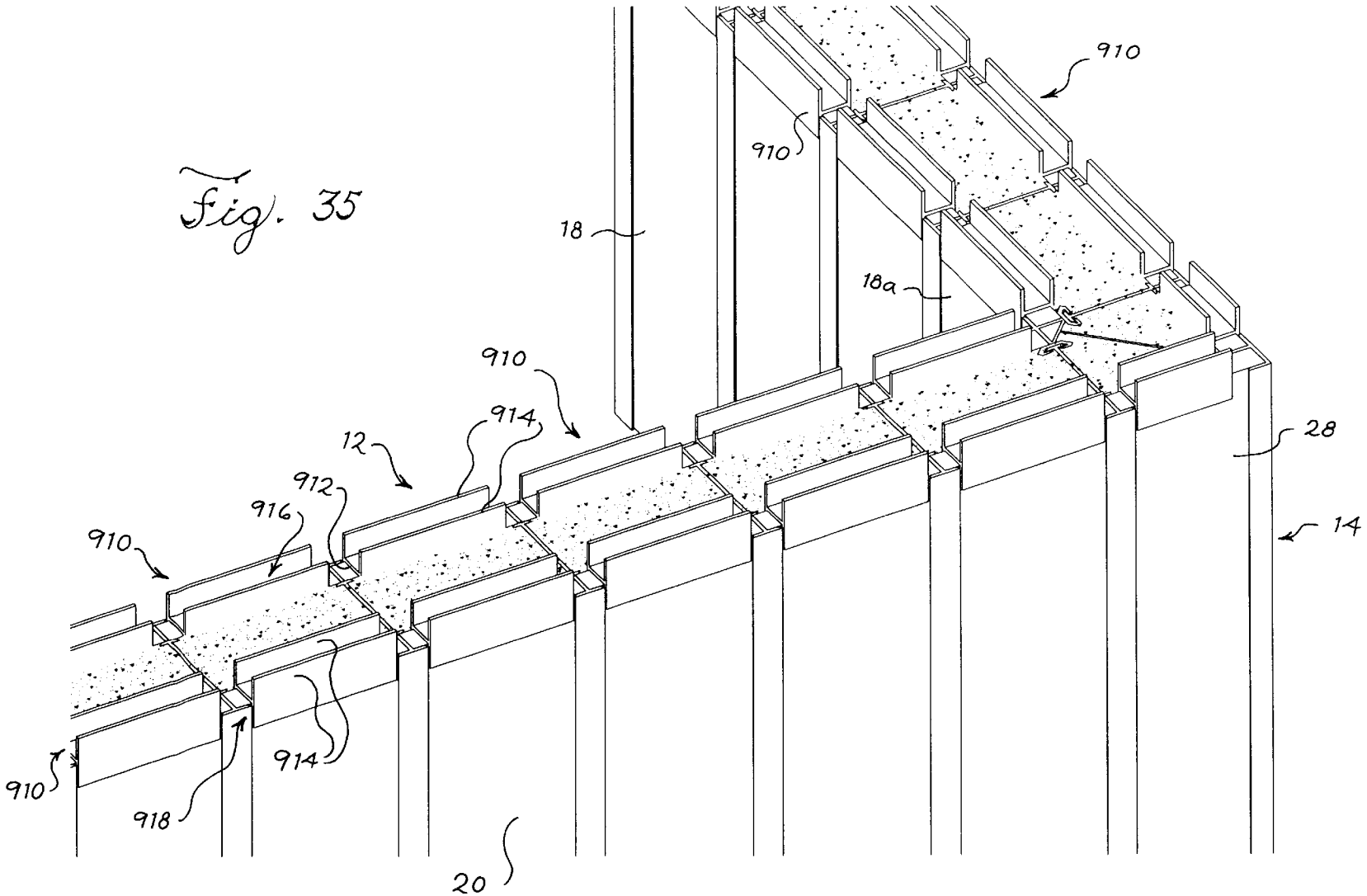
FIG. 35 is a perspective view of another aspect of the forming system of the invention shown in FIG. 1 filled with concrete as a base level and supplied with mounting brackets for the addition of a second forming system to construct a second level or story on the base level.
Figure 36:
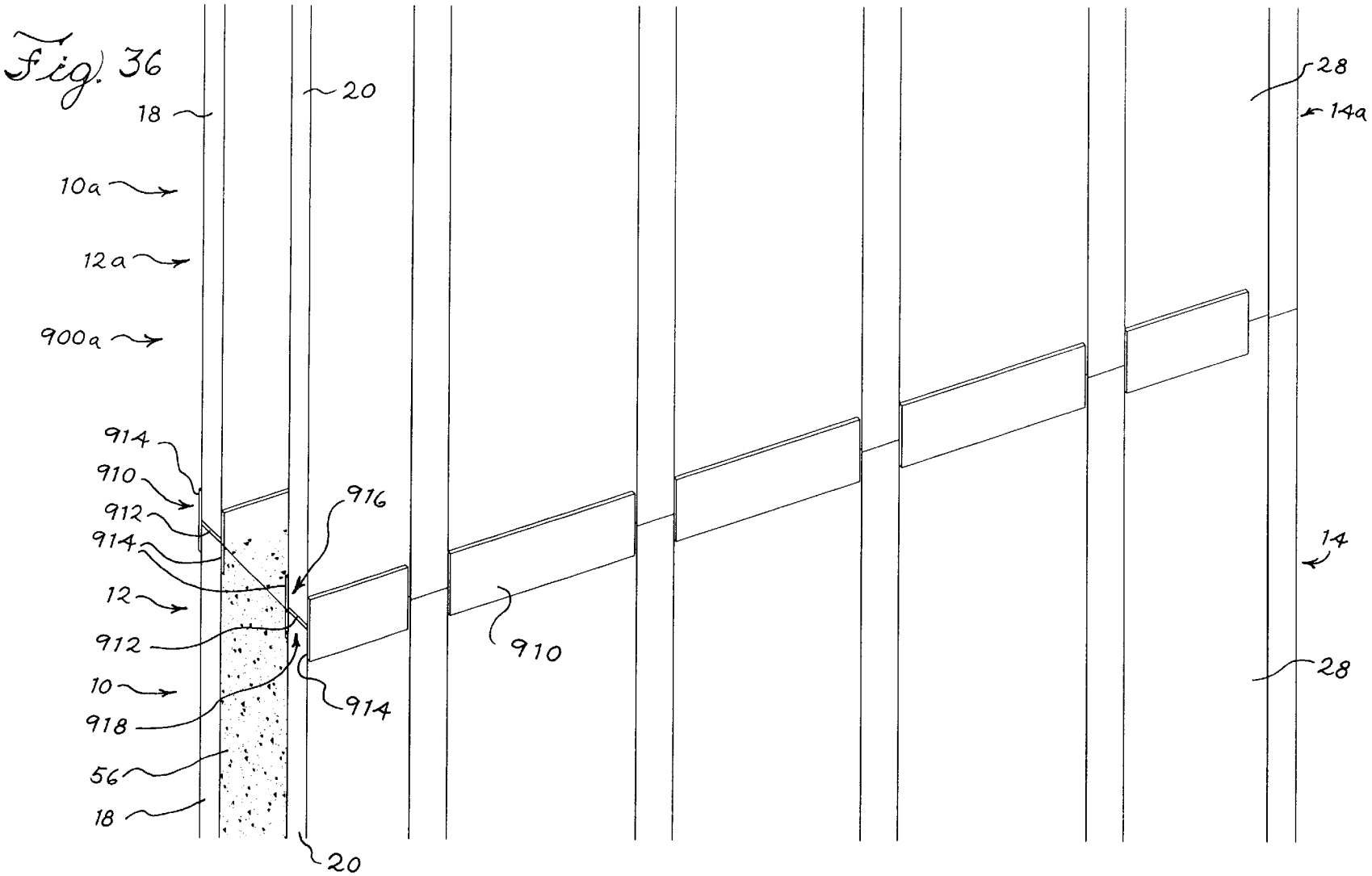
FIG. 36 is a perspective view of the aspect of the system shown in FIG. 35 with the second forming system in place to form a second story or level on the first base level.

Another aspect of a multi-level forming system 900*a* is shown in FIGS. 35 and 36. In this aspect, mounting brackets 910 are attached to the upper borders of the wall panels 18 and 20, and corner panels 18*a* and 28 of a previously formed and poured wall concrete structure 10 that was made using one or more of the aspects of the previously discussed system. The mounting brackets 910, in this aspect, are generally "H" shaped with a center wall 912 and two opposing, spaced side walls 914, forming an upper channel 916 and lower channel 918.

The upper channels 916 are sized to accept and engage the lower borders or edges of the wall panels 18 and 20 and corner panels 18*a* and 28 of the upper forming system 10*a*. The lower channels similarly are sized to accept and engage the upper border of the wall panels 18 and 20 and corner panels 18*a* and 20 of the base system 10. In this aspect, the channel walls 914 engage the panels of the respective upper 10*a* and base 10 systems. The panels also may be fixed within the channels 916 and 918 with fasteners, adhesives or other fastening systems.

The center walls 912 and side walls of the mounting brackets 910 are sized to provide a stable base for the assembly of the second forming system 10*a* above the first wall structure as shown in FIG. 36. In this aspect, the bracket side walls 914 extend a sufficient distance from the bracket center walls 912 to substantially overlap the panels of the base system 10 and the panels of the second system 10*a*. The width of the bracket side walls 914 will depend on the specific application and may be adjusted depending on any of the needs of a particular system and forming environment, including the expected stresses on the forming and lower borders of the second forming system 10*a*.

In the aspect shown in FIGS. 35 and 36, the brackets generally extend from the tie rails 24 at one edge of the forming panels to the tie rails at the edge of the other side of the panels. The brackets 910 may be made of plastic, other polymeric materials, metals or, in some instances, wood or composite materials. For example, in one aspect the bracket 910 is made of and has a wall thickness of about 0.125 inches and a flange width of about one inch in each direction for a total of two inches.

As shown in FIGS. 35 and 36, the mounting brackets 910 are placed on the upper border or edges of the wall panels 18 and 20 and corner panels 18*a* and 28 of the base system 10 typically before the forming cavity is completely filled with concrete or other hardenable materials. This provides the brackets 910 with additional stability as at least a portion of the side walls 914 forming the bracket lower channels 918 may be embedded in the concrete or other hardenable materials. The brackets 910 also may be placed on the panel borders after the construction of the first level or story and may be held in place by the frictional engagement between the panels and the lower channel 910, or may be fixed to the panels with conventional fastening systems, i.e., screws, nails, adhesives, etc.

As shown in FIG. 36, the mounting brackets 912 also serve a similar function as the footing brackets 26 for the forming system 10. Once the mounting brackets 910 are in place, a forming system 10*a*, such as one or more of the aspects of the system discussed above is installed by inserting the wall panels 18 and 20 in the upper channels 916 of the mounting brackets 910, above the previously installed wall system 12 and corner assembly 14 of the base system 10. Once the second forming system 10*a* is installed, concrete or other hardenable materials may be poured between the second set of forms 10*a* to provide the second level or story to the structure.

While the invention has been described by reference to certain specific descriptive examples which illustrate preferred materials and conditions, it is understood that the invention is not limited thereto. Rather all alternatives, modifications and equivalents within the scope of the invention so described are considered to be within the scope of the appended claims.

What is claimed is:

1. A system for forming structures of concrete or other pourable, hardenable materials comprising:

two or more adjacent pairs of vertical forming panels, each pair of panels spaced apart and defining a forming cavity to receive concrete or other hardenable materials and one panel defining an inner wall and the other panel defining an outer wall;

at least one tie rail between each adjacent pair of forming panels, the tie rail engaging edges of the panels, substantially fixing each panel in a predetermined position relative to the other panels, the tie rail having a first retaining section holding the edges of the inner wall forming panels and a second retaining section holding the edges of the outer wall forming panels, and at least one web extending between the first and second retaining sections, the web having one or more retainers sized and positioned to hold reinforcing members in a predetermined position and orientation between the outer wall and the inner wall;

the tie rail retaining sections extending generally along a substantial length of the vertical edges of the panels, and at least one portion of the retaining sections extending over the surface of the panel edges a distance sufficient to inhibit displacement of the panel edges from the retaining sections when the panels are subject to pressure outwardly exerted by concrete or other hardenable materials within the forming cavity.

2. The system of claim 1 wherein the tie rail retaining sections comprise channels positioned to receive the panel side edges therein, the channels defined by a rear wall and at least one engagement wall segment extending over, and holding the outer surface of the panel edges effective to inhibit displacement of the edges from the channel when pressure is exerted against the panel; and the tie rail retaining sections extending generally continuously along a substantial length of the vertical edges of the panels.

3. The system of claim 2 wherein at least one tie rail retaining section provides an attachment surface spaced from an exterior wall surface of the forming panels.

4. The system of claim 3 wherein the attachment surface is effective to retain siding or other wall materials fixed to the surface and cooperates with the panel surfaces to provide a drainage plane behind such siding or other wall materials.

5. The system of claim 3 wherein and the vertical height of the panels is generally greater than their width, the tie rail retaining sections extend at least generally the height of the vertical height of the panels, and the tie rail retaining section provides a generally continuous attachment surface along the vertical height of the tie rail.

6. The system of claim 2 wherein the rear wall of the engagement channels are provided with a weakened zone extending generally the length of the engagement channel, the weakened zone effective to permit the removal of at least a portion of the engagement channel from the system along the weakened zone.

7. The forming system of claim 1 wherein the tie rails are provided with at least one horizontal web extending between the tie rail retaining sections and at least one web extending between the tie rail retaining sections at an acute angle, the webs spaced apart to provide openings effective for the flow of concrete or other hardenable materials therethrough.

8. The forming system of claim 7 wherein the horizontal webs are provided with the retainers sized and positioned to hold reinforcing members in a predetermined position and orientation between the outer wall and the inner wall.

9. The system of claim 1 wherein the panels are left in place after the system is filled with concrete or another hardenable material.

10. The system of claim 1 wherein the panels comprise polymeric, low density foam and have a vertical height generally greater than their width.

11. The system of claim 1 wherein the panels have a vertical height of from 8 feet to 10 feet and have a width of about 10 inches to about 24 inches.

12. The system of claim 11 wherein the panels comprise polymeric foam and have a thickness of about 1 inch and an R value of about 10 to a thickness of about 3 inches and an R value of about 21.

13. The system of claim 2 wherein the channel wall segments of the retaining sections of the wall tie rails are spaced from about 1 inch apart to about 3 inches apart.

14. The system of claim 13 wherein the wall segments of the wall tie rails extend over the panels from about 0.5 inches to about 2 inches.

15. The forming system of claim 1 wherein the bottom edges of the wall panels are engaged and supported by a footing, and are disposed between a first L-shaped footing bracket and a second L-shaped footing bracket spaced from the first form a distance sufficient to receive concrete or another hardenable material between the forms.

16. The forming systems of claim 15 wherein at least one of L-shaped brackets is mountable on the footing to provide a side form for concrete or other hardenable materials poured adjacent to the footing.

17. The system of claim 16 wherein the concrete or other hardenable materials are poured before the panels are mounted on the footing between the brackets.

18. The forming system of claim 1 wherein a base plate extends from the L-shaped footing brackets engaging and supporting the bottom edges of the wall panels, the base plate extending perpendicularly from the up right portion of the L-shaped brackets, parallel to the horizontal portion of the brackets.

19. The system of claim 1 wherein a second forming system is disposed above a first base system, the top panel edges of the first system adjacent to bottom panel edges of the second system with mounting plates spanning the top panel edges of the first system and the bottom panel edges of the second system, the mounting plates effective to maintain the relative panel positions of the two systems and to resist the displacement of the panels of the systems when force is exerted on them by concrete or other hardenable materials poured into the second system.

20. The system of claim 19 wherein the mounting plates comprise H-shaped members having a lower channel engaging the top panel edges of the system and upper channels engaging the bottom panel edges of the second system.

21. A system for forming structures of concrete or other pourable, hardenable materials comprising:

at least two pairs of forming panels meeting at an angle to define an inner wall corner and an outer wall corner and a forming cavity therebetween;

an inner corner bracket at the angular intersection defining the inner wall corner, and outer corner bracket at the angular intersection defining the outer wall corner, and at least one web extending from the inner corner bracket to the outer corner bracket; the inner corner bracket holding edges of the intersecting inner wall panels, the outer corner bracket holding side edges of the intersecting outer wall panels, the corner brackets extending generally a substantial length of the vertical edges of the panels;

at least one portion of the brackets extending over the panel edges a distance sufficient to inhibit the displacement of the panel edges from the corner brackets when the panels are subject to pressure outwardly exerted from the forming cavity; and at least a first stabilizing tie rail and at least a second stabilizing tie rail angularly displaced from the first stabilizing tie rail; each tie rail with a retaining section, an attachment end fixed to the inner corner bracket, and at least one web therebetween;

the retaining section of the first stabilizing tie rail holding one of the outer corner panels and an adjacent forming panel of the outer wall and the retaining section of the second stabilizing tie rail holding the other outer corner wall panel and another adjacent panel of the outer wall section, the stabilizing tie rails displaced at an angle effective to redistribute loads imposed on the panels and corner brackets by the pressures exerted from the forming cavity; and at least a portion of the retaining sections of the stabilizing tie rails extending over the panel edges a distance effective to inhibit the displacement of the panel edges from the retaining sections.

22. The system of claim 21 wherein the inner and outer corner brackets include at least two channels defined by a rear wall and outwardly extending side walls, the channel openings disposed at substantially the same angle as the intersecting panels;

at least one side wall engaging the surface of the panel edges, and extending a distance over the panel edges effective to inhibiting displacement of the panel edges from the channels during assembly of the system and when pressure is exerted against the panel outwardly from the forming cavity; and the channels extend generally continuously along a substantial length of the vertical edges of the panels.

23. The forming system of claim 22 wherein at least one horizontal web extends between the retaining sections of the stabilizing rails and the inner corner brackets, and at least one horizontal web extends between the corner brackets.

24. The forming system of claimed 23 wherein the horizontal rails are provided with retainers sized and positioned to hold reinforcing bars in a predetermined position and orientation between the outer side wall and the inner side wall.

25. The forming system of claim 24 wherein the attachment end of the stabilizing tie rails is reversibly detachable from the inner corner bracket.

26. The forming system of claim 25 wherein the attachment end of the stabilizing tie rails comprise a generally T-shaped flange, and the surface of the inner corner bracket is provided with slots disposed and sized to engage the T-shaped flanges of the stabilizing tie rail attachment ends to retain the flanges within the slots.

27. The forming system of claim 26 wherein the flanges of stabilizing tie rail retaining sections comprise a first straight segment and a second segment extending from the first segment at an acute angle and the slots of the inner corner bracket are provided with walls corresponding to and encompassing the flange segments to retain the flanges in the slots.

28. The system of claim 27 wherein at least one corner bracket provides an attachment surface spaced outwardly from the panel surface effective to retain siding or other wall materials fixed thereto and to cooperate with the panel surfaces to provide a drainage plane behind such siding or other wall materials.

29. The system of claim 22 wherein a portion of the retaining section of the stabilizing tie rails are removable from the system along a weakened portion of the tie rails.

30. The system of claim 22 wherein the panels comprise low density, expanded foam or reinforced low density expanded foam and have a vertical height greater than their width.

31. The system of claim 30 wherein the panels have a vertical height of from eight feet to 10 feet and have a width of about 10 inches to about 24 inches.

32. The system of claim 29 wherein the panels are left in place after the system is filled with concrete or another hardenable material.

33. The system of claim 30 wherein the panels have a thickness of from about 1 inch and an R value of about 1.0 to a thickness of about 3 inches and an R value of about 3 to about 21.

34. The system of claim 30 wherein the channel wall segments of the retaining sections of the wall tie rails, the corner brackets and the stabilizing tie rails are spaced from about 1 inch apart to about 3 inches apart.

35. The system of claim 34 wherein the wall segments of the wall tie rails extend over the panels from about 0.5 inches to about 2 inches.

36. The system of claim 35 wherein the wall segments of the corner brackets extend over the panels from about 0.5 inches to about 2 inches.

37. The system of claim 36 wherein the wall segments of the stabilizing tie rails extend over the panels from about 0.5 inches to about 2 inches.

38. A system for forming structures of concrete or other hardenable materials wherein the system comprises at least two intersecting wall sections forming a corner defined by at least two pairs of opposing inner forming panels and outer forming panels with a forming cavity therebetween;

at least one corner assembly having an inner corner bracket at the angular intersection of at least two inner panels, and outer corner bracket at the angular intersection of least two outer panels, and at least one web extending from the inner corner bracket to the outer corner bracket; the inner corner bracket holding the vertical edges of the intersecting inner panels in engagement channels, the outer corner bracket holding vertical edges of the intersecting outer panels in engagement channels; and at least a portion of the engagement channels extending over the panel edges a distance sufficient to inhibit the displacement of the panel edges from the channels when the panels are subject to pressure outwardly exerted from the forming cavity, and are in pivotal relation effective to movably position the panels engaged therein in a predetermined angular relation.

39. The system of claim 38 wherein the engagement channels generally extend a substantial length along the vertical edges of the panels.

40. The system of claim 39 wherein the corner bracket is provided with a locking plate fixed in place over a portion of the engagement channels after the angular relation of the panels is set, the locking plate of a length and width effective to prevent the further hinged movement of the channels.

41. A system for forming wall structures of concrete or other pourable, hardenable materials comprising:

one or more of pairs of opposing, vertical forming panels spaced from each other, a predetermined distance defining a forming cavity disposed to receive the concrete or other hardenable materials, the first panel of each pair of forming panels defining an inner wall and the second panel of each pair of forming panels defining an outer wall;

at least one corner assembly having an inner corner bracket at the angular intersection of at least two inner wall panels, and outer corner bracket at the angular intersection of at least two outer wall panels, and at least one corner web extending from the inner corner bracket to the outer corner bracket; the inner corner bracket engaging at least a portion of vertical edges of the intersecting inner wall panels, the outer corner bracket engaging at least a portion of the vertical edges of the intersecting outer wall panels; the brackets extending over the panel edges a distance sufficient to inhibit the displacement of the panel edges from the corner brackets when the panels are subject to pressure outwardly exerted from the forming cavity; and the corner web having at least one end provided with an inner corner retaining end, and the inner corner bracket is provided with at least one corner web retaining channel sized to receive and hold the inner corner web retaining end, and an opening to accept the inner corner retaining end within the web retaining channel.

42. The system of claim 41 wherein one or more wall tie rails extend between each adjacent pair of forming panels, holding and substantially fixing each form in a predetermined position relative to the other forms; each wall tie rail having a first retaining section disposed between and holding a side edge of the first inner wall forming panels and a second, spaced retaining section disposed between and holding one edge of the second outer wall forming panels, and at least one web member extending between the first and second retaining sections; and a first tie rail and a second tie rail angularly disposed from the first tie rail, the inner retaining portion of first tie rail holding an intersecting inner wall panel and the corner bracket, and the second tie rail holding the other intersecting inner wall panel and the corner bracket.

43. The system of claim 42 wherein the corner bracket is Y shaped and the inner retaining portion of the first wall tie rail holds one arm of the Y, the inner retaining portion of the second tie rail holds the other arm of the Y and the corner web is retained in the central leg of the Y.

44. A system for forming wall structures of concrete or other pourable, hardenable materials having variable wall thicknesses comprising:

one or more of pairs of opposing, vertical forming panels spaced from each other a predetermined distance defining a forming cavity disposed to receive the concrete or other hardenable materials, the first panel of each pair of forming panels defining an inner wall and the second panel of each pair of forming panels defining an outer wall;

at least one corner assembly having an inner corner bracket at the angular intersection of and holding the vertical edges of at least two inner wall panels, an outer corner bracket at the angular intersection of and holding vertical edges of at least two outer wall panels, and at least one corner web extending from the inner corner bracket to the outer corner bracket;

the brackets having at least one portion extending over the panel edges a distance sufficient to inhibit the displacement of the panel edges from the corner brackets when the panels are subject to pressure outwardly exerted from the forming cavity; and the corner web having at least one end provided with an inner corner retaining end, and the inner corner bracket is provided with a plurality of corner web retaining channels sized to receive and hold the inner corner web retaining end, each channel having an opening to accept the inner corner retaining end within the channel, and each channel spaced a progressively greater distance from the outer corner bracket effective to provide a corner forming cavity of different widths.

45. The system of claim 44 wherein the corner web is replaceable with a web of a different length effective to cooperate with the inner corner bracket channels to provide forming cavities of different widths.

46. The system of claim 44 wherein the corner web is provided with a second retaining end and the outer corner bracket is provided with at least one channel to receive and hold the second retaining end therein.

47. A system for forming structures of concrete or other pourable, hardenable materials comprising:

one or more of pairs of vertical forming panels having a length greater than their width, at least one panel made of a generally rigid foam material, the panels spaced from each other a predetermined distance to provide an inner wall defined by one panel and an outer wall defined by the other panel and a forming cavity sized to receive the concrete or other hardenable materials between the panels, and at least one corner assembly defined by the intersection of at least two outer wall panels at a preselected angle and the intersection of at least two inner panels at a preselected angle;

one or more wall tie rails disposed between adjacent wall panels extending generally a substantial length of vertical edges of the forming panels, each wall tie rail having a first retaining section disposed between and engaging adjacent outer wall panels and a second retaining section disposed between and engaging adjacent inner wall panels, and at least one web extending from the first retaining section to the second retaining section;

each of the wall tie rail retaining sections provided with at least two channels formed of a rear wall and outwardly extending wall segments, the openings of the channels generally disposed in opposing directions to receive at least a portion of the edges of each forming panel engaged by the retaining section; and the wall segments of each channel spaced apart and having a length effective contact the panel edges and inhibiting displacement of the panel edges from the channel when pressure is exerted against the panel;

one or more of the corner assemblies provided with an inner corner bracket at the angular intersection of and engaging at least two inner wall panels, an outer corner bracket at the angular intersection of and engaging at least two outer wall panels, and at least one web extending from the inner corner bracket to the outer corner bracket;

the inner and outer corner brackets having at least two channels formed of a rear wall and outwardly extending wall segments, the openings of the inner tie rail channels disposed at substantially the same angle as the angle of intersection of the inner wall panels to receive at least a portion of the edges of the panels engaged by the inner bracket, the openings of the outer tie rail channels disposed at substantially the same angle as the angle of intersection of the outer wall panels to receive at least a portion of the edges of the panels engaged; and the wall segments of each channel of the corner brackets spaced apart and having a portion with a length effective to retain the panel edges within the channel and inhibit displacement of the panel edges from the channel when pressure is exerted against the panel.

48. The forming system of claim 47 wherein the corner assemblies include a first stabilizing tie rail and a second stabilizing tie rail comprising a retaining section provided with at least two channels formed of a rear wall and outwardly extending flanges, the openings of the channels generally disposed in opposing directions to receive at least a portion of a forming panel; the flanges spaced apart and having a length effective to inhibiting displacement of the forming panel from the channel when pressure is exerted against the panel and to maintain the panel in a generally vertical alignment;

a channel opening of the first stabilizing tie rail disposed opposite a first channel of the outer corner bracket and the channel opening of the second stabilizing tie rail disposed opposite a second channel of the corner bracket opening of the outer corner bracket, and an outer wall panel disposed in the first stabilizing tie rail channel and the first corner bracket channel and an outer wall panel disposed in the second stabilizing rail channel and the second corner bracket channel, the edges of the outer wall panels retained within the opposing channels; and a first web extending between the retaining section of the first stabilizing tie rail and the inner corner bracket, and a second web extending between the retaining section of the second stabilizing tie rail and the inner corner bracket, the web of the first stabilizing web and the second stabilizing web disposed at a relative angle effective to assist in maintaining the angle of intersection of the outer wall panels and inner wall panels.

49. The forming system of claim 48 wherein one or more of the corner webs extending from the outer corner brackets to the inner corner bracket are reversibly detachable from the inner corner bracket.

50. A system for forming structures of concrete or other pourable, hardenable materials comprising:

two or more adjacent pairs of vertical forming panels spaced from each other to define a forming cavity to receive concrete or other hardenable materials, one panel of each pair forming panels defining an inner wall and the other panel defining an outer wall;

one or more tie rails between each adjacent pair of forming panels, the tie rails holding and substantially fixing each form in a predetermined position relative to other forms, each tie rail having a first retaining section disposed between and holding edges of the adjacent inner wall forming panels and a second retaining section spaced from the first retaining section and disposed between and holding the edges of the outer wall forming panels, and at least one web member extending between the first and second retaining sections;

the retaining sections having at least one portion extending over the panel surfaces a distance sufficient to inhibit displacement of the panel edges from the retaining sections when the panels are subject to pressure from the forming cavity, and the tie rail web effective to maintain the spacing and relative position of the retaining sections during assembly of the system and pouring of concrete or other hardenable materials into the forming cavity; and at least one window opening cut into at least one pair of opposing inner wall panels and outer wall panels, a window buck disposed in the window opening, the window buck having surfaces extending between the inner and outer panels effective to prevent a substantial flow of concrete or other hardenable materials into the window opening and the surfaces presized to accommodate a window assembly therein.

51. The system of claim 50 wherein the window buck and window assembly are supplied preassembled with the window buck prefitted to the window assembly and removable from the window assembly for insertion in the window opening.

52. The system of claim 51 wherein the window assembly and window buck are inserted in the window opening before the system is filled with concrete or other hardenable materials, and the window assembly is covered with protective materials effective to prevent damage to the window during the filling of the system.

53. The system of claim 50 wherein a door opening is formed in opposing inner and outer panels, and a door buck is disposed in the door opening, the door buck having surfaces effective to inhibit the flow of concrete or other materials into the door opening and in the system, the door buck surfaces prefitted to a door assembly.

54. A tie rail for holding forming panels of a system for forming structures of concrete or other pourable, hardenable materials comprising:

a first retaining section, a second retaining section spaced from the first retaining section, and at least one web member extending between the first and second retaining sections, the retaining sections engageable with at least one edge of a forming panel, the retaining sections having at least one engagement portion disposed to contact and extend over the surface of a forming panel edge and to extend generally a substantial length of vertical edges of the panel, the engagement portion having a weakened zone effective to permit the removal of at least a portion of the engagement portion from the retaining section along the weakened zone; and the engagement portion extending a distance effective to inhibit displacement of the panel edges from the retaining sections when the panel is subject to pressures from the concrete or other hardenable materials, and the tie rail web effective to maintain the spacing and relative position of the retaining sections.

55. The tie rail of claim 54 wherein tie rail extends generally continuously along a substantial length of the vertical edges of the panel, and the retaining sections comprise engagement channels positioned to receive the panel edges therein, the channels having a rear wall and engagement wall segments disposed to hold the outer surfaces of panel edges inserted into the channels, the wall segments extending a distance effective to inhibiting displacement of forming panel edges from the channels when pressure is exerted against the panels.

56. The tie rail system of claim 55 wherein at least one engagement wall segment is disposed to lie along the surface of a panel inserted into the retaining portion and to provide an attachment surface spaced from the panel surface.

57. The tie rail of claim 56 wherein the attachment surface extends generally continuously along the vertical height of the tie rail is effective to retain siding or other wall materials fixed thereto and cooperate with the panel surface to provide a drainage plane behind such siding or other wall materials.

58. The tie rail claim 55 wherein the rear wall of the engagement channels is provided with the weakened zone extending generally the length of the engagement channel, the weakened zone effective to permit the removal of at least a portion of the engagement channel from the retaining section along the weakened zone.

59. The tie rail of claim 54 wherein the tie rails are provided with at least one horizontal web extending between the retaining portions and at least one web extending between the retaining portions at an acute angle, the webs spaced to allow the flow of concrete or other hardenable materials therebetween.

60. The tie rail of claim 54 wherein the web is provided with at least one retainer sized and positioned to hold a reinforcing bar in a predetermined position and orientation between the first and second retaining sections.

61. The tie rail of claim 55 wherein the channel wall segments of the retaining sections of the wall tie rails are spaced from about 1 inch apart to about 3 inch apart.

62. The tie rail of claim 61 wherein the wall segments of the wall tie rails extend over the panels from about 0.5 inches to about 2 inches.

63. A corner assembly for holding forming panels of a system for forming structures of concrete or other pourable, hardenable materials comprising:

an inner corner bracket, an outer corner bracket, and at least one web extending from the inner corner bracket to the outer corner bracket; the inner corner bracket engageable with edges of a first set of intersecting forming panels to provide a first corner, the outer corner bracket engageable with the edges of a second set of intersecting forming panels to provide a second corner;

each bracket extending generally a substantial length along the vertical edges of the panels and having at least one wall extending a distance sufficient to inhibit the displacement of the engaged panel edges from the corner brackets when the panels are subject to pressure; and at least a first stabilizing tie rail and at least a second stabilizing tie rail angularly displaced from the first stabilizing tie rail, each tie rail with a retaining section, an attachment end fixed to the inner corner bracket and at least one web section therebetween;

the retaining section of the first stabilizing tie rail disposed to hold the edges of one of forming panels from the second set of intersecting panels, the second stabilizing tie rail disposed to hold edges of another of the panels from the second set of intersecting panels and an adjacent outer wall panel, the stabilizing tie rails displaced at an angle effective to redistribute loads imposed by pressure exerted on the panels and corner brackets, and the retaining sections of the stabilizing tie rails extending over panel edges held by the tie rail a distance effective to inhibit the displacement of the panel edges from the retaining sections.

64. The corner bracket of claim 63 wherein each inner and outer corner bracket extends generally continuously along the vertical edges of the panels, and includes at least two channels to retain the panel edges held by the brackets, the channels comprising a rear wall and outwardly extending walls, and the channel openings disposed at substantially the same angle as the intersecting panels inserted therein, the channel wall disposed to hold on each side of panel edges disposed within the channel; and the channel extending a distance effective to inhibiting displacement of engaged panel edges from the channels during assembly of the system and when pressure is exerted against the panels.

65. The forming system of claim 64 wherein the stabilizing tie rails extend generally a substantial length of the vertical edges of the panels, and the stabilizing rail web and corner webs comprise two or more horizontal webs and two or more webs extending at an acute angle.

66. The forming system of claim 65 wherein the stabilizing tie rails are provided with retainer members sized and positioned to hold reinforcing bars in a predetermined position, and orientation between the outer side wall and the inner side wall.

67. The stabilizing tie rails of claim 65 wherein the attachment ends of the stabilizing tie rails is reversibly detachable from the inner corner assembly.

68. The stabilizing tie rails of claim 64 wherein the attachment ends of the stabilizing tie rails comprise a generally T-shaped flange, and the surface of each inner corner bracket is provided with slots disposed and sized to engage the T-shaped flanges of the stabilizing tie rail attachment sections to retain the flanges within the slots.

69. The stabilizing tie rails of claim 68 wherein the flanges of stabilizing tie rail attachment end comprise a first straight segment and a second segment extending from the first segment at an acute angle and the slots of the inner corner bracket are provided with walls corresponding to and encompassing the flange segments to retain the flanges in the slots.

70. The system of claim 64 wherein at least one the stabilizing tie rail or corner bracket provides at least one attachment surface spaced outwardly from the panel surface effective to retain siding or other wall materials fixed thereto and to cooperate with the panel surfaces to provide a drainage plane behind such siding or other wall materials.

71. The system of claim 70 wherein the attachment surfaces of the stabilizing tie rails extend generally the vertical height of the rails and are removable from the system along a weakened portion of the tie rails.

72. The corner assembly of claim 70 wherein the channel walls of the corner bracket retaining sections and the stabilizing tie rails are spaced from about 1 inch apart to about 3 inches apart.

73. The system of claim 72 wherein the channel walls of the stabilizing tie rails extend over the panels from about 0.5 inches to about 2 inches.

74. The system of claim 73 wherein the channel walls of the corner brackets extend over the panels from about 0.5 inches to about 2 inches.

75. A corner assembly for holding forming panels of a system for forming structures of concrete or other hardenable materials comprising:

an inner corner bracket, outer corner bracket and at least one web extending from the inner corner bracket to the outer corner bracket; the inner corner bracket engageable to hold edges of a first set of intersecting panels to form a first corner, the outer corner bracket engageable to hold edges of a second set of intersecting wall panels to form a corner; and the corner brackets having channels disposed to hold the panel edges, the inner and outer corner brackets each having a pivot permitting positioning of the panels held by the brackets in more than one angular relation, and the bracket channels having at least one engagement wall extending over the panel edges held by the brackets a distance sufficient to inhibit the displacement of the panel edges from the corner brackets when the panels are subject to pressure.

76. The system of claim 75 wherein each corner bracket is provided with a locking plate fixable over a portion of the bracket channels with panels length and width effective to prevent the further pivotal movement of the bracket channels.

77. The corner assembly of claim 75 wherein each bracket is provided with a hinge extending from a portion of one bracket channel to the other bracket channel, the channels pivotally movable about the hinges.

78. A corner assembly for holding the forming panels of a system for forming wall structures of concrete or other pourable, hardenable materials comprising:

an inner corner bracket, an outer corner bracket, and at least one corner web extending from the inner corner bracket to the outer corner bracket; the inner corner bracket engageable to hold vertical edges of a first set of intersecting wall panels to form a first corner, the outer corner bracket engageable to hold the vertical edges of a second set of intersecting wall panels to form a second corner;

the corner brackets having at least one engagement wall extending a distance sufficient to inhibit the displacement of the panel edges held inserted within the corner brackets from the brackets when the panels are subject to pressure;

the corner web having at least one end provided with an inner corner retaining portion, and the inner corner bracket is provided with at least one corner web retaining channel sized to receive and hold the inner corner web retaining portion, and an opening to accept the inner corner retaining portion within the channel.

79. The corner assembly of claim 78 wherein the inner corner bracket is provided with a plurality of corner web retaining channels sized to receive and hold the inner corner web retaining portion, each channel having an opening to accept the inner corner retaining portion within the channel, and each channel spaced a progressively greater distance from the outer corner bracket effective to provide a forming cavity between the first and second sets of panels of different widths when the inner corner web is fixed therein.

80. The corner assembly of claim 79 wherein the corner web is replaceable with a web of different lengths effective to cooperate with the inner corner bracket channels to provide forming cavities of different widths.

81. A corner assembly for holding forming panels for a system for forming structures of concrete or other pourable, hardenable materials comprising:

an inner corner bracket, an outer corner bracket, and at least one binding member extending from the inner corner bracket to the outer corner bracket; the inner corner bracket and the outer corner bracket having cooperating openings formed therein positioned to accept the binding member therein, the inner corner bracket engageable to hold at least a portion of edges of a first set of intersecting panels forming a first corner, the outer corner bracket engageable to hold edges of a second set of intersecting panels forming a second corner; and each bracket having at least one engagement wall extending over panel edges held by the brackets, the engagement wall extending a distance sufficient to inhibit the displacement of the panel edges from the corner brackets when the panels are subject to pressure.

82. The system of claim 81 wherein each inner corner bracket is formed of the first retaining portions of adjacent tie rails, the tie rails having second retaining portions spaced from the first retaining portion, with a web therebetween, the tie rail retaining portions including at least two channels formed of a rear wall and outwardly extending walls, the openings of the channels disposed to accept the edge of a forming panel therebetween.

83. A method of forming wall structures of concrete or other pourable, hardenable material and having exterior panels used as forms and retained as a permanent component of the wall structure, said method comprising:

providing a lower base;

erecting tie rails on the base with a laterally extending portion of the tie rails extending laterally across the wall structure and having substantial openings therein through which the pourable, hardenable material may flow and hardened therein;

providing substantially rectangular and substantially flat surface panels;

positioning the substantially rectangular and flat panels in rows opposite one another to define a wall cavity therebetween disposed to receive the pourable material;

holding of at least the edges of the panels by retaining portions on the tie rails to retain the panels in position against outwardly directed pressure from the pourable material poured into the cavity;

forming two wall structures meeting at an angle to form a corner between the two wall structures having the cavity therebetween;

providing an inner corner bracket and an outer corner bracket with at least one web extending between the inner corner bracket to the outer corner bracket having substantial openings therein to be filled with the pourable material;

connecting a pair of corner connector tie rails to the inner corner bracket, the corner connector tie rails having an end adapted for connection to the inner corner bracket and an opposite end having retaining portions to retain the panels in position against outwardly directed pressure form the pourable material poured into the cavity;

positioning substantially rectangular and flat surface corner panels to define an outer side for the corner and an inner side for the corner, the substantial edge margins of the outer panels being held by the outer corner brackets, the corner bracket ties rails, and the web extending between the inner and outer corner brackets to resist the outwardly directed pressure from the material poured into the cavity; and pouring of the pourable material into the cavity and through the openings in the lateral extending portions of the tie rails to form a continuous wall structure with embedded tie rails and the opposing sides of the wall structure clad with exterior panels.

84. The method of claim 83 wherein the tie rails extend generally a substantial length of the vertical edges of the panels and the panels comprise polymeric foam.

85. The method of claim 83 wherein tie rails are operatively connected to the bracket holding the corner panels edges providing the inner side of the corner, the tie rails disposed to hold the marginal edges of the panels forming the outer side of the corner to distribute the stresses exerted on the corners, and resist outwardly directed pressures from in the cavity.

86. The method of claim 83 wherein the length of the laterally extending portion is adjustable to provide a cavity having a predetermining size.

87. The method of claim 83 wherein the laterally extending portion is connected to one of the corner brackets by inserting one retaining ends of the laterally extending portion in a channel formed in the corner bracket sized to hold the retaining end.

88. The method of claim 83 wherein the laterally extending portion is formed by at least one binding member removably connected to each bracket.

89. The method of claim 83 wherein the corner brackets are provided with channels sized to hold the panel edge margin therein and the channels pivotally moveable to more than one corner angle, and positioning the corner panels to a desired corner angle.

90. The method of claim 83 wherein footing brackets are provided dispersed along the bottom edge margins of the walls to assist the outward pressure on the panels from the forming cavity, the footing brackets provided with corrugations forming drainage channels.

91. The method of claim 90 wherein before tie rails and panels are positioned on the base, a set of footing brackets are installed on the base, spaced a distance apart effective to engage the outer peripheral surfaces of the panels and ties, the footing brackets provided with an upwardly extending wall, and the upward extending wall is used as a side form to provide a slab of poured concrete or other pourable hardenable material adjacent the wall structure.

92. The method of claim 83 wherein a window opening is provided in the wall structure by cutting a window open in the opposing panels and providing a window buck in the opening sized to inhibit the flow of concrete or other hardenable materials into the window opening, the window buck premated with a window assembly.

93. A method in accordance with claim 83 including:

removing exterior retaining portions of the tie members to leave vertical extending grooves between adjacent panels with the panels being held substantially by surface interlocking of flat surfaces of the panels and flat surfaces of the poured, hardened material of the wall structure.

94. A wall structure formed of a poured, hardenable material and a cladding of exterior polymeric foam panels, the structure comprising:

a body of hardened, poured material extending vertically and horizontally and having opposite side walls;

a series of tie rails spaced along and embedded within the body;

laterally extending portions of the tie rails spanning the side walls of the body and having openings therein through which the poured material flowed to provide a continuous body through the series of tie rails;

outer retaining sections on the tie rails for retaining polymeric panels to form a wall cavity therebetween to receive the pourable material, the retaining sections on the tie rails having an outer retaining strip detachably connected to the tie rail so that the retaining strip is detachable; and substantially rectangular and substantially flat panels of polymeric foam materials substantially covering the opposite side walls of the wall structure.

95. A wall structure in accordance with claim 94 wherein:

reinforcing members are attached to the tie rails at positions spaced from the foam panels and within the cavity to be embedded in the pourable material.

96. A wall structure in accordance with claim 94 wherein:

panels are positioned within vertical channels at opposite vertical ends of the rails.

97. A wall structure in accordance with claim 96 wherein:

the outer retaining sections on the tie rails comprise vertically extending channels sized to the thickness of marginal vertical edges of the panels to hold these marginal vertical edges of the panels, and extending generally a substantial length of the vertical edges of the panels.

98. A wall structure in accordance with claim 96 wherein:

the wall panels have a substantially uniform cross-sectional thickness throughout.

99. A wall structure in accordance with claim 96 wherein:

the outer retaining strip detachably connected to the tie rail so that the retaining strip may be detached leaving a vertically extending groove between adjacent foam panels.

100. A wall structure in accordance with claim 96 comprising:

first and second wall structures meeting at an angle to form a corner therebetween;

a corner body of the poured material integral with the poured body of the first and second wall structures;

a corner tie rail having a laterally extending section embedded in the poured corner body and extending laterally across the body;

portions of the laterally extending section of the corner tie rail defining openings having therein the poured material of the corner body;

outer retaining sections on the corner tie rails; and outer corner panels of polymeric material being substantially rectangular and flat cladding the exterior of the corner body and being held by the tie bars to define a corner cavity to receive the pourable material and to resist outward pressure therefrom.

101. A wall structure in accordance with claim 100 wherein the corner panels are curved to provide a curved corner.

102. A wall structure in accordance with claim 96 wherein:

the outer retaining section of tie rails have an outer detachable, vertically extending portion having been detached from the embedded tie rail to leave a vertically extending groove between adjacent panels.

103. A wall structure in accordance with claim 96 wherein:

the polymeric foam wall panels have a substantially constant, uniform thickness throughout and has substantially smooth surfaces on opposite sides thereof prior to pouring of the pourable material; and the pourable material is concrete that adheres to the inner surface of the smooth surface.

104. A wall structure in accordance with claim 96 wherein:

reinforcing elements for the pourable material are held by the tie rails and the pourable material hardens thereabout embedding the reinforcing elements in the wall structure.

105. A wall structure in accordance with claim 96 wherein:

the outer retaining sections comprise a pair of adjacent channels facing in opposite directions on the tie rail to receive adjacent vertical edges of adjacent foam panels therein.

106. A wall structure in accordance with claim 96 wherein the tie rails are substantially I-beam in shape having a laterally extending portion in the form of a web between the channels, the channels by pairs of vertical flanges projecting outwardly from opposite ends of the web.

107. A system for forming structures of concrete or other pourable, hardenable materials comprising:

two or more adjacent pairs of vertical forming panels, each pair of panels spaced apart and defining a forming cavity to receive concrete or other hardenable materials and one panel defining an inner wall and the other panel defining an outer wall;

at least one tie rail between each adjacent pair of forming panels, the tie rail engaging edges of the panels substantially fixing each panel in a predetermined position relative to the other panels, the tie rail having a first retaining section holding the edges of the inner wall forming panels and a second retaining section the edges of the outer wall forming panels, the first and second retaining sections holding the panel edges without exerting substantial force on the panel edges, and at least one web extending between the first and second retaining sections, the tie rail having a frangible zone effective to permit the removal of at least a portion of the tie rail along the frangible zone;

at least one portion of the retaining sections extending generally the substantial length of the vertical edges of the panels and extending over the surface of the panel edges a distance sufficient to inhibit displacement of the panel edges from the retaining sections when the panels are subject to pressure outwardly exerted by concrete or other hardenable materials within the forming cavity.

108. The system of claim 107 wherein the tie rail retaining sections comprise channels positioned to receive the panel side edges therein, the channels defined by a rear wall and at least one engagement wall segment extending over, and holding the outer surface of the panel edges effective to inhibit displacement of the edges from the channel when pressure is exerted against the panel.

109. The system of claim 108 wherein at least one wall segment of a tie rail retaining section provides an attachment surface spaced from an exterior wall surface of the forming panels, and the rear wall of the engagement channels are provided with a frangible zone extending generally the length of the engagement channel, the frangible zone effective to permit the removal of at least a portion of the engagement channel from the system along the frangible zone.

110. The forming system of claim 109 wherein the tie rails are provided with at least one horizontal web extending between the tie rail retaining sections and the tie rail retaining sections extend at least generally the height of the vertical height of the panels and the vertical height of the panels is generally greater than their width.

111. The system of claim 110 wherein the channel wall segments of the retaining sections of the wall tie rails are spaced from about 1 inch apart to about 3 inches apart.

112. The system of claim 111 wherein the wall segments of the wall tie rails extend over the panels from about 0.5 inches to about 2 inches.

113. A system for forming structures of concrete or other pourable, hardenable materials comprising:

two or more adjacent pairs of vertical forming panels, each pair of panels spaced apart and defining a forming cavity to receive concrete or other hardenable materials and one panel defining an inner wall and the other panel defining an outer wall;

at least one tie means between each adjacent pair of forming panels for engaging edges of the panels and substantially fixing each panel in a predetermined position relative to the other panels, the tie means having a first retaining means for holding the edges of the inner wall forming panels and a second retaining means for holding the edges of the outer wall forming panels, and at least one means for connecting the first and second retaining means, and the tie means having means for weakening a portion of the tie means effective to permit the removal of at least a portion of the tie means from the system;

at least one portion of the retaining means extending over the surface of the panel edges for inhibiting displacement of the panel edges from the retaining means when the panels are subject to pressure outwardly exerted by concrete or other hardenable materials within the forming cavity.

114. The system of claim 113 wherein at least one tie means provides an attachment means spaced from an exterior wall surface of the forming panels effective to retain siding or other wall materials fixed to the surface and cooperates with the panel surfaces to provide a drainage plane behind such siding or other wall materials.

115. The system of claim 114 wherein and the vertical height of the panels is generally greater than their width, the tie means extend at least generally the height of the vertical height of the panels, and provide a generally continuous attachment surface along the vertical height of the tie means.

116. The system of claim 113 wherein the panels comprise polymeric foam and have a thickness of about 1 inch and an R value of about 10 to a thickness of about 3 inches and an R value of about 21.

117. The forming system of claim 113 wherein the bottom edges of the wall panels are engaged and supported by a footing, and are disposed between a first restraining means for holding the lower edges of the panels and a second restraining means for holding the lower edges of the panels spaced from the first means a distance sufficient to provide a cavity for receiving concrete or another hardenable material between forms held by the first and second restraining means.

* * * * *